US006899790B2

(12) United States Patent
Lee

(10) Patent No.: US 6,899,790 B2
(45) Date of Patent: May 31, 2005

(54) METHOD OF PROVIDING PAPERMAKING FIBERS WITH DURABLE CURL

(75) Inventor: Jeffrey A. Lee, Neenah, WI (US)

(73) Assignee: Georgia-Pacific Corporation, Atlanta, GA (US)

( * ) Notice: Subject to any disclaimer, the term of this patent is extended or adjusted under 35 U.S.C. 154(b) by 0 days.

(21) Appl. No.: 09/793,863

(22) Filed: Feb. 27, 2001

(65) Prior Publication Data

US 2001/0040015 A1 Nov. 15, 2001

Related U.S. Application Data

(60) Provisional application No. 60/187,106, filed on Mar. 6, 2000.

(51) Int. Cl.[7] ..... D21B 1/12; D21B 1/16; D21C 5/02; D21C 9/147; D21C 9/16

(52) U.S. Cl. ..... 162/4; 162/6; 162/7; 162/8; 162/9; 162/23; 162/26; 162/78; 162/90; 162/111

(58) Field of Search ..... 162/9, 111, 68, 162/25, 23, 26, 130, 51, 243, 4, 6, 7, 8, 78, 90, 50

(56) References Cited

U.S. PATENT DOCUMENTS

| | | | | |
|---|---|---|---|---|
| 2,008,892 | A | 7/1935 | Asplund | 92/20 |
| 2,516,384 | A | 7/1950 | Hill et al. | 92/20 |
| 3,023,140 | A | 6/1962 | Textor | 162/24 |
| 3,382,140 | A | 5/1968 | Henderson et al. | 162/28 |
| 3,773,610 | A | 11/1973 | Shouvlin et al. | 162/19 |
| 3,808,090 | A | 4/1974 | Logan et al. | 162/23 |
| 3,873,412 | A | 3/1975 | Charters et al. | 162/25 |
| 3,948,449 | A | 4/1976 | Logan et al. | 241/41 |
| 4,036,679 | A | 7/1977 | Back et al. | 162/9 |
| 4,187,141 | A | 2/1980 | Ahrel | 162/23 |
| 4,409,065 | A | 10/1983 | Kasser | 162/9 |
| 4,431,479 | A | 2/1984 | Barbe et al. | 162/9 |
| 4,455,195 | A | 6/1984 | Kinsley | 162/13 |
| 4,488,932 | A | 12/1984 | Eber et al. | 162/9 |
| 4,548,674 | A | 10/1985 | Hageman et al. | 162/5 |
| 4,734,160 | A | 3/1988 | Moldenius | 162/71 |

(Continued)

FOREIGN PATENT DOCUMENTS

| | | | |
|---|---|---|---|
| EP | 0 096 460 A2 | 12/1983 | D21C/9/00 |
| EP | 0 101 319 A2 | 2/1984 | D21F/11/00 |
| EP | 0 252 650 A2 | 1/1988 | A61L/15/00 |
| EP | 0 440 472 A1 | 8/1991 | D21H/11/20 |
| WO | WO98/27269 | 6/1998 | D21C/9/00 |
| WO | WO00/39388 | 7/2000 | D21B/1/36 |

*Primary Examiner*—Steve Alvo
(74) *Attorney, Agent, or Firm*—Michael W. Ferrell

(57) ABSTRACT

A process for producing high bulk cellulosic fiber exhibiting a durable elevated curl index includes: (a) concurrently heat treating and convolving cellulosic fiber pulp at elevated temperature and pressure at high consistency under conditions selected so as to preclude substantial fibrillation and attendant paper strength and fiber bonding development; and (b) recovering the pulp wherein the length weighted curl index of the treated fiber is at least about 20% higher than the length weighted curl index of the fiber prior to the heat treatment and convolving thereof. The curl imparted to the fiber persists upon treatment for 30 minutes in a laboratory disintegrator at 3000 rpm at 1% consistency at a temperature of 125° F. Moreover, the curl may be imparted to the fiber in a disk refiner at very short residence times, on the order of several seconds or less. In general, the process is carried out in the presence of saturated steam at a pressure of from about 5 to about 150 psig.

67 Claims, 24 Drawing Sheets

U.S. PATENT DOCUMENTS

| | | | | |
|---|---|---|---|---|
| 4,756,798 | A | | 7/1988 | Lachenal et al. ..... 162/24 |
| 4,898,642 | A | | 2/1990 | Moore et al. ..... 162/157 |
| 4,915,785 | A | | 4/1990 | Siminoski et al. ..... 162/78 |
| 4,938,842 | A | | 7/1990 | Whiting et al. ..... 162/78 |
| 4,976,819 | A | | 12/1990 | Minton ..... 162/9 |
| 5,102,501 | A | * | 4/1992 | Eber et al. ..... 162/111 |
| 5,211,809 | A | | 5/1993 | Naddeo et al. ..... 162/6 |
| 5,244,541 | A | | 9/1993 | Minton ..... 162/28 |
| 5,296,100 | A | | 3/1994 | Devic ..... 162/78 |
| 5,348,620 | A | | 9/1994 | Hermans et al. ..... 162/9 |
| 5,384,011 | A | | 1/1995 | Hazard, Jr. ..... 162/9 |
| 5,384,012 | A | | 1/1995 | Hazard, Jr. ..... 162/9 |
| 5,501,768 | A | | 3/1996 | Hermans et al. ..... 162/9 |
| 5,571,377 | A | | 11/1996 | Tibbling et al. ..... 162/52 |
| H1704 | H | | 1/1998 | Wallajapet et al. ..... 536/30 |
| 5,755,926 | A | | 5/1998 | Hankins et al. ..... 162/6 |
| 5,772,845 | A | | 6/1998 | Farrington, Jr. et al. .... 162/109 |
| 5,834,095 | A | | 11/1998 | Dutkiewicz et al. ..... 428/191 |
| 5,858,021 | A | | 1/1999 | Sun et al. ..... 8/125 |
| 5,997,689 | A | | 12/1999 | Bokstrom ..... 162/6 |

* cited by examiner

| CURL INDEX: | 0 | 0.15 | 0.28 | 0.43 | 1.17 | 1.50 | 2.23 |
|---|---|---|---|---|---|---|---|
| KINK INDEX (1/mm): | 0.0 | 2.2 | 3.3 | 5.6 | 7.8 | 13.3 | 21.1 |

METHOD OF PROVIDING PAPERMAKING FIBERS WITH DURABLE CURL

CLAIM FOR PRIORITY

This non-provisional application is based upon and claims priority with respect to U.S. Provisional Patent Application Ser. No. 60/187,106, of the same title, filed Mar. 6, 2000.

TECHNICAL FIELD

The present invention relates generally to papermaking fibers and more specifically to an improved method of providing durable curl to fiber by way of high temperature and pressure, low mechanical energy processing.

BACKGROUND

Refining and bleaching cellulosic fibers for papermaking is well-known. Various systems and processes are used for preparing pulps, including chemical pulping processes such as the Kraft process, mechanical processes, chemi-mechanical processes, thermo-mechanical processes and so forth. The art is appreciated by reference to the following patents and patent applications.

U.S. Pat. No. 2,008,892 to Asplund discloses an apparatus for refining wood chips into mechanical pulp provided with a grinding portion including a stationary disk, and a rotating disk.

There is disclosed in U.S. Pat. No. 2,516,384 to Hill et al. a process for mechanically curling cellulose fibers. The method of the '384 patent includes forming the pulp in the presence of a limited amount of aqueous liquid into small, discreet nodules of fibers and causing the nodulated pulp to form into rotatable units and travel roll wise under compression, thereby subjecting the nodules to mechanical pressure with continuous reorientation of the nodules relative to the direction of applied pressure and thus imparting kinks, bends, and twists to the pulp fibers or fiber bundles. See Col. 4, lines 73 and following, through Col. 5, lines 1–20.

U.S. Pat. No. 3,023,140 to Textor discloses adding hydrogen peroxide and wood chips to a refiner for the purpose of simultaneously bleaching and refining the chips. (See FIGS. 2 and 3).

U.S. Pat. No. 3,382,140 to Henderson et al. is directed to a process for fibrillating cellulosic fibers. Cellulosic high consistency papermaking pulp in the form of a semi-solid, non-flowable and nonpumpable lumping mass composed of defibered fibers is continuously refined by passage through a refining space comprising opposed disk like working surfaces relatively rotatable about a common axis wherein the pulp is continuously maintained packed under high compression to cause defibrillation by interfiber friction along the surfaces of the individual separated fibers without substantially fracturing the fibers. In general, fibrous material is defibered and than dewatered to increase its consistency to a level where it forms a semisolid, nonflowable moist mass adapted for high consistency refining. Pulp consistency in the range of between about 10% and about 60% with the fibers in intimate contact; preferably between about 20 and 35% is satisfactory. If the consistency is much below 10% (according to the patent) the amount of water present may act as a lubricant preventing the desired reining by inter-fiber friction. If much greater than 60%, the pulp will be too dry which may be result in burning under the inter fiber friction. Examples of the '140 patent teach mechanical power input of from about 5 to about 40 HP day/ton of pulp produced.

There is disclosed in U.S. Pat. No. 3,773,610 to Shouvlin et al. a pressurized system for pulp refining including pressurized double disk treatment. According to the '610 patent, all fibrous materials are passed through a series of treatments under a steam pressurized atmosphere of from 10 to 150 psig and a temperature of between 115° C. and 200° C. in the absence of accompanying liquid. The raw fibrous materials are initially passed through a tube in which they conditioned by either the steam atmosphere, or by liquid chemicals under steam pressure, and then are passed between simultaneously rotating disks of a double disk refiner which is also under steam pressure. Subsequent to treatment with the disks the fibrous materials are passed to another conditioning tube, such as a digester or a bleach tower where they are further conditioned by liquid chemicals under the same steam pressurized conditions. The fibrous materials may thereafter be washed, cooled and/or pressed.

U.S. Pat. No. 3,808,090 to Logan et al. to a method of making wood pulp involving the mechanical abrasion of wood particles in the presence of water in an inert gaseous atmosphere. According to the process, wood particles are fed into a substantially closed chamber where they are mechanically abraided in the presence of water in an inert gaseous atmosphere (steam) at an environmental pressure of 10–60 psig, a temperature of 160°–300° F. and under a power consumption of 50–150 horsepower days per ton. In the '090 patent the Aspland process is characterized as suitable only for low quality pulp. It is noted that the conditions of the Aspland process are selected to provide mechanical reduction of the wood into fibers with the least possible energy input. To this end, high pressures of the order of 115–150 psig and relatively low energy input of the order of 7–12 horsepower days per ton are employed to obtain the best results. See Col. 1, lines 51–65.

U.S. Pat. No. 3,873,412 to Charters et al. relates to a method of mechanically refining a mixture of Kraft and semichemical pulp. The method is used for producing pulp for use in the manufacture of Kraft type products such as liner board and bag grade paper comprising the steps of steaming small segments of fibrous material, defiberizing the same in a pressurized atmosphere at an elevated temperature and, while the resultant fiber products are still hot, mixing them with hot Kraft pulp and then refining the mixture so obtained.

U.S. Pat. No. 3,948,449 to Logan et al. is directed to an apparatus for the treatment of lignocellulosic material. The '449 patent also relates to the production of a mechanical pulp of improved strength properties. The lignocellulosic material is fed into a substantially closed chamber where it is mechanically abraided under a power input of 15 or more HP day/ton. During the abraiding step the material is maintained in an inert gaseous atmosphere at a pressure of 10–80 psig, preferably 20–40 psig. It is noted in the '449 patent that the Asplund process is well known in the industry for the manufacture of low grade pulps for employment in the manufacture of roofing and flooring felts. The system involves generally presteaming wood chips followed by refining under high pressure. The products are not suitable for high quality or high strength papermaking because of their inherent low strength and other poor papermaking qualities.

U.S. Pat. No. 4,036,679 to Back at al. is directed to a process for producing convoluted and fiberized cellulose fibers and sheet products. The process includes the application of contortive forces to a pulp muss under controlled operating conditions, wherein the feed rate, work space gap and relative rate of movement of the working elements applying the contortive forces are correlated to maintain the work space filled with fibers under sufficient compression. Sheets made from these fibors exhibit excellent bulk softness and absorbency properties, even when the formation process is conducted in an aqueous system, and even when the substantial compacting forces are applied to the wet web process. According to Col. 6 of the '679 patent, the minimum net specific energy is at least about 1.0 HPD/ADT and more preferably at least about 1.5 HPD/ADT is maintained. Moreover it is noted in col. 10, of the '679 patent that when making sheet from the pretreated fiber, that the web is introduced to a nonthermal dewatering means which subjects it to compressive forces exerted by at least one dewatering means. See Col. 10, lines 1 to 57.

U.S. Pat. No. 4,187,141 to Ahrel et al. relates to the production of bleached wood pulp from wood chips using a disk refiner. In this patent it is disclosed to impregnate wood chips with an alkaline bleaching liquid prior to defibrating the chips in the refiner.

U.S. Pat. No. 4,409,065 to Kasser discloses a method of making an improved bag from Kraft pulp including a curlation step before web formation. The curlation step is preferably carried out promptly before the web is formed.

U.S. Pat. No. 4,431,479 to Barbe et al. is directed to a method for treating pulp fibers that have already been curled. The method includes subjecting the pulp to a heat treatment while the pulp is at a high consistency, thereby rendering the curl permanent to subsequent mechanical action. The permanent curl has advantages for paper machine runnability and for increasing the toughness of the finished product. During the process of papermaking most of the curl in both high consistency refined mechanical and high yield sulfite pulp is lost in the subsequent steps of handling at low consistency and high temperatures. See Col. 3, lines 20–29. In the '479 patent the method of curling takes place at medium to high consistency (15%–35%) and may be a high consistency disk refining action as is generally used in pulp manufacture. Col. 4, lines 32–35. According to the '479 patent, it is seen that the process is highly effective for ligno cellulosic pulp fibers, for example, mechanic pulp and high yield sulfite pulp fibers. The treatment reportedly has no effect on cellulosic pulp fibers which contain little or no lignin. Col. 8, lines 4–10. The heat treatment process described in the '479 patent takes place in a digester at a temperature of about 150° C. after the fibers have been curled. Generally, the method is reported useful for treating high yield or mechanical pulps which have been curled by a high consistency action which method includes subjecting the pulp to a heat treatment at temperature of 100° C.–170° C. for a time varying between 60 minutes and two minutes while the pulp is at a high consistency, 15%–35% to render the curl permanent.

U.S. Pat. No. 4,455,195 to Kinsley is directed to a fibrous filter media and process for producing it. The process involves selection of a lignin containing fiber source having a lignin content of at least about 10% and thermal mechanically pulping the fiber source under temperature/pressure conditions of 300° F.–350° F./50 psig–120 psig and a refiner energy utilization of about 8–35 HPD/ADT. The thermal mechanically produced fibers are characterized by a high degree of stiffness and an extremely smooth surface free of fine fibril formation and thus are substantially non-self-bonding.

U.S. Pat. No. 4,488,932 to Eber et al. discloses a method of making fibrous webs of enhanced bulk. See also European Patent Publication No. 0 101 319. Webs are produced by subjecting hydrophilic papermaking fibers to mechanical deformation, e.g. hammermilling sufficient to deform the fibers without substantial fiber breakage, dispersing the resulting curled or kinked treated fibers, preferably in admixture with conventional papermaking fibers in an aqueous medium, to form a fiber furnish, and forming a wet laid web from the resulting fiber furnish within a period of time, e.g. within five minutes, such that the deformations of the treated fibers are at least partially retained and impart enhanced bulk and softness to the finished fibrous web.

U.S. Pat. No. 4,548,674 to Hageman et al. is directed to a method of regenerating waste paper. Waste paper containing polymeric contaminants is broken down in the presence of an acidic aqueous solution containing at least one peracid. Particular peracids disclosed include permonosulphuric acid and peracetic acid.

U.S. Pat. No. 4,734,160 to Moldenius et al. discloses a method of peroxide bleaching lignocellulose-containing material for providing a pulp of both high strength and brightness. Increase in strength is provided in the first stage by hyper-alkaline peroxide bleaching pH of over 12. The desired brightness increase is provided in a subsequent stage with or without intermediate washing of the pulp at a lower initial pH.

U.S. Pat. No. 4,756,798 to Lachenal et al. teaches the concept of adding oxygen during the hydrogen peroxide bleaching of mechanical pulp. The bleaching liquid that is disclosed in this patent includes alkaline hydrogen peroxide with sodium silicate and magnesium sulphate.

U.S. Pat. No. 4,898,642 to Moore et al. is directed to twisted, chemically stiffened cellulosic fibers and absorbent structures made therefrom. According to the '642 patent curled cellulosic fibers are chemically stiffened with a cross linking agent which is typically a $C_2$–$C_8$ dialdehyde.

U.S. Pat. No. 4,915,785 to Siminoski et al. discloses a single stage process for bleaching pulp with an aqueous hydrogen peroxide bleaching composition containing magnesium sulphate and sodium silicate.

There is disclosed in U.S. Pat. No. 4,938,842 to Whiting a bleaching liquid composition including hydrogen or sodium peroxide, sodium hydroxide, sodium silicate, magnesium sulphate and a chelating agent.

U.S. Pat. No. 4,976,819 to Minton discloses a method for treating pulp prior to forming a web. The method includes mechanical treatment of a pulp slurry of up to 50% consistency by dewatering and compacting the pulp. The pulp is twisted and kinked such that a web of enhanced softness is provided. The preferred device for imparting such twisting and kinking, is a plug screw feeder. Pulp that has been so treated exhibits increased drainability in a wet section of a paper machine.

U.S. Pat. No. 5,211,809 to Naddeo et al. discloses a color removal process for secondary (recycle) fiber. Color from dyes is removed from secondary pulps with non-chlorine based bleaching agents in treating sequences using oxygen with combinations of peroxide, ozone and/or hydrosulfite, at controlled pH conditions (less than 8 or greater than 10). Acid treatment prior to bleaching improves color removal and protects fibers from damage at more severe bleaching conditions.

There is disclosed in U.S. Pat. No. 5,244,541 to Minton a pulp treatment method wherein mechanically refined pulp is kinked and twisted and subsequently subjected to papermaking process steps.

U.S. Pat. No. 5,296,100 to Devic relates to hydrogen peroxide/alkaline bleaching of wood pulps. High-yield ligno-cellulosic wood pulps are bleached by pre-treating the pulp with a complexing agent and washing the pre-treated pulp followed by bleaching the pulp with hydrogen peroxide in an alkaline medium. When from about 60 percent to 85 percent of the initial amount of hydrogen peroxide has been consumed, a supplementary amount of hydrogen peroxide being equal to or less than the initial amount is added.

European Publication No. 0 440 472 reports high bulking resilient fibers produced by crosslinking wood pulp fibers with polycarboxylic acids such as citric acid.

U.S. Pat. Nos. 5,384,011 and 5,384,012 to Hazard et al. disclose a process for preparing individual crosslinked cellulosic fibers wherein curing and drying are carried out in separate stages. The drying and curing steps are carried out in turbulent pressurized superheated steam.

U.S. Pat. No. 5,501,768 to Hermans et al. is directed to a method of treating papermaking fibers for making tissue. According to the '768 patent, the throughdryability of dewatered, but wet, sheets made from papermaking fibers can be significantly increased by subjecting an aqueous suspension of the fibers at high consistency to elevated temperatures with sufficient working of the fibers. It is noted in Col. 3, lines 36 and following that the temperatures can be about 150° F. or greater. It is farther noted that mechanical treatment with equipment having relatively high volume to working surface areas, such as dispargers are preferred and that disk refiners, for example, are not preferred. See Col. 3, line 65 to Col. 4, line 13. Power inputs are greater than 1 HP day/ton. Note examples 1–11. See, also, U.S. Pat. No. 5,348,620.

U.S. Pat. No. 5,571,377 to Tibbling et al. describes a process for peroxide bleaching of chemical pulp in a pressurized bleach vessel. Suspension of pulp having a concentration preferably exceeding 8 percent of cellulose containing fiber material is continuously fed to a bleaching vessel and treated with an acid to adjust the pH value below 7 and is subsequently bleached in a bleaching stage to a brightness exceeding 75 percent ISO. Peroxide bleaching takes place at elevated temperature and that the pressure in a bleaching vessel which exceeds two bar and where the cross section of the area the bleaching vessels exceeds 3 square meters.

U.S. Pat. No. 5,755,926 of Hankins et al. is directed to an integrating pulping process for recycling waste paper. The method and system includes a mild alkaline pulping process with oxygen and hydrogen peroxide followed by rapid decompression of fibers and hot washing.

U.S. Pat. No. 5,772,845 to Farrington Jr. et al. is directed to a method of making tissue, without the use of a Yankee dryer. The typical Yankee functions of building machine direction and cross direction stretch are replaced by a wet end rush transfer and the throughdrying fabric design, respectively. The products are preferably made with chemimechanically treated fibers in at least one layer. It is noted in the '845 patent that certain methods can introduce curl, kinks and microcompressions into the fiber which decrease fiber to fiber bonding, decrease sheet tensile strength, and increase sheet bulk, stretch, porosity, and softness. Examples of mechanical treatments include flash drying, dry fiberizing and wet high consistency curling. A preferred method for modifying the fibers is taught to be through the use of a shaft disperser. See Col. 5.

U.S. Pat. No. 5,834,095 to Dutkiewicz et al. discloses a treatment process for cellulosic fibers. The process includes treating cellulosic fibers using high temperatures that are effective to result in modifications to the fiber. The fibers are typically heat treated with hot air. Also provided is a cross-linking catalyst to facilitate fiber modification. See Col. 4, lines 1–10.

U.S. Pat. No. 5,858,021 to Sun et al. discloses a treatment process for cellulosic fibers. The process first prepares the cellulosic fibers in a high consistency mixture with water and then adds an alkaline metal hydroxide. The high consistency process has been found to produce cellulosic fibers that are uniformly treated. In the '021 patent a high energy disperser such as a twin screw disperser, is utilized. Typical conditions for using the disperser include an energy level of about 6 horsepower-day per ton of cellulosic fiber and a feed rate of cellulosic fiber of about 2000 pounds per hour. See Col. 10, lines 13–40.

U.S. Pat. No. 5,997,689 to Bokstrom discloses a method of bleaching secondary fibers. A secondary fiber pulp is first slushed and then transferred at a consistency of 20–40 percent to a disperser wherein the pulp is mechanically treated and treated with oxygen. The pulp is thereafter conveyed to a bleaching tower wherein it is treated with alkali and hydrogen peroxide.

United States Statutory Invention Registration No. H1704 of Wallajapet et al. is directed to a modified cellulose fiber having improved curl. This statutory invention registration describes an oxidized or sulfonated cellulose fiber having a curled, stable structure. The oxidized or sulfonated curled fiber is prepared by a process including treating the fibers in a high energy refiner effective to provide the desired curl properties to the fiber which is used in disposable absorbent products. Typically, the high energy disperser employed is a twin screw disperser. See Col. 8, lines 10–35.

International Publication WO 98/27269 of Kimberly Clark Worldwide, Inc. discloses a process for treating cellulosic fibers using steam explosion that is reported to result in modified cellulosic fibers that exhibit desired properties such as wet curl properties. Aqueous pulp having consistencies of from 25 to 75 percent are contacted with steam from 2–6 minutes and then explosively decompressed. Curl indices of from about 0.2 to about 0.3 are attained. See Example 1 and Table 1.

SUMMARY OF INVENTION

There is provided in a first aspect of the present invention a process for producing high bulk cellulosic fiber exhibiting a durable elevated curl index including the steps of: (a) concurrently heat-treating and convolving cellulose fiber pulp at elevated temperature and pressure at high consistency under conditions selected so as to preclude substantial fibrillation and attendant paper strength and fiber bonding development and (b) recovering the pulp wherein the length weighted curl index of the treated fiber is at least about 20% higher than the length weighted curl index of the fiber prior to the heat treatment and convolving thereof, wherein the at least about 20% elevation of the length weighted curl index of the treated fiber persists upon treatment for 30 minutes in a disintegrator at 1% consistency at a temperature of 125° F. As will further be discussed below, the laboratory disintegrator is typically operated at 3000 rpm and is of the type described in TAPPI Standard T205 Sp-95.

In another aspect of the present invention there is provided a method of making absorbent sheet from cellulosic furnish including the steps of: (a) thickening a pulp process stream to a consistency of from about 20% to about 60%; (b) concurrently heat treating and convolving the fiber of the pulp process stream under conditions selected so as to preclude substantial fibrillation and attendant paper strength and fiber bonding development such that the length weighted curl index of the fiber is at least about 20% higher than the length weighted curl index of the fiber prior to the heat treatment and convolving thereof and the 20% elevation of the curl index persists upon treatment for 30 minutes in a disintegrator at 1% consistency at a temperature of 125° F.; (c) combining the treated pulp process stream with a second pulp process stream to provide a papermaking furnish; (d) depositing said papermaking furnish on a foraminous support to form a web; and (e) drying said web to make absorbent sheet.

In still yet another aspect of the present invention, there is provided a method of making absorbent sheet including: (a) preparing a first cellulosic pulp component exhibiting an elevated durable curl index by way of concurrently heat treating and convolving cellulosic fiber at elevated temperature and pressure under conditions selected so as to preclude substantial fibrillation and attendant paper strength and fiber bonding development wherein the length weighted curl index of the treated fiber is at least about 20% higher than the length weighted curl index of the fiber prior to heat treatment and convolving thereof; the 20% elevation in the curl index persisting upon treatment of the fiber for 30 minutes in a disintegrator at 1% consistency at a temperature of 125° F.; (b) combining in admixture the first cellulosic pulp component with a second cellulosic pulp component to make a papermaking furnish, the second cellulosic pulp component having a length weighted curl index lower than a length weighted curl index of the first pulp component; (c) depositing the papermaking furnish on a foraminous support to form a web; and (d) drying the web to form an absorbent sheet.

In particular embodiments of the present invention, a first cellulosic may be heat treated and convolved at high consistency and then combined with a second pulp that has been refined at low consistency in order to achieve a balance of properties in the absorbent sheet to be made therefrom. Low consistency, or traditional refining is well known and is generally carried out at consistencies of less than about 10 percent and typically less than about 5 percent. In still yet other methods of practicing the invention, one might heat treat and convolve the fiber at high consistency followed by diluting and refining the fiber at low consistency to achieve a desirable combination of properties in the furnish. Likewise, it is possible to refine a pulp at low consistency, thicken the pulp and heat treat and convolve the fiber as will be appreciated from the discussion which follows.

Further aspects and advantages of the present invention will be better appreciated from the description and examples which follow. Unless otherwise indicated, percent, %, or like terminology refers to weight percent unless the context indicates otherwise; "consistency" and like terms refers to the percent by weight of solids in a pulp or other mixture. Likewise, HP day/ton is based on power inputs to the tonnage of dry fiber. In order to determine curl durability, fiber curl in accordance to the present invention is treated in a laboratory disintegrator (of the type specified in TAPPI Standard T205 Sp95) for thirty minutes at 1% consistency. Such equipment is available from Testing Machines Inc., Amityville, N.Y. and is suitably operated at 3000 revolutions per minute (rpm) and 125° F. for purposes of determining curl durability. Other temperatures and speeds which do not alter the basic test may be employed under suitable conditions.

BRIEF DESCRIPTION OF DRAWINGS

The invention is described in detail below in connection with the various Figures. In the Figures.

DETAILED DESCRIPTION

Figure 1A:
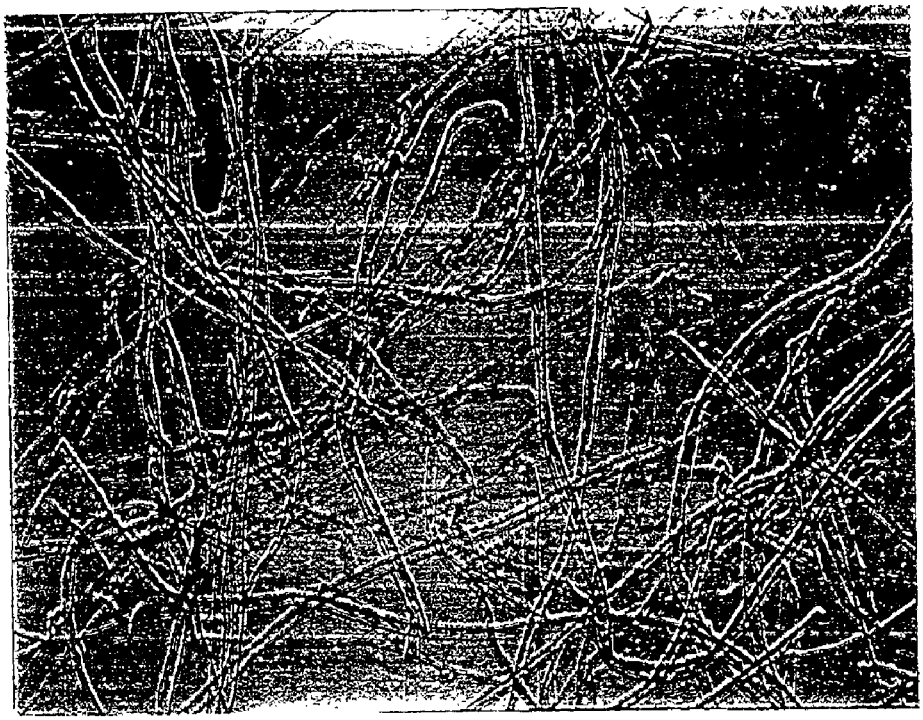
FIGS. 1A and 1B are photomicrographs respectively showing untreated fiber and fiber treated in accordance with the present invention, the fiber being Southern Bleached Softwood Kraft (SBSK or SBSWK) in both instances.

The present invention is described in connection with numerous examples and figures which form a part of this detailed description. Such exemplification and illustration of the invention is provided for purposes of explanation only. Modifications within the spirit and scope of the present invention, set forth in the appended claims, will be readily apparent by those of skill in the art. The present invention is generally directed to a process for producing high bulk cellulosic fiber exhibiting a durable elevated curl index. The process is typically carried out in a chamber in the presence of saturated steam. Most preferably, the pressure in the chamber is pulsed with respect to time either on a macroscopic level or by way of localized pressure pulsations. One may introduce such localized pressure pulsations by carrying out the inventive process in a rotating disk refiner having one or more disk relief patterns operative to impart localized pressure pulses within the chamber. When using a disk refiner the gap between a rotating disk and an opposing surface is generally from about 0.5 mm to about 10 mm, with from about 1 mm to about 5 mm being more typical.

In most cases, the step of concurrently heat treating and convolving the fiber in a process in accordance with the present invention includes applying mechanical shear to the fiber at relatively high consistency. Generally, pulp which is processed in accordance with the present invention exhibits a drop in CSF (freeness) of at most about 60 ml. Less than about 45 ml is more typical with less than about 30 ml being preferred. In typical embodiments, the pulp exhibits a drop in CSF of at most about 20 ml, preferably at most about 10 ml. More preferably, the pulp exhibits no drop in CSF and optionally exhibits an increase of at least 10 ml. CSF increases of 20 ml, 30 ml and more can be attained by way of the inventive process as will be appreciated from the specific embodiments discussed below.

CSF is determined in accordance with TAPPI Standard T 227 OM-94 (Canadian Standard Method).

In many embodiments, the curl index of the treated fiber is at least about 30% higher than the curl index of the fiber prior to the step of concurrently heat treating and convolving the fiber. It is preferred that the curl index of the treated fiber is durable enough so that it is reduced by at most about 25% by treatment at 1% consistency at 125° F. in a disintegrator for 30 minutes. More preferably, the length weighted curl index of the treated fiber is reduced by at most about 15% by treatment at 1% consistency at 125° F. in a disintegrator for 30 minutes.

In particularly preferred embodiments of the present invention, the curl index of the treated fiber is at least about 40% higher than the curl index of the fiber prior to heat treating and convolving the fiber in accordance with the present invention. Still more preferably the treated fiber has a length weighted curl index of at least about 50% higher than the curl index of the fiber prior to treatment.

The curl index attained by way of practicing the present invention will to some extent depend upon the curl index of the fiber prior to treatment. In most cases, the treated fiber has a length weighted curl index of at least about 0.12. More preferably the curled fiber has a length weighted curl index of at least about 0.15 with minimum values of at least about 0.2, 0.25 or 0.3 being particularly preferred. Generally the length weighed curl index is determined by standard procedure in an Op Test fiber analyzer, model number Code LDA 96 in accordance with the equations set forth hereinafter.

The heat treatment and convolving of the fiber or pulp in accordance with the present invention is generally carried out at a consistency of from about 20% to about 60% with from about 20% to about 50% being typical and from about 30% to about 40% being preferred.

Quite remarkably, the heat treating and convolving of the fiber is carried out with very short residence times in a disk refiner, for example, involving a duration of from about 0.01 to about 20 seconds. Typically, the step of heat treating and convolving the fiber in a refining type of apparatus has a duration of less than about 10 seconds with less than about 5 seconds, and indeed, less than about 2 seconds being typically suitable. About 1 second or less in the refiner is sufficient in cases. Overall heat treatment, or total time contacting the steam is generally that required to heat the fiber to substantially that of the steam which may be in the range of less than 2 to 4 minutes, more preferably, less than 2 minutes; still more preferably less than 1 minute. From about 10 to about 30 seconds is suitable with similar or less time involved in the convolving step.

Heat treatment and curling of the fiber is generally carried out a temperature of from about 230° F. to about 370° F. and typically with relatively low power inputs. Mechanical power inputs of less than about 2 HP day/ton, more preferably less than about 1 HP day/ton, and even more preferably at mechanical energy inputs less than about 0.5 HPday/ton are suitable. Higher energy inputs may be suitable under some conditions. For example, provided the equipment is suitable and the fiber is not subject to undue degradation one may utilize more than about 5 HP day/ton up to about 10, 15, 20 or even 25 HP day/ton if the material will not develop substantial paper strength and fiber bonding by way of such treatment.

In general, the process is carried out in saturated steam at a pressure of from about 5 to about 150 psig or higher, with perhaps from about 10 to about 90 psig being more typical.

When the pulp is heat treated and curled, papermaking chemicals for example sulfates, silicates, hydroxides, peroxides and debonders may be added if so desired. In a particularly preferred aspect of the invention, the fiber is heat treated and curled in the presence of an alkaline agent and a peroxide bleach.

In many instances the fiber will include secondary (recycled) fiber. In still other embodiments the fiber will consist essentially of secondary fiber or may be a mixture of virgin fiber and secondary fiber including from about 5 to about 95% by weight of secondary fiber based on the weight of fiber present in the pulp. In some embodiments, the fiber in the pulp consists of secondary fiber, that is, 100% of the fiber is recycled fiber. The present invention may be applied to any suitable pulp including Kraft hardwood fibers, Kraft softwood fibers, sulfite hardwood fibers, sulfite softwood fibers, and mixtures thereof. So also, the fibers may be mechanically pulped fibers, chemi-mechanically pulped fibers and mixtures thereof.

In particularly preferred embodiments of the present invention there is provided a method of making absorbent sheet from cellulosic furnish including: (a) thickening a feed pulp process stream to a consistency of from about 20 to about 60%; (b) concurrently heat treating and convolving the fiber of the pulp process stream under conditions selected so as to preclude substantial fibrillation and attendant paper strength and fiber bonding developments such that the length curl weight index of the fiber is at least about 20% higher than the length weight curl index of the fiber prior to the heat treatment and convolving thereof and the 20% elevation of the curl index persists upon treatment for 30 minutes in a disintegrator at 1% consistency at a temperature of 125° F.; (c) combining the treated pulp process stream with a second pulp process stream to provide a paper making furnish; (d) depositing the paper making furnish on a foraminous support to form a web; and (e) drying the web to make absorbent sheet. The feed pulp process stream and the second pulp process stream are generally at a consistency of less than about 6% and more typically at a consistency of less than about 5%. Drying of the web may be carried out by way of a through dryer as is well known in the art as described and shown, for example, in U.S. Pat. No. 5,607,551 to Farrington et al., the disclosure of which is incorporated herein by reference. The present invention is likewise applicable to product made by the foregoing process.

In still yet another embodiment of the present invention there is provided a method of making absorbent sheet including: (a) preparing a first cellulosic pulp component exhibiting an elevated durable curl index by way of concurrently heat treating convolving cellulosic fiber at elevated temperature and pressure under conditions selected so as to preclude substantial fibrillation and attendant paper strength and fiber bonding development wherein the length weighted curl index of the treated fiber is at least about 20% higher than the length weighted curl index of the fiber prior to heat treatment and convolving thereof, the 20% elevation and curl index persisting upon treatment of the fiber for 30 minutes in a disintegrator at 1% consistency at a temperature of 125° F.; (b) combining in admixture the first cellulosic pulp component with a second cellulosic pulp component to make a papermaking furnish wherein the second cellulosic pulp component has a length weighted curl index lower than the length weighted curl index of the first pulp component; (c) depositing the paper making furnish on a foraminous support to form a web; (d) drying the web to form an absorbent sheet. Typically, the first cellulosic pulp component comprises at least about 50% of the fiber present in the absorbent sheet; that is, the absorbent sheet typically includes at least about 50% of the fiber curled in accordance with the present invention. Suitably up to about 75% or 90% or more of the curled fiber may be present in the absorbent sheet. With this latter process the length weighted curl index of the second cellulose pulp component is usually at least 25% lower than the length weighted curl index of the first cellulosic pulp component after the first cellulosic pulp component has been heat treated and convolved. Typically the length weighted curl index of the second cellulosic pulp component is at least about 35% or perhaps more typically at least 50% lower than the length weighted curl index of the first cellulosic pulp component after the first cellulosic pulp component has been treated and convolved in accordance with the present invention. It will be appreciated by one of skill in the art that the foregoing description while illustrative, is better understood by reference to the following examples and appended figures.

Processing in accordance with the present invention induces a significant amount of curl and kink to papermaking fibers which results in increased caliper and sheet void volume, with reduced strength; all beneficial to tissue and towel production. The process will also increase sheet air porosity, increasing the suitability of the processed fibers for manufacturing paper on a machine employing throughair dyers. The fibers can also be incorporated into any paper sheet where increased bulk is beneficial.

Fibers suitable for treatment by the process include virgin kraft hardwood and softwood, mechanical and chemimechanical pulps, and secondary fibers.

Process steps may, in some exemplary embodiments include (1) thickening a slurry of papermaking fibers to about 35% consistency, (2) feeding the fibers into a sealed pressure vessel tube, (3) heating the fibers to a saturated steam pressure between 5 PSIG and 150 PSIG, (4) feeding the fibers through a disk refiner or similar machine to impart mechanical action to the fibers with a specific energy application of less than 1 to 2 HP day/ton, (5) discharging the fibers from the pressurized system by a blow valve or other discharge device, (6) supplying the fibers to a papermaking process. Papermaking fibers from pulping or paper recycling operations are typically supplied to the process thickening device. Such devices include twin wire presses and screw type presses. The fiber stream is thickened from an inlet consistency of about 5%, or lower, to 20% to 50% solids. Normally a 35% solids level can be easily achieved with normal or light duty presses. A particular advantage of this process is the ability to utilize pulps at a 35% or lower consistency. Increasing the consistency to about 50% requires about 2 to 3 times the pressing energy required at 35% consistency. To achieve consistency much above 50% requires the application of thermal drying energy which greatly increases the operating cost. The utilization of about 35% solids pulp results in both a lower capital cost for the pressing equipment and a lower operating cost compared to other processes requiring higher levels of dryness. The pulp discharged from the pressing device is fed into a pressurized heating or steaming chamber or tube. Common devices include positive displacement pumps and plug screw feeders. The chamber is pressurized with saturated steam to a pressure of 5 PSIG to 150 PSIG. The pulp is fed through the chamber and is heated to saturated temperature by the steam. Alternately the pulp could be heated by other means including non contact steam and electrical heaters.

The pulp is then fed into a high consistency disk refiner. The disk refiner plate pattern, plate gap and throughput is adjusted to provide a low specific energy to the pulp, most preferably below 1 to 2 HP day per short ton. The refining conditions are selected to minimize refiner plate to fiber impacts of a high energy nature which result in fiber fibrillation and cutting or strength development. The fiber is then discharged out of the refiner through several commercially available means including but not limited to a blow valve and cyclone arrangement. The steam exiting the cyclone can be recovered for its heat value further reducing the operating cost of the system. The curled and kinked discharged pulp can then be held at discharge solids level of about 25% to 50% or can be diluted to 5% or less solids level. The pulp can be held in storage tanks for extended periods or be supplied directly to the papermaking process. A significant advantage of this process is the resiliency or permanency of the curled nature of the pulp which greatly simplifies the system to deliver the pulp to the papermaking process.

Thus, the concurrent heat and mechanical treatment of the present invention is advantageously carried out in a disk refiner apparatus at elevated temperature and pressure wherein the surface patterns of the disk or disks produce localized compressive/decompressive shear conditions in a pulsating manner over time. Generally speaking, the fibers are heat and mechanically treated to increase curl by mechanically convolving the fibers at elevated temperature and pressure under relatively low mechanical energy input. Conditions are selected so as to preclude substantial fibrillation and attendant strength and bonding development, while also preventing substantial fiber damage or scorching. In a preferred embodiment, the curl index is increased without unduly reducing the freeness of the pulp. A particularly preferred mode of practicing the present invention also involves concurrently heat-treating and convolving the fiber at a temperature of at least about 230° F. in a disk refiner at a very low specific energy input. The energy input may in fact be less than that required to operate the refiner without pulp or may be from about a finite value to less than about 2 HP day/ton. A finite value up to less than 1 HP day/ton is believed suitable. The lower limit of specific energy input required to practice the present invention may be difficult to determine, or may even be a negative value with respect to a reference value. Specific energy inputs of from about 0.01 HP day/ton up to about 2 HP day/ton are believed suitable. Preferably, the mechanical energy employed is thus specified as less than an upper limit at which the refiner tends to fibrillate the fiber and to reduce the effectiveness of the process in imparting permanent curl to the treated fiber.

The duration of the step of convolving and heat-treating the fiber in a disk refiner is calculated as the volume of the refining cavity (that is, the cylindrical cavity between disks) times the reciprocal of the volumetric flow rate of the pulp based on its substantially uncompressed volume after the curling step and before dilution.

As noted above, CSF is determined in accordance with TAPPI Standard T 227 OM-94 (Canadian Standard Method).

The porofil or "void volume", as referred to hereafter, is determined by saturating a sheet with a nonpolar liquid and measuring the amount of liquid absorbed. The volume of liquid absorbed is equivalent to the void volume within the sheet structure. Porofil is expressed as grams of liquid absorbed per gram of fiber in the sheet structure. More specifically, for each single-ply sheet sample to be tested, select 8 sheets and cut out a 1 inch by 1 inch square (1 inch in the machine direction and 1 inch in the cross-machine direction). For multi-ply product samples, each ply is measured as a separate entity. Multiple samples should be separated into individual single plies and 8 sheets from each ply position used for testing. Weigh and record the dry weight of each test specimen to the nearest 0.001 gram. Place the specimen in a dish containing POROFIL™ liquid, having a specific gravity of 1.875 grams per cubic centimeter, available from Coulter Electronics Ltd., Northwell Drive, Luton, Beds, England; Part No. 9902458.) After 10 seconds, grasp the specimen at the very edge (1–2 millimeters in) of one corner with tweezers and remove from the liquid. Hold the specimen with that corner uppermost and allow excess liquid to drip for 30 seconds. Lightly dab (less than ½ second contact) the lower corner of the specimen on #4 filter paper (Whatman Ltd., Maidstone, England) in order to remove any excess of the last partial drop. Immediately weigh the specimen, within 10 seconds, recording the weight to the nearest 0.001 gram. The void volume for each specimen, expressed as grams of POROFIL per gram of fiber, is calculated as follows:

$$\text{void volume}=[W_2-W_1)/W_1],$$

wherein

"W1" is the dry weight of the specimen, in grams; and

"W2" is the wet weight of the specimen, in grams.

The porofil or void volume for all eight individual specimens is determined as described above and the average of the eight specimens is the void volume for the sample.

Unless otherwise stated, breaking length and stretch are reported hereinafter in accordance with standard Tappi T 494 OM-96 procedures, water retention values (WRV) are reported in accordance with standard procedures Tappi UM 256, and sorptive capacity and rate (SAT) are measured in accordance with Tappi T 561 PM-96 except using a test cutoff rate of 5 mg in 5 seconds instead of 3 mg in 5 seconds.

The curl generated can be quantified by several means. Unless otherwise specified, the OpTest Fiber Quality Analyzer (FQA) from OpTest Equipment, Hawkesbury, Ontario, Canada, Model No. Code LDA 96, was utilized to determine fiber length and curl indices. The analyzer is operated at standard settings, that is, the settings are for fibers 0.5 mm and longer with curl indices from 0 to 5. The FQA measures individual fiber contour and projected lengths by optically imaging fibers with a CCD camera and polarized infrared light. The arithmetic curl index, CI, is determined by:

$$CI = \frac{L}{l} - 1$$

L=contour length l=projected length

The length weighted curl index, $CI_{LW}$, is calculated by multiplying the sum of the individual CI by its contour length and dividing by the summation of the contour lengths:

$$CI_{LW} = \frac{\sum CI_i L_i}{\sum L_i}$$

$CI_i$=individual arithmetic curl index $L_i$=individual contour length

Length weighted mean curl indices typically between 0.100 and 0.260 have been generated in the process.

Length weighted mean curl indices up to about 0.35 have been generated.

Unless otherwise indicated, "Curl Index", "mean curl" and like terminology as used herein refers to length weighted curl index of the pulp. In order to determine curl durability, fiber curled in accordance with the present invention is treated in a laboratory disintegrator (of the type specified in TAPPI Standard T205 Sp-95) for 30 minutes at 1 percent consistency. Such equipment is available from Testing Machines Inc., Amityville, N.Y. and is suitably operated at 3,000 rpm and 125° F. for the test procedure. Other temperatures and speeds may be used if so desired to test the suitability of the fiber for an application.

Figure 1B:
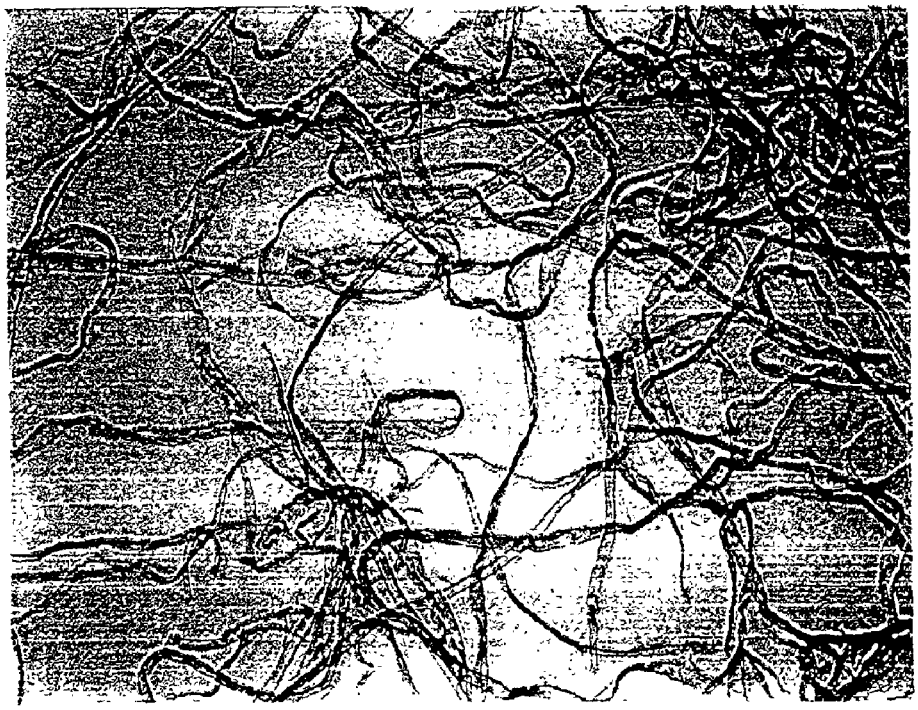
Figure 2:
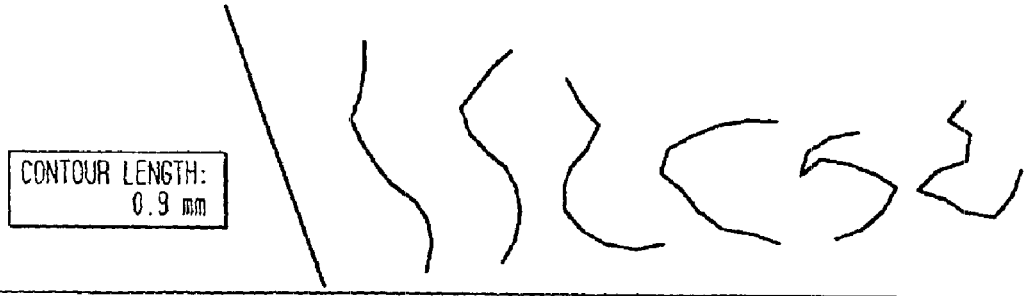
FIG. 2 is a schematic diagram illustrating curl index and kink index.

The invention is better understood by reference to FIGS. 1A and 1B. In FIG. 1A a photomicrograph of untreated southern bleached softwood kraft (SBSK) is given at 50× magnification. The sample was the control pulp from a pilot plant trial. In FIG. 1B is a photomicrograph, 50×, of SBSK treated in accordance with the present invention. The curled and kinked structures generated in the process are clearly seen in (b). The distinction is perhaps better appreciated by reference to FIGS. 2 and 3. FIG. 2 shows some examples of two-dimensional fiber structures along with their calculated curl index. Even at a curl index of 0.2–0.4 the amount of curl is very significant.

Figure 3:
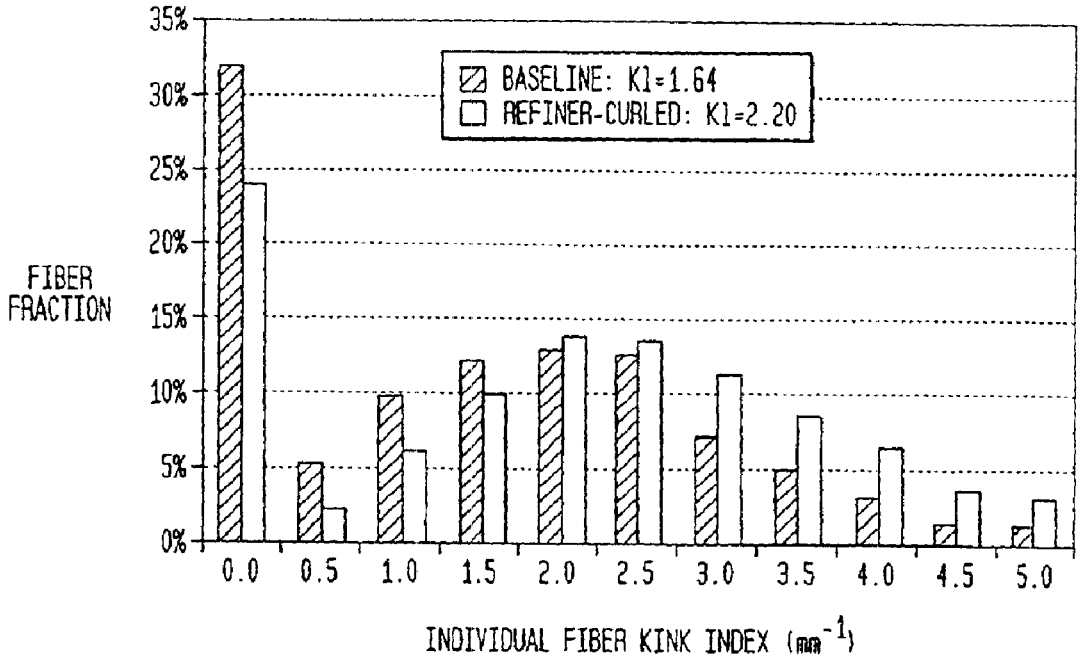
FIG. 3 is a histogram showing individual kink indices for fibers treated in accordance with the present invention and untreated fibers, the fiber being Southern Bleached Hardwood Kraft (SBHK or SBHWK) in both instances.

FIG. 3 is a histogram of individual fiber kink index for fibers treated in accordance with the invention. The FQA kink index, derived from the Kibblewhite kink index, is a weighted sum of the distinct angles or discontinuities in each fiber divided by the fiber contour length:

$$\text{Kink index} = \frac{2N_{21°-45°} + 3N_{46°-90°} + 4N_{91°-180°}}{L}$$

Where $N_{a-b}$ represents the number of kinks in an individual fiber which have a change in fiber direction between a and b degrees. Thus, for a 1 mm fiber a kink index of 2.0 $mm^{-1}$ would correspond to only one small-angle kink. The curling process shifts the distribution toward higher kink index; however, very few fibers have a kink index above about four.

Most of the "curliest" fibers are concentrated in the 0.2–0.4 curl index range and 2–4 $mm^{-1}$ kink index. Based on FIG. 1B the qualitative appearance of these fibers is one of significant curl with very few discontinuities. This is consistent with low energy deformation rather than high energy process which damages the fibers and introduces discrete discontinuities or kinks.

Figure 4:
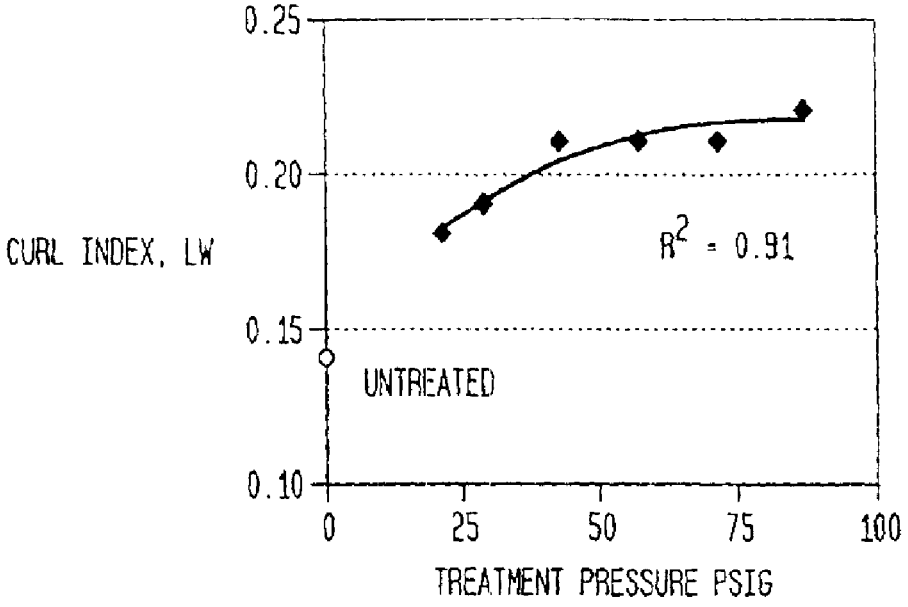
FIG. 4 is a plot of the relationship between treatment pressure and curl index (SBHK fiber) for the inventive process.
Figure 10:
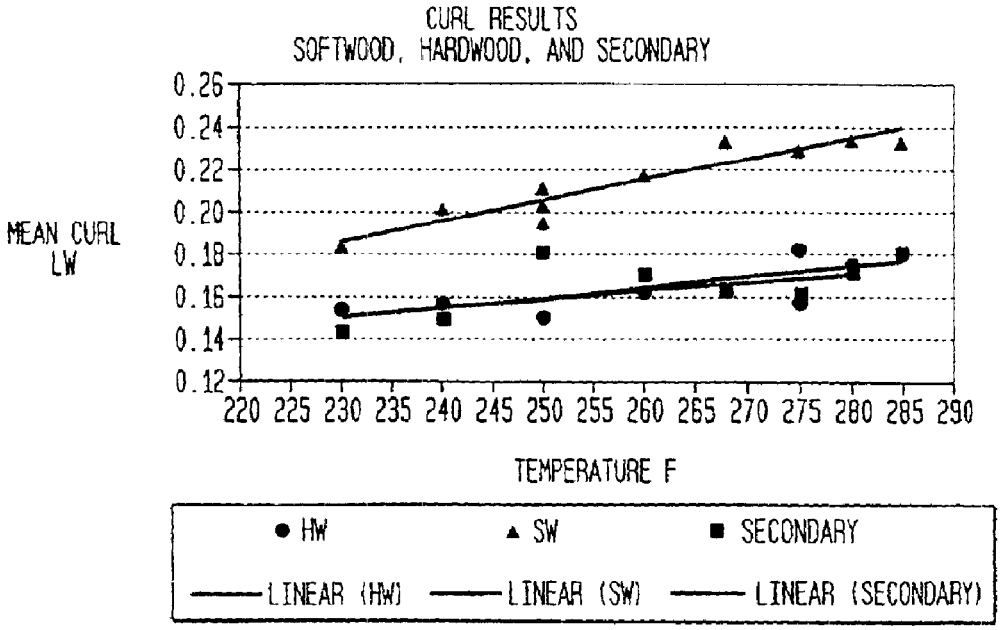
FIG. 10 is a plot of treatment pressure vs. curl index for various fibers.

It has been discovered that the curl generated in the fibers is related to the steam pressure during the mechanical treatment in the disk refiner. In FIG. 4 the curl index, length weighted, and treatment pressure of southern bleached hardwood kraft ("SBHK") pulp is plotted. The figure shows the relationship between treatment pressure and curl index. See also FIG. 10.

Figure 5A:
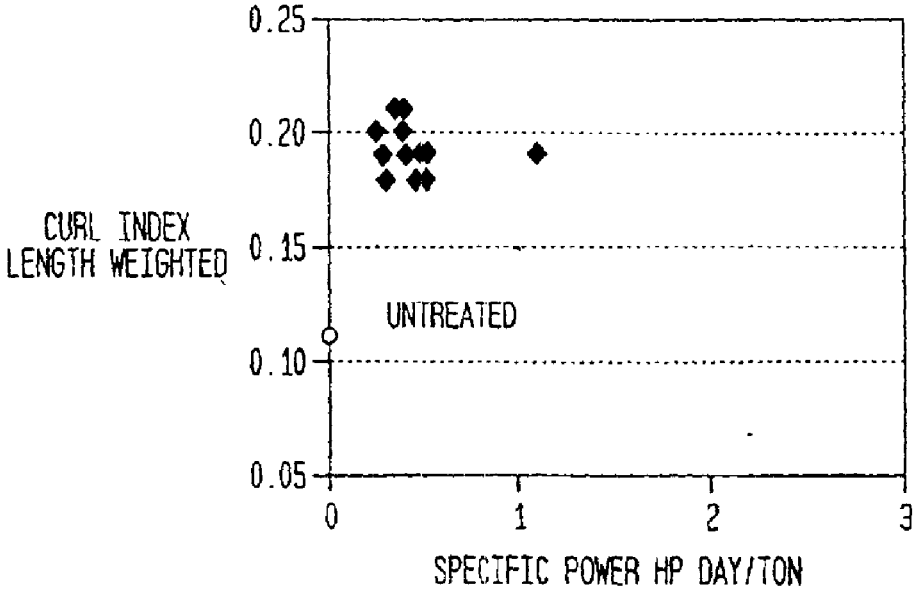
FIG. 5A is a plot of curl index vs. energy input for secondary fiber.
Figure 5B:
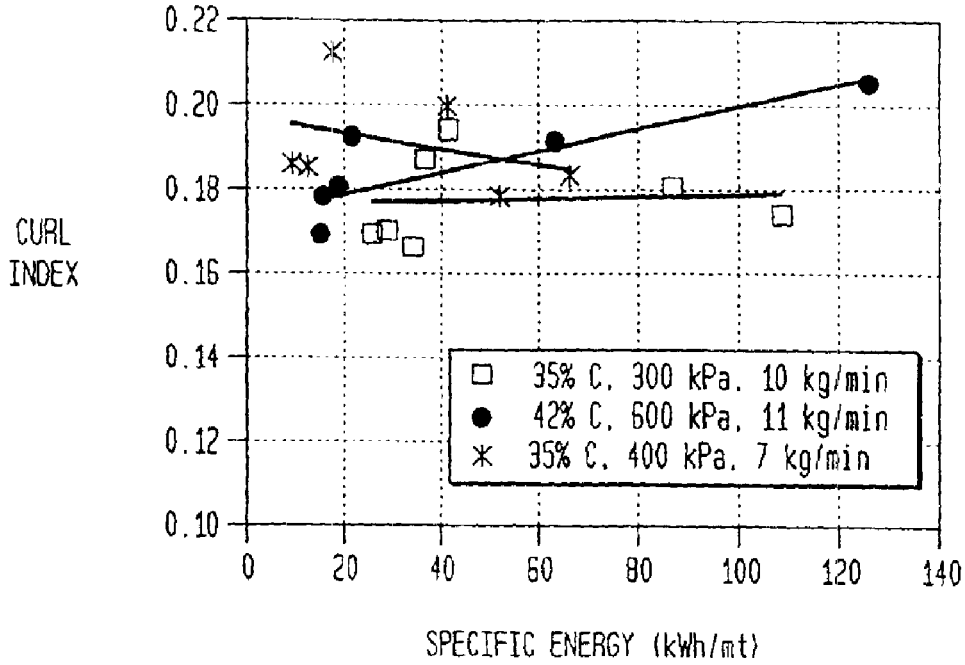
FIG. 5B is another plot of curl index v. specific energy input.

It has been discovered that the curl generated is not affected by the specific energy applied under typical conditions. In FIG. 5A the specific energy applied to a sample of secondary fiber is plotted with the length weighted curl index. No relationship between the curl index the specific power application is apparent. This is a surprising result because much of the prior art, Back (U.S. Pat. No. 4,036,679) and Hermans (U.S. Pat. No. 5,501,768) for example, related any changes in the fibers directly to power application (discussed below). In FIG. 5B there is shown additional data for hardwood fiber having initial freeness of 630 ml in a disk refiner with coarse plates at various steam pressures, consistencies and feed rates.

A method was developed to test the suitability of a fiber for through air dried (TAD) processes. A key consideration in TAD processes is the ability to pull air through the formed sheet. The greater the resistance to air flow the more difficult it is to dry the sheet. High air flow resistance increases the capital cost and operating costs of a TAD machine and limits the production rate of the machine. The steps of the procedure are:

(1) The fibers are completely water dispersed in a standard British laboratory disintegrator operated at about 2% consistency for 5 minutes at 3,000 RPM.

(2) A 100 mesh wire is placed on a standard TAPPI handsheet mold and the mold is closed.

(3) A 13 lb per 3000 $ft^2$ basis weight handsheet is formed on the wire.

(4) The wire is removed from the handsheet mold without couching.

(5) A TAD fabric is placed on the sheet and placed on a vacuum ring apparatus.

(6) Vacuum, at 15 to 20 inches of water, is pulled through the TAD wire and handsheet for 20 seconds to dry the handsheet. The vacuum is turned off and the top wire and TAD fabric are removed. The sheet is separated from the TAD fabric.

(7) The handsheet is tested for air flow resistance under controlled vacuum. Standard physical tests of the sheet can be performed including tensile, caliper, void volume and SAT.

Figure 6:
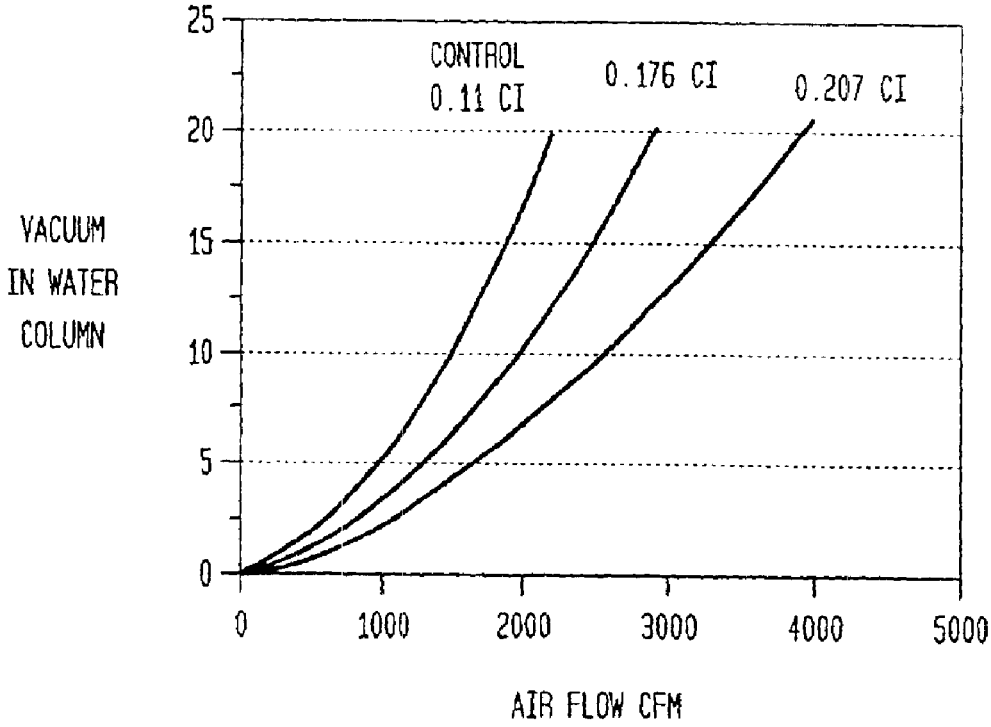
FIG. 6 is an air flow curve for various samples of sheet prepared with secondary fiber.
Figure 7:
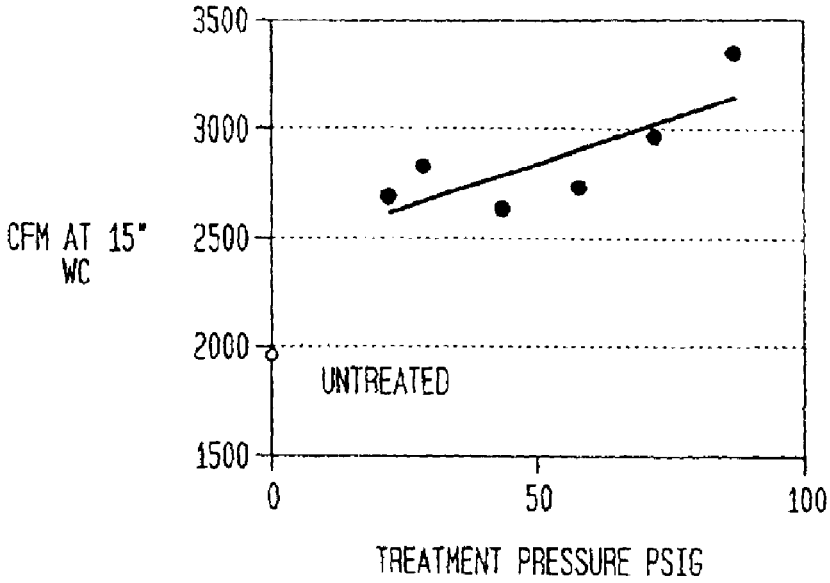
FIG. 7 is a plot of air flow vs. treatment pressure for sheets prepared from curled secondary fiber.

In FIG. 6 the air flow curve is plotted for secondary samples prepared by the TAD simulation procedure. The increase in air flow with curl index is seen. In FIG. 7 the relationship between air flow at 15 inches of water column vacuum and treatment pressure is plotted.

To test the resilience or permanence of the curl generated by the process a number of treatment conditions have been performed. Retention at low, about 1% consistency has no effect on the curl index. Retention at low consistency with gentle stirring has little or no effect on the curl index. Based in part on the nature of paper making processes—temperature, consistency, mechanical shear, and retention time—a hot disintegration test was also developed.

High energy refining of wood chips to produce "mechanical" pulps is practiced in many pulp mills. It is well known that a temporary curl, known as latency, is generated in the fibers after the refining process. The curl will relax after a short time generally 20 to 60 minutes. Common practice in mechanical pulp mills is to install a "latency chest" after the refiners to allow time for the curl to fully relax. These mills also perform a laboratory latency removal treatment to the pulp prior to testing the properties of the fibers. Industry standard methods include TAPPI 262, CPPA C.8P, and SCAN-M 10:77. All of these methods involve a hot disintegration for about 1 to 2 minutes. Based on the standard methods a hot disintegration process was developed to determine the permanency of the curl generated by the curling process of the present invention. The method utilizes a lower temperature and a much longer disintegration than standard to more closely mimic paper mill conditions. Samples of secondary pulp curled in accordance with the present invention were disintegrated in the British standard laboratory disintegrator for 30 minutes (3,000 rpm) at about 125° F. and 1% consistency. The curl index before and after treatment was determined. The results are given in Table 1. From this data the reduction in curl index from the hot disintegration is between 13% to 24% indicating a very high degree of permanence. Also note that the uncurled control fiber showed a 14% curl index reduction after the hot disintegrations. This high degree of permanence is an advantage because the curl treatment can be performed as a separate step prior to the papermaking process. The curled fibers can be stored under a wide range of conditions and be delivered to the papermaking process in a substantially curled state.

TABLE 1

Hot Disintegration Results
Secondary Fiber

| Treatment Pressure PSIG | Discharge Curl Index LW | Disintegration Curl Index LW | Curl Index Reduction |
|---|---|---|---|
| Untreated - Control | 0.114 | 0.098 | 14% |
| 22 | 0.180 | 0.137 | 24% |
| 29 | 0.200 | 0.163 | 19% |
| 44 | 0.181 | 0.155 | 14% |
| 58 | 0.196 | 0.170 | 13% |
| 73 | 0.208 | 0.171 | 18% |
| 87 | 0.205 | 0.176 | 14% |

In summary, the process involves utilizing a high consistency, pressurized refiner to provide mechanical forces to papermaking fibers at saturated steam pressures between 5 PSIG and 150 PSIG, consistencies between 20% and 60%, and, most preferably, a power application below 1 to 2 HP day/ton. The pressurized treatment results in a substantially permanently curled fiber or durable curled fiber which improves the caliper, void volume, air porosity, and softness while reducing the strength of tissue and towel base sheets. The process can be utilized to prepare papermaking fibers for tissue and towel machines and are especially important for through air dried machines.

A further surprising aspect of the invention is the resiliency of the curl generated. A central weakness of much of the prior art is the temporary nature of the curl generated. For example, Back in U.S. Pat. No. 4,036,679 teaches a process to mechanically curl fibers by a treatment in a disk refiner at 70% to 90% consistency. The fibers treated by the Back process are reported to retain the curled structures for more than 48 hours as long as they are held in the dry state. The fibers must be utilized in forming a paper sheet in a relatively short time after dilution or the curled structures are dissipated or substantially lost. Hermans teaches in U.S. Pat. No. 5,501,768, Examples 8 & 9, that the fibers treated in the disclosed process are only pulped for 2 minutes after discharge from the disperser and immediately formed into paper sheets. Minton, U.S. Pat. No. 4,976,819, teaches that fibers treated by her process should not be subjected to "excessive heat, agitation, or shear" prior to the papermaking process or the curl will be lost. In light of the unexpected results seen with the present invention, a number of other patents in the field warrant further comment.

Hill teaches in U.S. Pat. No. 2,516,384 that pulp can be curled by passing fibers at 2% to 60% consistency between two moving elements under mechanical pressure. The elements move in a gyratory or reciprocal motion generating nodules or balls of pulp. Hill states that the curl induced is of a lasting or permanent nature. Back and others have subsequently refuted these claims and assert that the Hill patent results in a temporary curl only.

Hermans has two closely related patents U.S. Pat. Nos. 5,501,768 and 5,348,620. The '620 patent has claims concerning the utilization of a minimum 20% secondary fiber. The patent details a method of increasing the "throughdryability" of fiber by treating it in shaft type disperger, specifically a Maule or Vivis machine. The treatment conditions claimed are 20% or higher consistency, 150° F. or higher temperature (limited to about 212° F. in the Maule disperger), and a power input of 1 HP day/ton or higher preferably 2 to 3 HP day/ton. Hermans teaches in the '620 patent:

> The working of the fibers, such as by shearing and compression, is not known to be quantifiable in any meaningful way other than by the temperature and power input and the resulting TD index. However, it is necessary that the fibers experience substantial fiber-to-fiber rubbing or shearing as well as rubbing or shearing contact with the surface of the mechanical devices used to treat the fibers.

Figure 8:
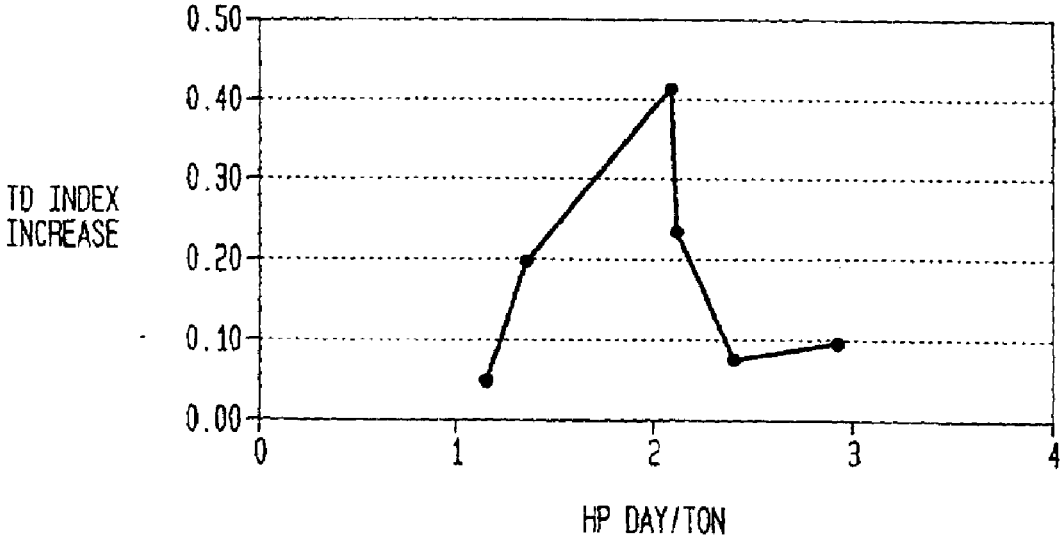
FIG. 8 (PRIOR ART)
FIG. 8 is a plot of TD index vs. energy input based on data in U.S. Pat. No. 5,348,620.

In the '768 patent Hermans teaches that the fiber to fiber contact which generates the increased throughdryability can only be generated in an apparatus "which has a high volume-to-working surface area ratio which increases the likelihood of fiber-to-fiber contact." Disk refiners, as disclosed in the present invention, are specifically excluded from the teaching because "disk refiners have a very low volume-to-working surface area . . ." and "work the fibers primarily by contact between the working surfaces and the fibers." The data from Examples 1 to 6 from the Hermans '620 patent are graphed in FIG. 8 and clearly show the dependence on the change in TD index as a function of applied power in the Maule disperger.

Back, U.S. Pat. No. 4,036,679, teaches that cellulose fibers can be convoluted by treatment in a disk refiner at a consistency of 70% to 90% (substantially dry) and controlling the feed rate, disk clearance, and disk rate of rotation.

Minton, U.S. Pat. No. 4,976,819, teaches curling of pulp by passing the pulp through a plug screw compression device with wringing, de-watering, and compaction resulting in a discharge consistency up to 50%. While Minton teaches that the mechanical treatment results in a curl that is "substantially irreversible" she does recognize the "excessive heat, agitation or shear is preferably minimized before passing the pulp to the head box."

Barbe, U.S. Pat. No. 4,431,479, teaches a method of setting the temporary curl produced during the refining step of producing a high yield mechanical or chemi-mechanical pulps. The setting of the curl is accomplished by a heat treatment step directly after the wood chip refining i.e. production step of the mechanical pulping process. Specifically, Barbe teaches treating the high yield pulp at a temperature between 100° C.–170° C., a consistency of 15% to 30%, and a time between 2 minutes and 60 minutes.

Figure 9:
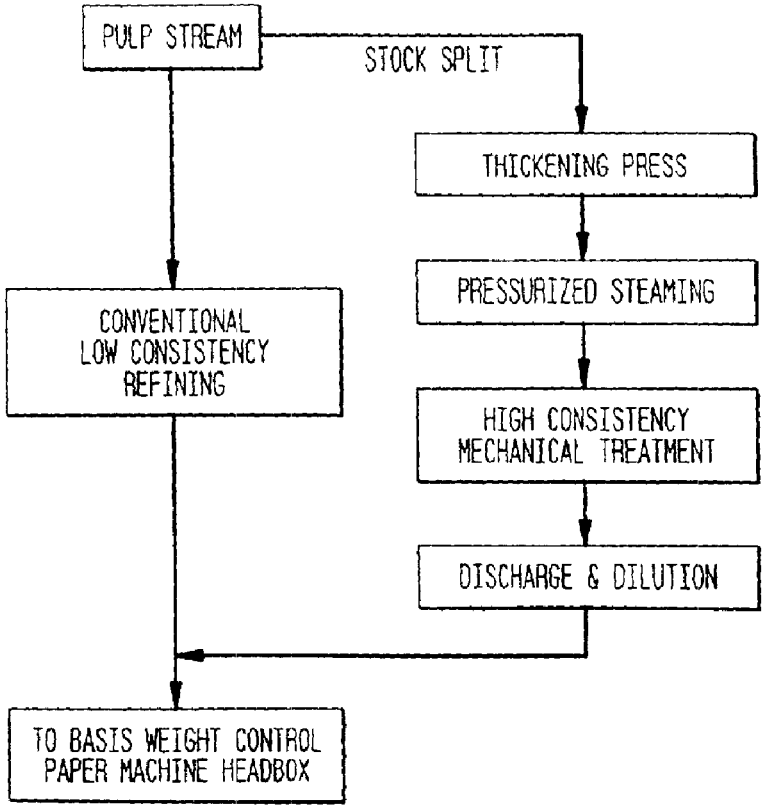
FIG. 9 is a flow diagram illustrating a process for making absorbent sheet in accordance with the present invention.

In another aspect of the invention, fibers are treated as part of a process for making absorbent sheet as will be appreciated by reference to FIG. 9 hereof.

Just prior to low consistency refining, a fiber flow will be split. A portion of the fiber stream, up to 100%, is diverted to a thickening device. Such devices include twin wire presses and screw type presses. The fiber stream is thickened to 20% to 50% solids and fed into a pressurized steaming device. The pulp is then pressurized with saturated steam to a gauge pressure of 5 PSI to 50 PSI and a temperature of 230° F. to 300° F.; the curl induced is a function of temperature. The steamed pulp is fed into a high consistency disk refiner. The disk refiner plate pattern, plate gap and throughput is adjusted to provide fiber to fiber interaction and to minimize refiner plate to fiber action which commonly results in fiber fibrillation, fiber cutting and strength development. The conditions utilized in a 12" Sprout refiner are a plate gap between 0.025 in and 0.100 in, a throughput between 0.5 kg/min and 1.0 kg/min oven dry pulp, and a measured energy input below 2 HP day/ton of pulp. The fiber exiting the refiner plates is in the form of small fiber bundles. The fiber, after a holding time from 1 sec to 600 sec, is then discharged from the pressurized refiner by a plug or blow valve. The treated pulp is diluted to consistency suitable for introduction back into the pulp stream feeding the basis weight control for the paper machine headbox. Energy input and holding time between the refiner system discharge and the paper machine headbox should be minimized to maintain the maximum fiber curl. The fiber curl induced was measured utilizing the Fiber Quality Analyzer (FQA) as noted above. Length Weighted Mean curls typically between 0.100 and 0.260 have been generated in the process. Mean curls up to 0.300 have been generated.

EXAMPLES

The process for introducing durable curl into papermaking fibers was evaluated under a variety of conditions. Significant advantages of the invention include:

- Resilience—The curl is not substantially removed by various curl-removing pulp treatments.
- Sheet permeability—Fiber curl increased throughdried ("TAD") handsheet permeability by 70% at 15" ($H_2O$) $\Delta P$.
- Product benefits—Fiber curl increased creped tissue bulk and porofil by up to 30%.

Robust, controllable process—Significant curl was produced over a wide range of throughput and disk gap. The magnitude of the induced curl increased with increased treatment pressure/temperature.

Low specific energy—Significant curl was induced over a wide range of process conditions using less than 1 to 2 HP day/ton specific energy input without a significant freeness drop.

Scale-up—commercial soale continuous processing (20" refiner) produced a higher degree of curl than lab scale batch processing (12" refiner) using similar process conditions.

Table 2 is a summary of process conditions investigated on a 12" refining batch system and a 20" continuous disk refiner, as well as absorbent sheet products made with fiber curled in accordance with the present invention.

TABLE 2

Process Description and Variables

| Process Step | Variable | Conditions Evaluated |
|---|---|---|
| Thickening | Consistency | 35% (nominal) |
| Steaming | Temperature | 105 to 160° C. |
| | Pressure | 35 to 600 kPa pressure (5 to 90 PSI) |
| High Consistency Refining | Feed Rate | 1 to 6 kg/min |
| | Plate Gap | 0.6 to 4 mm |
| | Plate Speed | 900 to 1,800 RPM |
| | Specific Energy | <1 to 20 HP day/ton |
| Post Refining Retention | Time | 1 Sec to 10 minute (batch) |
| Discharge | Depressurization Rate | Fast and slow |
| Dilution | Temperature | 120 to 180° F. |
| | Consistency | 1 to 2% |
| | Latency or Curl Stability | Time, energy, and temperature |
| Paper Machine and Sheet Impact | Basesheet | Pilot PM trial with 9 lb/3000 $ft^2$ basesheet |
| | Caliper/Bulk | |
| | Strength | |
| | Porofil | |
| | TAD Air Permeability | TAD Simulation Handsheets |
| | Strength | |
| | Caliper/Bulk | |

20" Single Disk Continuous System

Figure 11A:
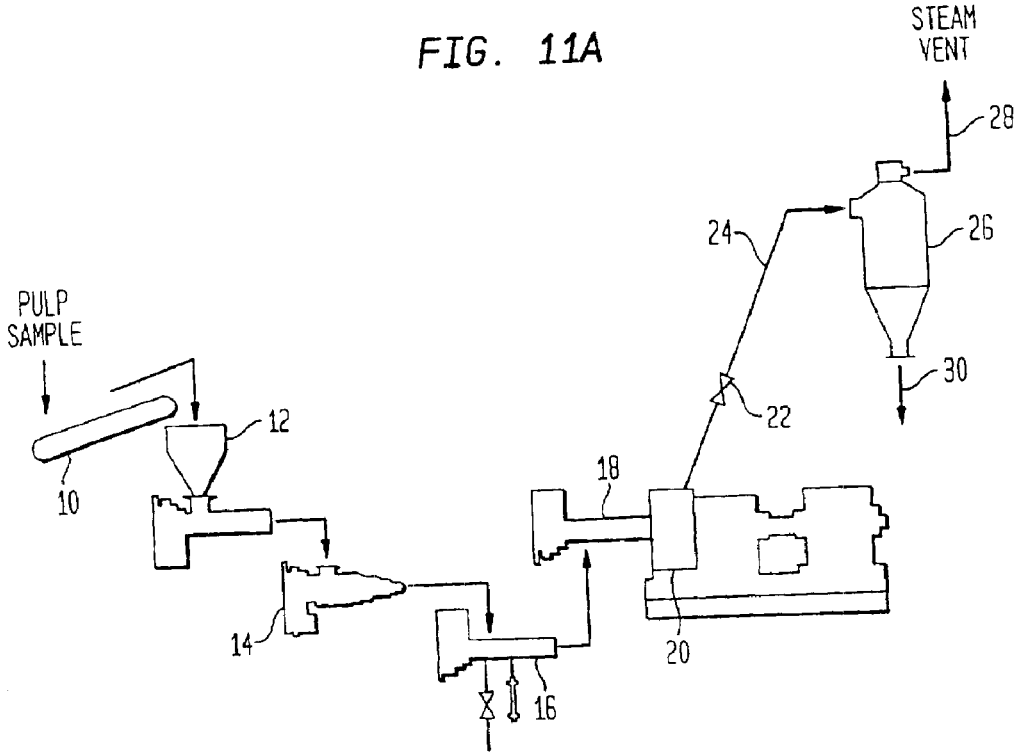
FIG. 11A is a schematic diagram illustrating the operation of a continuous apparatus for treating fiber in accordance with the present invention.
Figure 11B:
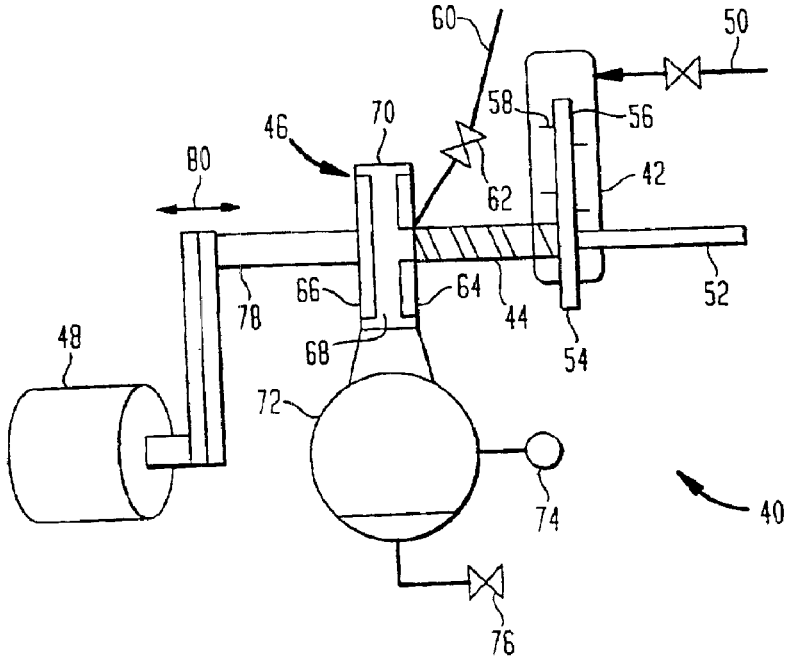
FIG. 11B is a schematic diagram illustrating the operation of a batchwise apparatus for treating fiber in accordance with the present invention.

Utilizing the system of FIG. 11A, a variety of process conditions and pulps were investigated. Specifically, a total of four pulp sources were utilized: deinked (secondary) pulp (DIP), Southern bleached softwood Kraft (SBSK), Southern bleached hardwood Kraft (SBHK) and a Northern bleached hardwood/softwood Kraft blend (NBHK/SK). Other experiments were performed utilizing the batchwise apparatus of FIG. 11B, discussed in detail following the continuous system data.

Experiments were performed to examine the separate impacts of steam pressure, pulp throughput, plate gap, specific energy application, and plate pattern. Table 3 provides a summary of the experimental cells performed.

TABLE 3

Experimental Run Summary

| Pulp | Throughput (kg/min) | Variable* | Examples |
|---|---|---|---|
| Blended | 2 | Gap 0.8–3 mm (fine plates) | 1–8 |
| Hardwood/ Softwood | 6 | Gap 2–4 mm (fine plates) | 9–14 |

TABLE 3-continued

Experimental Run Summary

| Pulp | Throughput (kg/min) | Variable* | Examples |
|---|---|---|---|
| Bleached Kraft (NBK) | 2 | Gap 0.6–3 mm | 15–20 |
| | 6 | Gap 1.5–4 mm | 21–25 |
| | 6 | RPM 900–1800 (fine plates, 4 mm) | 26–30 |
| | 2 | Gap 0.6–3 mm | 31–35 |
| | 6 | Gap 1.8–4 mm | 36–40 |
| Deinked | 6 | Gap 1.7–4 mm | 41–44 |
| Secondary | 6 | RPM 900 to 1800 | 45–48 |
| (DIP) | 6 | Pressure 150 to 600 kPa (1200 rpm) | 49–54 |
| Southern | 6 | Gap 1.5–4 mm (600 kPa) | 55–58 |
| Bleached Softwood Kraft (SBSK) | 2 | Gap 1–4 mm (600 kPa) | 59–62 |
| Southern | 2 | Gap 1–4 mm (600 kPa) | 63–66 |
| Bleached | 2 | Pressure 150 to 600 kPa | 67–72 |
| Hardwood Kraft | 6 | Pressure 150 to 600 kPa | 73–78 |
| (SBHK) | 6 | Gap 1.3–4 mm (600 kPa) | 79–82 |

Unless otherwise specified: (coarse) refiner plates, 3.5 mm gap, 1500 rpm, 200 kPa The pulp samples were prepared as follows:

1. Baled and wet lap pulps were slushed in the batch pulper at about 5% consistency
2. Slushed pulp warm de-watered on the twin roll press to (nominal 35% consistency)
3. Discharged pulp from the press was broken up in a transfer screw conveyor and placed into nylon bags (about 1 $m^3$ volume). The samples were labeled and the bags placed in storage at room temperature.

Figure 12A:
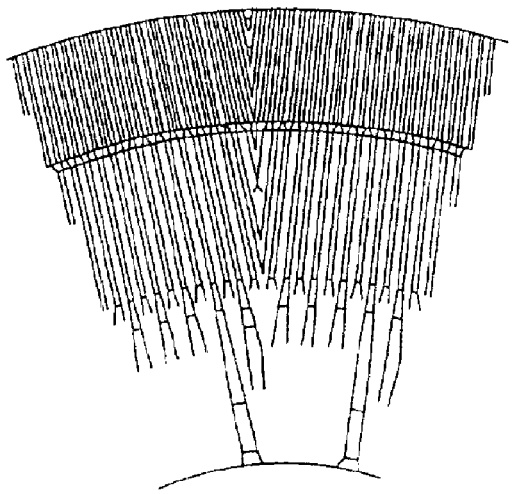
FIGS. 12A and 12B are drawings illustrating relief patterns on refiner plates evaluated for use in connection with the present invention.
Figure 12B:
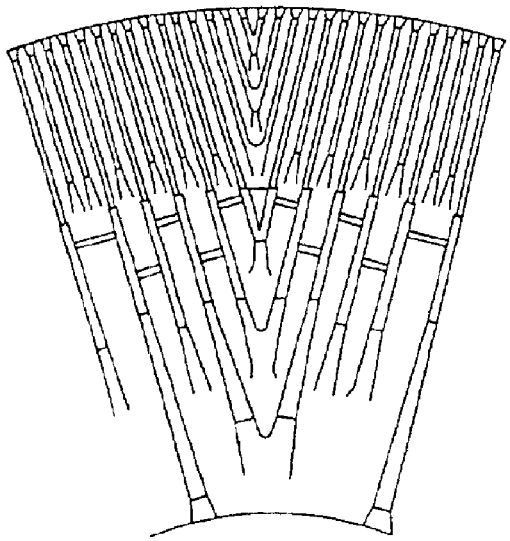

Referring to FIG. 11A, the pulp was spread by hand and metered from a slow moving belt conveyer 10 to a feed bin 12 and thereafter the pulp was conveyed to a plug screw feeder 14 which provides a pressure seal. The pulp was then fed by way of feeder 14 to a heating screw 16, wherein steam was injected and the material further conveyed through screw feeder 18 to a 20" single disk refiner 20. Refiner 20 was equipped with pressure controls which can be adjusted to vary pulp residence time between the plates and maintain a consistent pulp discharge flow. After refining the material was passed through a blow valve indicated at 22 through line 24 to a cyclone 26 which was vented to allow the steam to escape at 28 while the pulp was collected at 30. Two types of disks were used, a fine disk as shown in FIG. 12A and a coarse disk as shown in FIG. 12B. Variables investigated included:

1. Steam pressure/treatment temperature (150 to 600 kPa steam pressure)
2. Disk clearance (0.6–4.0 mm)
3. Specific power application (primarily <1 HP day/ton, but as high as 20 HP day/ton)
4. Disk rotation speed (900–1800 rpm)
5. Plate pattern—fine and coarse
6. Pulp throughput—nominal 2 and 6 kg/min (3 and 10 short ton per day).

In addition, freeness of the pulp, CSF test TAPPI T227 OM-94 (Canadian Standard Method) was measured as well as the curl index and kink index as noted above. Later trials included some higher feed rates.

Again referring to FIG. 11A, pulp emerging from plug screw feeder 14 comes into contact with steam and remains in contact with steam in heating screw 16 for 8 to 25 seconds (measured), for 10 seconds in many of the trials. Thereafter, pulp is in contact with steam in infeed screw 18 for a short time; estimated to be less than about 3 seconds. Pulp is in contact with steam between refiner plates in disk refiner 20 for typically less than 1 second (duration of convolving step) where it is concurrently heat treated and convolved. After curling the pulp is in contact with steam in the refiner housing outside the plates and in the blow line where the material is decompressed in a confined volume for less than 1 second.

In summary, pulp emerging from the plug may be in contact with the steam for between about 10 and 30 seconds while typically concurrently heat treated and convolved for less than about 1 second in the refiner. What is desired is sufficient time for the pulp to be heated to essentially the temperature of the steam, which will depend on how well the pulp is broken up and contacted with the steam. It is likewise possible to use longer overall times, e.g., 2–4 minutes if desired.

Results for the continuous disk refiner are tabulated below in Tables 4 through 9.

TABLE 4

| | | | | | Pulp Treatment Conditions | | | | | | |
|---|---|---|---|---|---|---|---|---|---|---|---|
| Example | Gap mm | Disk RPM | Steam Housing kPa | ° C.: | Test time min | KW: Idle load | KW: Load | Kg/min: Production | Specific Power KWh/ton b.d | ml: CSF | %: Conc |
| 1 | 2.00 | 1500 | 220 | 133 | 1.5 | 7 | 7.5 | 1.27 | 6 | 655 | 28.5 |
| 2 | 3.00 | 1500 | 200 | 133 | 1.7 | 7 | 7.7 | 1.26 | 10 | 665 | 26.2 |
| 3 | 1.80 | 1500 | 200 | 133 | 1.5 | 7 | 9.3 | 1.34 | 29 | 660 | 28.3 |
| 4 | 1.50 | 1500 | 200 | 133 | 1.5 | 7 | 9.5 | 1.35 | 31 | 670 | 28.5 |
| 5 | 2.00 | 1500 | 180 | 133 | 1.5 | 7 | 9.2 | 1.48 | 24 | 680 | 27.1 |
| 6 | 1.00 | 1500 | 180 | 133 | 1.5 | 7 | 10.4 | 1.46 | 38 | 660 | 26.3 |
| 7 | 0.80 | 1500 | 180 | 133 | 1.5 | 7 | 11.6 | 1.32 | 58 | 650 | 25.7 |
| 8 | 0.75 | 1500 | 180 | 133 | 1.5 | 7 | 18.3 | 1.43 | 132 | 640 | 23.9 |
| 9 | 4.00 | 1500 | 180 | 133 | 1.0 | 7 | 10.1 | 5.27 | 10 | 687 | 35.1 |
| 10 | 3.00 | 1500 | 180 | 133 | 1.0 | 7 | 9.5 | 4.61 | 9 | 684 | 34.9 |
| 11 | 2.00 | 1500 | 180 | 133 | 0.8 | 7 | 39.0 | 3.86 | 138 | 675 | 33.6 |
| 12 | 4.00 | 1500 | 220 | 133 | 1.0 | 7 | 9.3 | 4.68 | 8 | 688 | 31.3 |
| 13 | 3.00 | 1500 | 220 | 133 | 1.0 | 7 | 10.2 | 4.55 | 12 | 682 | 30.1 |
| 14 | 2.50 | 1500 | 220 | 133 | 0.8 | 7 | 97.1 | 3.56 | 422 | 681 | 34.5 |
| 15 | 2.00 | 1500 | 220 | 133 | 105 | 7 | 7.9 | 1.75 | 8 | 648 | 27.3 |
| 16 | 1.40 | 1500 | 220 | 133 | 1.5 | 7 | 8.0 | 1.53 | 11 | 663 | 27.9 |
| 17 | 1.00 | 1500 | 220 | 133 | 1.5 | 7 | 8.6 | 1.41 | 18 | 655 | 27.2 |
| 18 | 0.60 | 1500 | 220 | 133 | 1.5 | 7 | 27.5 | 1.46 | 234 | 602 | 33.2 |
| 19 | 0.70 | 1500 | 220 | 133 | 1.5 | 7 | 20.2 | 1.33 | 165 | 628 | 28.1 |
| 20 | 3.00 | 1500 | 220 | 133 | 1.0 | 7 | 7.3 | 1.61 | 3 | 665 | 31.6 |
| 21 | 2.50 | 1500 | 220 | 133 | 1.0 | 7 | 10.2 | 5.21 | 10 | 680 | 38.4 |
| 22 | 2.20 | 1500 | 220 | 133 | 1.0 | 7 | 10.3 | 4.57 | 12 | 678 | 35.7 |
| 23 | 1.70 | 1500 | 220 | 133 | 1.0 | 7 | 11.9 | 5.09 | 16 | 682 | 36.9 |
| 24 | 1.50 | 1500 | 220 | 133 | 1.0 | 7 | 12.6 | 4.84 | 19 | 675 | 32.7 |
| 25 | 4.00 | 1500 | 220 | 133 | 1.0 | 7 | 8.2 | 4.97 | 4 | 685 | 33.1 |
| 26 | 4.00 | 1500 | 220 | 133 | 1.0 | 7 | 10.1 | 5.38 | 10 | 680 | 35.6 |
| 27 | | | | | | | | | | | |
| 28 | 4.00 | 1200 | 220 | 133 | 1.0 | 4.5 | 8.2 | 5.70 | 11 | 689 | 35.4 |
| 20 | 4.00 | 900 | 220 | 133 | 1.0 | 3.7 | 11.0 | 4.39 | 28 | 684 | 34.6 |
| 30 | 4.00 | 1800 | 220 | 133 | 1.0 | 8.5 | 11.6 | 5.46 | 9 | 674 | 35.2 |
| 31 | 3.00 | 1500 | 220 | 133 | 1.5 | 7 | 7.7 | 1.53 | 7 | 676 | 34.2 |
| 32 | 2.00 | 1500 | 220 | 133 | 1.5 | 7 | 7.9 | 1.57 | 10 | 677 | 34.2 |
| 33 | 1.00 | 1500 | 220 | 133 | 1.5 | 7 | 9.2 | 1.49 | 24 | 667 | 32.8 |
| 34 | 0.70 | 1500 | 220 | 133 | 1.5 | 7 | 10.4 | 1.30 | 44 | 659 | 28.7 |
| 35 | 0.60 | 1500 | 220 | 133 | 1.5 | 7 | 17.2 | 1.34 | 127 | 641 | 25.5 |
| 36 | 4.00 | 1500 | 220 | 133 | 1.0 | 7 | 9.6 | 5.64 | 8 | 694 | 35.7 |
| 37 | 3.00 | 1500 | 220 | 133 | 1.0 | 7 | 11.2 | 7.71 | 9 | 698 | 40.8 |
| 38 | 2.25 | 1500 | 220 | 133 | 1.0 | 7 | 10.0 | 4.96 | 10 | 680 | 34.0 |
| 39 | 1.85 | 1500 | 220 | 133 | 1.0 | 7 | 11.4 | 6.54 | 11 | 686 | 37.6 |
| 40 | 1.75 | 1500 | 220 | 133 | 1.0 | 7 | 46.7 | 6.48 | 102 | 680 | 39.5 |

TABLE 5

| Example | Pulp FQA Results: Mean Length mm Lw | Percent Fines Ln | Lw | Mean Curl Ln | Lw | Kink Index |
|---|---|---|---|---|---|---|
| Control A1 | 1.98 | 31.90 | 3.75 | 0.17 | 0.18 | 2.22 |
| 1 | 1.85 | 31.42 | 3.98 | 0.27 | 0.29 | 2.81 |
| 2 | 1.83 | 32.83 | 4.28 | 0.26 | 0.28 | 2.80 |
| 3 | 1.79 | 32.64 | 4.39 | 0.27 | 0.30 | 2.77 |
| 4 | 1.82 | 31.13 | 4.10 | 0.27 | 0.30 | 2.77 |
| 5 | 1.80 | 33.10 | 4.44 | 0.25 | 0.28 | 2.66 |
| 6 | 1.86 | 28.94 | 3.46 | 0.27 | 0.30 | 2.76 |
| 7 | 1.84 | 31.84 | 4.09 | 0.28 | 0.31 | 2.82 |
| 8 | 1.78 | 32.79 | 4.39 | 0.26 | 0.29 | 2.69 |
| 9 | 1.88 | 32.80 | 4.09 | 0.24 | 0.26 | 2.58 |
| 10 | 1.85 | 32.87 | 4.25 | 0.24 | 0.27 | 2.61 |
| 11 | 1.87 | 32.49 | 4.09 | 0.24 | 0.26 | 2.65 |
| 12 | 1.87 | 31.75 | 4.10 | 0.24 | 0.28 | 2.59 |

TABLE 5-continued

| Example | Pulp FQA Results: Mean Length mm Lw | Percent Fines Ln | Lw | Mean Curl Ln | Lw | Kink Index |
|---|---|---|---|---|---|---|
| 28 | 1.80 | 30.65 | 4.12 | 0.22 | 0.25 | 2.50 |
| 29 | 1.74 | 31.22 | 4.27 | 0.23 | 0.26 | 2.57 |
| 30 | 1.79 | 31.83 | 4.26 | 0.24 | 0.27 | 2.63 |
| 31 | 1.74 | 32.21 | 4.52 | 0.27 | 0.30 | 2.78 |
| 32 | 1.75 | 30.16 | 4.11 | 0.26 | 0.29 | 2.71 |
| 33 | 1.73 | 32.83 | 4.68 | 0.26 | 0.30 | 2.73 |
| 34 | 1.72 | 31.48 | 4.45 | 0.27 | 0.30 | 2.70 |
| 35 | 1.77 | 29.74 | 4.16 | 0.28 | 0.31 | 2.71 |
| 36 | 1.79 | 30.64 | 4.07 | 0.23 | 0.26 | 2.51 |
| 37 | 1.74 | 31.92 | 4.51 | 0.23 | 0.26 | 2.59 |
| 38 | 1.80 | 30.02 | 3.93 | 0.24 | 0.26 | 2.63 |
| 39 | 1.85 | 33.12 | 4.43 | 0.23 | 0.27 | 2.54 |
| 40 | 1.70 | 32.92 | 4.83 | 0.23 | 0.26 | 2.53 |

TABLE 6

| Example | DIP Secondary Pulp Treatment Conditions: Gap mm | Disk RPM | Steam Housing kPa | ° C.: | Test time min | KW: Idle load | KW: Load | Kg/min: Production | Specific Power KWh/ton b.d | ml: CSF | %: Conc |
|---|---|---|---|---|---|---|---|---|---|---|---|
| 41 | 4.00 | 1500 | 200 | 133 | 1.0 | 7 | 10.1 | 5.48 | 9 | 509 | 37.8 |
| 42 | 3.00 | 1500 | 200 | 133 | 1.0 | 7 | 11.0 | 6.23 | 11 | 525 | 39.7 |
| 43 | 2.00 | 1500 | 200 | 133 | 1.0 | 7 | 14.6 | 5.76 | 22 | 506 | 38.4 |
| 44 | 1.70 | 1500 | 200 | 133 | 1.0 | 7 | 102.5 | 6.55 | 243 | 475 | 42.0 |
| 45 | 3.50 | 900 | 200 | 133 | 1.0 | 3.7 | 5.5 | 5.54 | 5 | 538 | 35.5 |
| 46 | 3.50 | 1200 | 200 | 133 | 1.0 | 4.5 | 8.2 | 6.69 | 9 | 530 | 37.8 |
| 47 | 3.50 | 1500 | 200 | 133 | 1.0 | 7 | 10.1 | 6.48 | 8 | 504 | 37.0 |
| 48 | 3.50 | 1800 | 200 | 133 | 1.0 | 8.5 | 11.9 | 5.87 | 10 | 494 | 35.8 |
| 49 | 3.50 | 1200 | 150 | 127 | 1.0 | 4.5 | 8.2 | 5.99 | 10 | 499 | 34.2 |
| 50 | 3.50 | 1200 | 200 | 133 | 1.0 | 4.5 | 7.3 | 6.05 | 8 | 516 | 35.2 |
| 51 | 3.50 | 1200 | 300 | 143 | 1.0 | 4.5 | 6.4 | 5.61 | 6 | 495 | 33.4 |
| 52 | 3.50 | 1200 | 400 | 152 | 1.0 | 4.5 | 6.4 | 6.40 | 5 | 515 | 37.0 |
| 53 | 3.50 | 1200 | 500 | 159 | 1.0 | 4.5 | 7.3 | 6.11 | 8 | 514 | 37.5 |
| 54 | 3.50 | 1200 | 600 | 165 | 1.0 | 4.5 | 7.3 | 6.90 | 7 | 545 | 40.6 |

TABLE 5-continued

| Example | Pulp FQA Results: Mean Length mm Lw | Percent Fines Ln | Lw | Mean Curl Ln | Lw | Kink Index |
|---|---|---|---|---|---|---|
| 13 | 1.86 | 32.22 | 4.16 | 0.25 | 0.28 | 2.63 |
| 14 | 1.77 | 33.95 | 4.82 | 0.25 | 0.28 | 2.69 |
| 15 | 1.75 | 30.58 | 4.06 | 0.27 | 0.31 | 2.75 |
| 16 | 1.72 | 33.02 | 4.73 | 0.26 | 0.30 | 2.73 |
| 17 | 1.75 | 30.15 | 4.09 | 0.28 | 0.31 | 2.82 |
| 18 | 1.73 | 29.55 | 4.15 | 0.26 | 0.29 | 2.74 |
| 19 | 1.75 | 29.60 | 4.06 | 0.28 | 0.31 | 2.79 |
| 20 | 1.74 | 29.46 | 3.88 | 0.27 | 0.30 | 2.77 |
| 21 | 1.82 | 30.95 | 3.92 | 0.24 | 0.27 | 2.64 |
| 22 | 1.83 | 32.09 | 4.03 | 0.24 | 0.27 | 2.61 |
| 23 | 1.86 | 29.30 | 3.56 | 0.25 | 0.28 | 2.72 |
| 24 | 1.77 | 30.36 | 4.15 | 0.25 | 0.28 | 2.58 |
| 25 | 1.80 | 31.82 | 4.27 | 0.24 | 0.26 | 2.59 |
| Control A2 | 1.95 | 33.05 | 4.13 | 0.17 | 0.18 | 2.19 |
| 26 | 1.77 | 31.86 | 4.44 | 0.23 | 0.26 | 2.56 |
| 27 | 1.78 | 30.58 | 4.09 | 0.23 | 0.26 | 2.62 |

TABLE 7

| Example | DIP Pulp FQA Results: Mean Length mm Lw | Percent Fines Ln | Lw | Mean Curl Ln | Lw | Kink Index |
|---|---|---|---|---|---|---|
| Control B | 1.27 | 23.85 | 4.58 | 0.11 | 0.11 | 1.76 |
| 41 | 1.04 | 28.90 | 7.01 | 0.16 | 0.18 | 2.09 |
| 42 | 1.07 | 30.62 | 7.44 | 0.17 | 0.19 | 2.10 |
| 43 | 1.09 | 30.92 | 7.63 | 0.17 | 0.19 | 2.15 |
| 44 | 1.04 | 32.99 | 8.99 | 0.19 | 0.21 | 2.13 |
| 45 | 1.11 | 29.90 | 7.11 | 0.17 | 0.19 | 2.10 |
| 46 | 1.13 | 28.90 | 6.68 | 0.16 | 0.18 | 2.09 |
| 47 | 1.11 | 29.68 | 7.10 | 0.17 | 0.19 | 2.07 |
| 48 | 1.03 | 30.52 | 7.52 | 0.16 | 0.19 | 2.18 |
| 49 | 1.10 | 27.72 | 6.37 | 0.15 | 0.18 | 2.00 |
| 50 | 1.02 | 29.23 | 7.14 | 0.17 | 0.20 | 2.08 |
| 51 | 1.03 | 30.10 | 7.33 | 0.17 | 0.18 | 2.11 |
| 52 | 1.08 | 30.05 | 7.48 | 0.17 | 0.20 | 2.15 |
| 53 | 1.01 | 30.02 | 7.54 | 0.18 | 0.21 | 2.24 |
| 54 | 1.03 | 29.98 | 7.75 | 0.18 | 0.21 | 2.24 |

TABLE 8

SBSK and SBHK Treatment Conditions

| Example | Gap mm | Disk RPM | Steam Housing kPa | ° C.: | Test time min | KW: Idle load | KW: Load | Kg/min: Production | Specific Power KWh/ton b.d | Ml: CSF | %: Conc |
|---|---|---|---|---|---|---|---|---|---|---|---|
| 55 | 4.00 | 1200 | 600 | 165 | 1.0 | 4.5 | 6.4 | 5.83 | 5 | 716 | 39.4 |
| 56 | 3.00 | 1200 | 600 | 165 | 1.0 | 4.5 | 7.3 | 6.75 | 7 | 711 | 44.1 |
| 57 | 2.00 | 1500 | 600 | 165 | 1.0 | 7 | 9.2 | 5.22 | 7 | 704 | 42.1 |
| 58 | 1.50 | 1500 | 600 | 165 | 1.0 | 7 | 10.1 | 4.50 | 11 | 705 | 40.9 |
| 59 | 4.00 | 1500 | 600 | 165 | 1.0 | 7 | 9.2 | 2.08 | 17 | 700 | 24.2 |
| 60 | 3.00 | 1500 | 600 | 165 | 1.0 | 7 | 8.2 | 2.23 | 9 | 708 | 29.7 |
| 61 | 2.00 | 1500 | 600 | 165 | 1.0 | 7 | 8.2 | 2.32 | 9 | 705 | 29.7 |
| 62 | 1.00 | 1500 | 600 | 165 | 1.0 | 7 | 49.4 | 1.96 | 361 | 672 | 30.6 |
| 63 | 4.00 | 1500 | 600 | 165 | 1.5 | 7 | 7.3 | 1.68 | 3 | 637 | 32.3 |
| 64 | 3.00 | 1500 | 600 | 165 | 1.5 | 7 | 6.7 | 1.79 | -3 | 641 | 38.9 |
| 65 | 2.00 | 1500 | 600 | 165 | 1.5 | 7 | 7.3 | 1.89 | 3 | 632 | 39.7 |
| 66 | 1.00 | 1500 | 600 | 165 | 1.5 | 7 | 8.6 | 1.69 | 15 | 610 | 41.0 |
| 67 | 3.50 | 1500 | 600 | 165 | 1.5 | 77 | 7.3 | 1.88 | 3 | 621 | 42.2 |
| 68 | 3.50 | 1500 | 500 | 159 | 1.8 | 7 | 7.0 | 2.00 | 0 | 624 | 44.6 |
| 69 | 3.50 | 1500 | 400 | 152 | 1.5 | 7 | 6.7 | 2.13 | -2 | 604 | 39.4 |
| 70 | 3.50 | 1500 | 300 | 143 | 1.5 | 7 | 7.3 | 1.97 | 3 | 602 | 35.8 |
| 71 | 3.50 | 1500 | 200 | 133 | 1.0 | 7 | 7.3 | 1.46 | 4 | 599 | 32.4 |
| 72 | 3.50 | 1500 | 150 | 127 | 1.0 | 7 | 8.2 | 1.71 | 12 | 609 | 36.4 |
| 73 | 3.50 | 1500 | 150 | 127 | 1.0 | 7 | 10.1 | 7.19 | 7 | 650 | 39.5 |
| 74 | 3.50 | 1500 | 200 | 133 | 1.0 | 7 | 8.2 | 5.78 | 4 | 632 | 37.8 |
| 75 | 3.50 | 1500 | 300 | 143 | 1.0 | 7 | 8.2 | 6.04 | 3 | 636 | 40.1 |
| 76 | 3.50 | 1500 | 400 | 152 | 1.0 | 7 | 8.2 | 6.74 | 3 | 638 | 41.8 |
| 77 | 3.50 | 1500 | 500 | 159 | 1.0 | 7 | 9.2 | 6.69 | 5 | 640 | 43.2 |
| 78 | 3.50 | 1500 | 600 | 165 | 1.0 | 7 | 10.1 | 6.79 | 8 | 650 | 43.4 |
| 79 | 4.00 | 1500 | 600 | 165 | 1.0 | 7 | 9.2 | 6.45 | 6 | 650 | 43.2 |
| 80 | 3.00 | 1500 | 600 | 165 | 1.0 | 7 | 9.8 | 6.66 | 7 | 655 | 44.6 |
| 81 | 2.00 | 1500 | 600 | 165 | 1.0 | 7 | 10.1 | 6.71 | 8 | 650 | 45.7 |
| 82 | 1.30 | 1500 | 600 | 165 | 1.0 | 7 | 67.7 | 6.87 | 147 | 655 | 50.6 |

TABLE 9

SBSK and SBHK FQA Results

| Example | Mean Length mm Lw | Percent Fines Ln | Lw | Mean Curl Ln | Lw | Kink Index |
|---|---|---|---|---|---|---|
| Control C | 2.38 | 49.30 | 6.37 | 0.15 | 0.17 | 1.76 |
| 55 | 2.02 | 53.25 | 8.67 | 0.26 | 0.29 | 2.64 |
| 56 | 1.84 | 54.22 | 9.70 | 0.24 | 0.28 | 2.72 |
| 57 | 1.98 | 51.20 | 8.19 | 0.27 | 0.31 | 2.63 |
| 58 | 1.92 | 49.16 | 8.11 | 0.26 | 0.30 | 2.69 |
| 59 | 1.98 | 50.42 | 8.18 | 0.28 | 0.32 | 2.76 |
| 60 | 2.05 | 43.68 | 6.14 | 0.27 | 0.30 | 2.71 |
| 61 | 1.92 | 48.65 | 7.93 | 0.27 | 0.31 | 2.64 |
| 62 | 1.93 | 45.20 | 7.12 | 0.27 | 0.31 | 2.65 |
| Control D | 0.95 | 61.81 | 16.37 | 0.12 | 0.14 | 1.75 |
| 63 | 0.74 | 62.91 | 20.29 | 0.22 | 0.24 | 2.46 |
| 64 | 0.78 | 60.54 | 18.43 | 0.21 | 0.23 | 2.51 |
| 65 | 0.77 | 62.90 | 19.59 | 0.23 | 0.25 | 2.46 |
| 66 | 0.73 | 60.48 | 19.03 | 0.23 | 0.26 | 2.45 |
| 67 | 0.73 | 62.65 | 19.95 | 0.21 | 0.23 | 2.44 |
| 68 | 0.78 | 59.95 | 18.33 | 0.22 | 0.24 | 2.45 |
| 69 | 0.76 | 62.73 | 19.92 | 0.20 | 0.22 | 2.27 |
| 70 | 0.79 | 62.51 | 19.46 | 0.22 | 0.24 | 2.45 |
| 71 | 0.81 | 62.05 | 18.75 | 0.20 | 0.23 | 2.28 |
| 72 | 0.84 | 61.81 | 17.89 | 0.19 | 0.21 | 2.32 |
| 73 | 0.85 | 62.10 | 18.05 | 0.16 | 0.18 | 2.17 |
| 74 | 0.84 | 62.27 | 17.87 | 0.18 | 0.19 | 2.26 |
| 75 | 0.82 | 62.33 | 18.33 | 0.20 | 0.21 | 2.32 |
| 76 | 0.80 | 61.60 | 18.66 | 0.19 | 0.21 | 2.34 |
| 77 | 0.79 | 61.95 | 18.72 | 0.19 | 0.21 | 2.42 |
| 78 | 0.80 | 62.25 | 18.68 | 0.20 | 0.22 | 2.42 |
| 79 | 0.79 | 62.92 | 19.59 | 0.19 | 0.21 | 2.40 |
| 80 | 0.78 | 61.58 | 18.69 | 0.20 | 0.21 | 2.43 |
| 81 | 0.79 | 61.70 | 19.04 | 0.20 | 0.21 | 2.31 |
| 82 | 0.74 | 58.80 | 18.40 | 0.23 | 0.24 | 2.49 |

Batch Testing

Following generally the procedure described above in connection with a continuous system utilizing a 20" single disk refiner, additional runs were carried out with a 12" Sprout Bauer Waldron high consistency refiner, utilizing chemicals including hydrogen peroxide as a bleaching agent and sodium hydroxide as an alkaline agent. There is shown schematically in FIG. 11B a batch refining system which was used to curl and bleach fiber in accordance with the present invention. A batch refining apparatus 40 includes generally a steaming chamber 42, a feed screw 44, a disk refining portion 46, a drive motor 48 and a steam supply 50. The apparatus employed was a Sprout-Waldron batch refining system wherein Steaming Chamber 42 included a vertical tube with bolt on cover. The chamber is equipped with a mixer rake 54 provided with a shaft 56 and blades 58 to agitate the pulp and help facilitate heating. During operation steam is fed into the chamber via a steam supply 50 to heat the pulp and pressurize the system. The steam pressure is monitored and controlled by a pressure indicator 74 and an appropriate control loop. The pulp was steamed for 5 to 15 minutes for most experiments described hereinafter. Variable speed feed screw 52—a tube with a internal screw connects the steaming chamber to a refiner portion 46 including a case 70 as well as a stator 64 and a rotor 66 defining a refining gap 68 therebetween. The bottom of the steaming chamber opens directly to the screw. A variable speed drive indicated generally at 52 connects to screw 44 and is used to move the pulp from the bottom of the steaming chamber into the refiner case. The speed of the screw was adjusted to provide about 5 seconds of residence time in the feed screw.

Stator 64 has a hole in the center through which feed screw 44 pushes the pulp into refiner plate gap 68. Opposite the stator is rotor 66 which is coupled to the drive motor via a shaft 78 and drive belts. The rotor assembly can be moved in and out to adjust the gap between the stator and rotor as is indicated schematically at 80. Standard 12" diameter, 6 segment refiner plates are bolted onto the rotor and stator. The case also has a chemical inlet pipe 60 equipped with a valve 62 to supply chemicals such as bleaching chemicals, discussed hereinafter in more detail, just at the point the pulp enters the hole in the stator. During the bleaching experiments the chemical charge was metered into the chemical inlet at a rate and concentration calculated to match the pulp feed rate at the desired chemical application. The pulp is mechanically treated between the rotor and stator plates and is thrown out into the refiner case. The rotor assembly can be moved in and out to adjust the gap between rotor and stator plates 66, 64. The bottom of the refiner case is open to a pulp receiver vessel 72. Total residence time of the pulp in the case is estimated to be less than 0.2 seconds. The pulp falls out of the refiner case by gravity and into receiver 72. The receiver is a horizontal tank equipped with a bolt on cover. At the bottom of the receiver is a screened tray designed to catch the pulp and to prevent the pulp from plugging a depressurization valve 76. During operation the receiver is maintained at system pressure. For most experiments the pulp was held in receiver 72 for 1 to 2 minutes of refiner operation plus an additional 0 to 10 minutes residence time at pressure without refiner operation. The depressurization valve is normally left slightly open during the experiments to 1) evacuate air in the system (which would prevent sufficient steam flow to heat the pulp), and 2) to drain any steam condensate from the refiner system. The valve was also used to depressurize the system at the end of the experiment. The main steam supply valve of supply 50 was closed and the vent valve opened 25 to 50%. At this opening the steam pressure was relieved over 1 to 2 minutes. Results appear below.

EXAMPLES 83–90

Approximately 100 lb of finished pulp was transported at about 5% consistency and thickened to 35% consistency. These runs were exploratory in nature and dealt primarily with developing operating parameters for the unit. It was noted that significant curl was imparted to the fiber during very low power application bleaching. A large plate gap was used to minimize refining. This work was performed with a hydrogen peroxide based bleaching liquor.

EXAMPLES 91–107

A sample of paper was acquired for the next set of tests. The paper was wetted to 35% consistency and run through a lab pilot pulp breaker before use in the refiner. Runs 91 to 102 and the production runs of Examples 103–107 were performed with this sample. During these runs it was discovered that the measured curl in the fiber was related to the bleaching performance in the refiner. Again, these runs were performed with a large gap and a low power application in the refiner. The positive impact of bleaching in the refiner on curl was carried through subsequent hydrosulfite bleaching and a variety of retention conditions. The examples demonstrated that a significant amount of the curl was preserved through the storage and repulping/paper making process. This curl generated a tissue sheet of increased caliper and Porofil while reducing the tensile strength.

EXAMPLES 108–117

Runs 108–117 were performed with hardwood BCTMP, and virgin hardwood and softwood. All of these runs, except one, were performed without chemicals. The curl response of the pulps varied somewhat; the BCTMP pulp having little curl induced while the softwood has a high induced curl.

Results of the bleaching trials appears in Tables 10 through 17 is discussed below in connection with the paper machine trials. Weight % is expressed as a percentage of dry pulp unless otherwise indicated. In Tables 10–17, "run time" refers to the length of time a batch of material is fed to the refining portion of the batch apparatus described above; whereas, "residence time" refers to the length of time a batch is maintained in vessel 72 at temperature and pressure. "Hydrosulfite" GE Brightness and like terminology refers to brightness for examples where the pulp was bleached and curled in accordance with the invention and then hydrosulfite bleached by conventional means.

TABLE 10

| | | Examples 83–90 Operating Conditions and Refiner Operation | | | | | |
|---|---|---|---|---|---|---|---|
| Example | Brightness GE | Cons % | Pulp Flow kg/mm | Run Time Min | Steam PSIG | Temp ° F. | Residence Min |
| 83 | 37.5 | 35 | 0.5 | 3 | 15 | 250 | 10 |
| 84 | 37.5 | 35 | 0.5 | 3 | 15 | 250 | 10 |
| 85 | 37.5 | 35 | 0.5 | 3 | 15 | 250 | 20 |
| 86 | 37.5 | 35 | 0.5 | 3 | 20 | 270 | 0 |
| 87 | 37.5 | 35 | 0.5 | 3 | 15 | 250 | 10 |
| 88 | 37.5 | 35 | 0.5 | 3 | 15 | 250 | 5 |
| 89 | 37.5 | 35 | 0.5 | 3 | 15 | 250 | 5 |
| 90 | 37.5 | 35 | 0.5 | 3 | 15 | 250 | 0 |

| | | | Refiner Chemicals & Results | | | | | |
|---|---|---|---|---|---|---|---|---|
| Example | Mag Sulfate g/l | DTPA % OP | Silicate % OP | Caustic % OP | Peroxide % OP | Brightness GE | ResH2O2 % OP | Hydrosulfite Brightness GE |
| 83 | 0.25 | 0.25 | 0.5 | 2 | 5 | | 0 | |
| 84 | 0.2 | 0.25 | 0.5 | 1 | 4 | 41.6 | 0 | |
| 85 | 0.1 | 0.4 | 0.5 | 1 | 5 | 44.0 | | |
| 86 | 0 | 0.25 | 0.2 | 1 | 5 | 41.1 | | |
| 87 | 0 | 0 | 0 | 0 | 0 | 35.1 | | |
| 88 | 1 | 0.25 | 0 | 1 | 5 | 41.6 | 0 | |
| 89 | 0.5 | 0.25 | 0.1 | 1 | 5 | 44.2 | 0.72 | |
| 90 | 0.5 | 0.25 | 0.5 | 1 | 6 | 48.3 | 1.8 | 51.3 |

TABLE 11

Examples 83–90 Pulp Fiber Analysis Results

| | | Percent Fines | | Mean Length mm | | | Mean Curl | | |
|---|---|---|---|---|---|---|---|---|---|
| Example | Retention Hours | Arithmetic | Length Weighted | Arithmetic | Length Weighted | Weight Weighted | Arithmetic | Length Weighted | Kink Index |
| Base | 0 | 42.15 | 8.88 | 0.529 | 1.336 | 2.308 | 0.07 | 0.073 | 1.27 |
| 83 | 0 | 59.05 | 24.39 | 0.292 | 0.631 | 1.151 | 0.115 | 0.126 | 1.91 |
| 84 | 0 | 45.65 | 11.02 | 0.477 | 1.282 | 2.284 | 0.161 | 0.177 | 2.31 |
| 85 | 18 Min | 48.62 | 13.27 | 0.421 | 1.105 | 2.033 | 0.152 | 0.177 | 2.11 |
| 85 | 12 | 46.7 | 11.58 | 0.457 | 1.194 | 2.115 | 0.162 | 0.174 | 2.21 |
| 85 | 12 | 46.7 | 11.58 | 0.457 | 1.194 | 2.115 | 0.162 | 0.174 | 2.21 |
| 86 | 0 | 47.98 | 12.01 | 0.451 | 1.214 | 2.192 | 0.143 | 0.156 | 2.08 |
| 86 | 72 | 45.65 | 10.56 | 0.485 | 1.313 | 2.371 | 0.121 | 0.138 | 1.83 |
| 87 | 0 | 48.5 | 12.81 | 0.432 | 1.19 | 2.198 | 0.163 | 0.181 | 2.16 |
| 87 | 18 | 46.5 | 11.98 | 0.443 | 1.161 | 2.109 | 0.164 | 0.181 | 2.24 |
| 88 | 0 | 47.7 | 12.46 | 0.447 | 1.188 | 2.118 | 0.164 | 0.188 | 2.21 |
| 88 | 24 | 46.77 | 12.09 | 0.44 | 1.135 | 2.007 | 0.152 | 0.165 | 2.13 |
| 89 | 0 | 45.88 | 11.5 | 0.459 | 1.196 | 2.128 | 0.161 | 0.179 | 2.13 |
| 89 | | 47.08 | 12 | 0.446 | 1.16 | 2.076 | 0.161 | 1.072 | 2.16 |
| 90 | 0 | 46.2 | 11.42 | 0.466 | 1.239 | 2.229 | 0.151 | 0.169 | 2.06 |
| 90 | | 43.58 | 9.9 | 0.498 | 1.297 | 2.258 | 0.142 | 0.153 | 2.11 |
| 90 | 0 | | | | | | | | |
| 90 | 0 | | | | | | | | |
| 90 | 0 | | | | | | | | |

TABLE 12

Examples 91–107 Operating Conditions

| | | Refiner Operation | | | | | |
|---|---|---|---|---|---|---|---|
| Example | Brightness GE | Cons % | Pulp Flow kg/mm | Run Time Min | Steam PSIG | Temp ° F. | Residence Min |
| 91 | 48.8 | 35 | 0.5 | 3 | 15 | 250 | 5 |
| 92 | 48.8 | 35 | 0.5 | 3 | 15 | 250 | 5 |
| 93 | 48.8 | 35 | 0.5 | 3 | 15 | 250 | 5 |
| 94 | 48.8 | 35 | 0.5 | 3 | 15 | 250 | 5 |
| 95 | 48.8 | 35 | 0.5 | 3 | 15 | 250 | 5 |
| 96 | 48.8 | 35 | 0.5 | 3 | 15 | 250 | 5 |
| 97 | 48.8 | 35 | 0.5 | 3 | 25 | 270 | 5 |
| 98 | 48.8 | 35 | 0.5 | 3 | 25 | 270 | 5 |
| 99 | 48.8 | 35 | 0.5 | 3 | 25 | 270 | 5 |
| 100 | 48.8 | 35 | 0.5 | 3 | 25 | 270 | 5 |
| 101 | 48.8 | 35 | 0.5 | 3 | 25 | 270 | 5 |
| 102 | 48.8 | 35 | 0.5 | 3 | 25 | 270 | 5 |
| 103 | 48.8 | 35 | 0.5 | 6 | 15 | 250 | 5 |
| 104 | 48.8 | 35 | 0.5 | 6 | 15 | 250 | 5 |
| 105 | 48.8 | 35 | 0.5 | 6 | 15 | 250 | 5 |
| 106 | 48.8 | 35 | 0.5 | 6 | 15 | 250 | 5 |
| 107 | 48.8 | 35 | 0.5 | 6 | 15 | 250 | 5 |

Refiner Chemicals & Results

| Example | Magnesium Sulfate Mag Sulfate g/l | DTPA DTPA % OP | Sodium Silicate Silicate % OP | Caustic Caustic % OP | Peroxide Peroxide % OP | Brightness GE | Res H2O2 % OP | Res NaOH % OP | Hydrosulfite Brightness GE |
|---|---|---|---|---|---|---|---|---|---|
| 91 | 0.2 | 0.2 | 0.5 | 0.5 | 5 | 57.4 | 1.05 | 1.3 | |
| 92 | 0.2 | 0.2 | 0.5 | 0.75 | 5 | 59 | 0.55 | 1.3 | |
| 93 | 0.2 | 0.2 | 0.5 | 1 | 5 | 58.1 | 0.32 | 1.13 | 65.1 |
| 94 | 0.2 | 0.2 | 0.5 | 1.25 | 5 | 58.4 | 0.15 | 1.46 | 64.5 |
| 95 | 0.2 | 0.2 | 0.5 | 1.5 | 5 | 61.8 | 0.15 | 1.36 | 66.6 |
| 96 | 0.2 | 0.2 | 0.5 | 0.25 | 5 | | 0.29 | 0.73 | |
| 97 | 0.2 | 0.2 | 0.6 | 1.5 | 5 | 60 | 0.1 | 1.3 | 65.1 |
| 98 | 0.2 | 0.2 | 0.6 | 1 | 5 | 58.5 | 0.48 | 0.79 | 62.6 |
| 99 | 0.2 | 0 | 0.6 | 1.25 | 5 | | 0.28 | 1.37 | 66.8 |
| 100 | 0.2 | 0 | 0.7 | 1.25 | 6 | 58.6 | 0.19 | 1.76 | 62.8 |
| 101 | 0.2 | 0 | 0.5 | 1 | 6 | 62 | 0.71 | 1.69 | 63.8 |
| 102 | 0.2 | 0 | 0.75 | 1 | 6 | 62.5 | 0.94 | 1.61 | 64 |
| 103 | 0.2 | 0 | 0.6 | 1 | 6 | | 0.58 | 0.8 | |
| 104 | 0.2 | 0 | 0.6 | 1 | 6 | | 0.67 | 0.98 | |
| 105 | 0.2 | 0 | 0.6 | 1 | 6 | | 0.61 | 0.89 | |
| 106 | 0.2 | 0 | 0.6 | 1 | 6 | | 0.52 | 1.12 | |
| 107 | 0.2 | 0 | 0.6 | 1 | 6 | | 0.56 | 1.12 | |

TABLE 13

Examples 91–107 90 Pulp Fiber Analysis Results

| | | Percent Fines | | Mean Length mm | | | Mean Curl | | |
|---|---|---|---|---|---|---|---|---|---|
| Example | Retention Hours | Arithmetic | Length Weighted | Arithmetic | Length Weighted | Weight Weighted | Arithmetic | Length Weighted | Kink Index |
| D | Control | 38.80 | 8.25 | 0.534 | 1.232 | 2.083 | 0.073 | 0.076 | 1.35 |
| 91 | 0 | 44.77 | 11.17 | 0.454 | 1.138 | 2.017 | 0.146 | 0.157 | 2.20 |
| 91 | 12 | 44.71 | 11.80 | 0.440 | 1.002 | 1.707 | 0.144 | 0.153 | 2.17 |
| 92 | 0 | 40.31 | 9.48 | 0.488 | 1.157 | 2.009 | 0.166 | 0.176 | 2.37 |
| 92 | 12 | 45.83 | 11.83 | 0.442 | 1.098 | 1.957 | 0.159 | 0.176 | 2.27 |
| 93 | 0 | 46.98 | 12.67 | 0.423 | 1.072 | 1.905 | 0.173 | 0.197 | 2.33 |
| 93 | 0 | 46.98 | 12.67 | 0.423 | 1.072 | 1.905 | 0.173 | 0.197 | 2.33 |
| 93 | 24 | 47.20 | 12.95 | 0.419 | 1.000 | 1.731 | 0.173 | 0.191 | 2.36 |
| 93 | 0 | 45.58 | 11.95 | 0.436 | 1.063 | 1.890 | 0.178 | 0.212 | 2.26 |
| 93 | 72 | 45.73 | 12.36 | 0.418 | 0.989 | 1.772 | 0.175 | 0.214 | 2.27 |
| 94 | 0 | 48.66 | 14.18 | 0.393 | 0.970 | 1.767 | 0.191 | 0.211 | 2.31 |
| 94 | 24 | 46.02 | 12.07 | 0.432 | 1.083 | 1.970 | 0.172 | 0.186 | 2.33 |
| 94 | 0 | 45.23 | 12.24 | 0.415 | 0.976 | 1.753 | 0.164 | 0.186 | 2.23 |
| 94 | 72 | 46.67 | 13.09 | 0.412 | 0.696 | 1.778 | 0.186 | 0.219 | 2.38 |
| 95 | 0 | 49.88 | 14.91 | 0.382 | 0.958 | 1.764 | 0.183 | 0.201 | 2.44 |
| 95 | 12 | 46.65 | 12.57 | 0.524 | 1.028 | 1.782 | 0.166 | 0.182 | 2.25 |
| 95 | 24 | 46.65 | 12.57 | 0.425 | 1.028 | 1.782 | 0.166 | 0.182 | 2.25 |
| 95 | 72 | 46.77 | 12.62 | 0.422 | 1.025 | 1.829 | 0.169 | 0.188 | 2.27 |
| 95 | 0 | 45.45 | 11.83 | 0.433 | 1.076 | 1.934 | 0.179 | 0.201 | 2.36 |
| 95 | 72 | 47.25 | 13.34 | 0.404 | 0.978 | 1.786 | 0.184 | 0.217 | 2.32 |
| 96 | 0 | 44.38 | 11.34 | 0.447 | 1.102 | 1.974 | 0.185 | 0.205 | 2.53 |
| 96 | 24 | 44.90 | 11.40 | 0.450 | 1.121 | 1.999 | 0.159 | 0.174 | 2.22 |
| 96 | 72 | 45.08 | 11.23 | 0.455 | 1.131 | 1.999 | 0.152 | 0.170 | 2.16 |
| 96 | 0 | 45.94 | 12.57 | 0.417 | 0.974 | 1.722 | 0.173 | 0.205 | 2.20 |
| 96 | 72 | 45.70 | 12.74 | 0.411 | 0.991 | 1.913 | 0.183 | 0.215 | 2.40 |
| 97 | 0 | 46.38 | 12.11 | 0.432 | 1.090 | 2.008 | 0.167 | 0.184 | 2.31 |
| 97 | 24 | 47.30 | 12.70 | 0.422 | 1.037 | 1.824 | 0.163 | 0.179 | 2.24 |
| 97 | 0 | 46.30 | 13.43 | 0.394 | 0.899 | 1.563 | 0.202 | 0.232 | 2.38 |
| 98 | 0 | 45.12 | 11.56 | 0.448 | 1.117 | 1.989 | 0.176 | 0.191 | 2.36 |
| 98 | 24 | 46.04 | 11.98 | 0.433 | 1.103 | 2.034 | 0.170 | 0.191 | 2.28 |
| 98 | 0 | 47.25 | 13.52 | 0.397 | 0.941 | 1.683 | 0.192 | 0.233 | 2.32 |
| 99 | 0 | 47.06 | 12.58 | 0.427 | 1.060 | 1.899 | 0.172 | 0.186 | 2.34 |
| 99 | 24 | 46.56 | 11.83 | 0.439 | 1.116 | 2.022 | 0.173 | 0.193 | 2.32 |
| 99 | 0 | 47.11 | 13.81 | 0.391 | 0.915 | 1.611 | 0.181 | 0.199 | 2.24 |
| 100 | 0 | 49.46 | 13.60 | 0.409 | 1.063 | 2.018 | 0.181 | 0.196 | 2.40 |
| 100 | 24 | 46.40 | 11.69 | 0.445 | 1.148 | 2.029 | 0.165 | 0.178 | 2.30 |
| 100 | 0 | 47.38 | 14.01 | 0.383 | 0.921 | 1.716 | 0.192 | 0.219 | 2.31 |
| 101 | 0 | 43.90 | 11.16 | 0.453 | 1.126 | 2.042 | 0.166 | 0.184 | 2.24 |
| 101 | 24 | 44.67 | 11.58 | 0.438 | 1.026 | 1.774 | 0.156 | 0.170 | 2.18 |
| 101 | 0 | 47.02 | 13.70 | 0.391 | 0.901 | 1.603 | 0.188 | 0.217 | 2.27 |
| 102 | 0 | 43.05 | 10.83 | 0.449 | 1.022 | 1.739 | 0.170 | 0.186 | 2.41 |
| 102 | 24 | 46.02 | 12.07 | 0.434 | 1.059 | 1.851 | 0.161 | 0.171 | 2.23 |
| 102 | 0 | 44.75 | 12.26 | 0.420 | 0.978 | 1.705 | 0.181 | 0.219 | 2.25 |
| 103 | 0 | 97.10 | 81.68 | 0.461 | 1.191 | 2.193 | 0.178 | 0.191 | 2.47 |
| 103 | 0 | 97.88 | 86.65 | 0.430 | 1.010 | 1.764 | 0.164 | 0.186 | 2.41 |
| 103 | 12 | 50.75 | 71.85 | 0.402 | 0.977 | 1.789 | 0.179 | 0.214 | 2.28 |
| 103 | 12 | 53.12 | 75.26 | 0.406 | 0.929 | 1.673 | 0.184 | 0.217 | 2.23 |
| 104 | 0 | 97.67 | 85.76 | 0.436 | 1.012 | 1.762 | 0.160 | 0.169 | 2.25 |
| 104 | 0 | | | | | | | | |
| 104 | 12 | 52.40 | 74.91 | 0.408 | 0.939 | 1.634 | 0.180 | 0.213 | 2.31 |
| 104 | 12 | 53.55 | 74.53 | 0.429 | 1.007 | 1.796 | 0.155 | 0.177 | 2.19 |
| 105 | 0 | 97.53 | 84.56 | 0.444 | 1.071 | 1.881 | 0.164 | 0.178 | 2.29 |
| 105 | 0 | | | | | | | | |
| 105 | 12 | 51.73 | 73.24 | 0.424 | 1.023 | 1.801 | 0.180 | 0.199 | 2.36 |
| 105 | 12 | 52.08 | 73.58 | 0.419 | 1.031 | 1.912 | 0.161 | 0.185 | 2.21 |
| 106 | 0 | 97.53 | 84.84 | 0.436 | 1.038 | 1.792 | 0.157 | 0.167 | 2.22 |
| 106 | 0 | | | | | | | | |
| 106 | 12 | 53.42 | 72029 | 0.432 | 1.078 | 2.070 | 0.172 | 0.191 | 2.25 |
| 106 | 12 | 53.33 | 73.75 | 0.435 | 1.033 | 1.847 | 0.169 | 0.186 | 2.25 |
| 107 | 12 | 55.96 | 75.20 | 0.466 | 1.105 | 1.974 | 0.179 | 0.201 | 2.31 |
| 107 | 0 | 97.78 | 85.49 | 0.429 | 1.058 | 1.909 | 0.178 | 0.191 | 2.35 |
| 107 | 0 | | | | | | | | |
| 107 | 12 | 53.12 | 75.46 | 0.421 | 0.983 | 1.726 | 0.175 | 0.192 | 2.25 |

TABLE 14

Examples 108–117 Pulp Fiber Analysis Data

| | | Percent Fines | | Mean Length mm | | | Mean Curl | | |
|---|---|---|---|---|---|---|---|---|---|
| Example | Ret | Arithmetic | Length Weighted | Arithmetic | Length Weighted | Weight Weighted | Arithmetic | Length Weighted | Kink Index |
| E | | 39.4 | 10.74 | 0.422 | 0.694 | 0.893 | 0.042 | 0.044 | 0.76 |
| 108 | 0 | 41.88 | 12.39 | 0.395 | 0.648 | 0.827 | 0.076 | 0.079 | 1.17 |
| 108 | 12 | 42.7 | 12.56 | 0.39 | 0.66 | 0.88 | 0.073 | 0.078 | 1.14 |
| 109 | 0 | 39.8 | 11.08 | 0.417 | 0.683 | 0.866 | 0.038 | 0.039 | 0.55 |
| 109 | 12 | 39.8 | 10.74 | 0.421 | 0.688 | 0.861 | 0.038 | 0.039 | 0.53 |
| 110 | 0 | 39.52 | 10.46 | 0.439 | 0.722 | 0.925 | 0.035 | 0.036 | 0.5 |
| 110 | 12 | 41.17 | 11.26 | 0.418 | 0.693 | 0.875 | 0.037 | 0.037 | 0.52 |
| 111 | 0 | 45.15 | 14.53 | 0.36 | 0.617 | 0.837 | 0.082 | 0.084 | 1.31 |
| F | | 52.27 | 9.36 | 0.6 | 1.751 | 2.633 | 0.122 | 0.157 | 1.33 |
| 112 | 0 | 54.09 | 9.28 | 0.623 | 1.913 | 2.86 | 0.089 | 0.103 | 1.03 |
| 112 | 72 | 53.83 | 8.89 | 0.651 | 2 | 2.915 | 0.077 | 0.094 | 0.98 |
| F | | 55.9 | 16.24 | 0.377 | 0.794 | 1.087 | 0.109 | 0.121 | 1.67 |
| 113 | 0 | 55.08 | 15.46 | 0.385 | 0.817 | 1.152 | 0.083 | 0.089 | 1.48 |
| 113 | 72 | 55.27 | 16.05 | 0.373 | 0.786 | 1.087 | 0.065 | 0.071 | 1.17 |
| G | | 56.42 | 7.33 | 0.798 | 2.399 | 3.238 | 0.087 | 0.097 | 1.27 |
| 114 | 0 | 58.12 | 8.46 | 0.717 | 2.293 | 3.18 | 0.197 | 0.211 | 2.4 |
| 114 | 72 | 51.04 | 6.2 | 0.859 | 2.395 | 3.216 | 0.19 | 0.209 | 2.33 |
| 115 | 0 | 55.92 | 7.59 | 0.749 | 2.283 | 3.134 | 0.192 | 0.202 | 2.42 |
| 115 | 72 | 53.65 | 7.12 | 0.78 | 2.259 | 3.056 | 0.192 | 0.209 | 2.31 |
| 115 | 3 | 55.77 | 7.98 | 0.748 | 2.304 | 3.228 | 0.213 | 0.233 | 2.42 |
| 115 | 3 | 56.16 | 7.68 | 0.744 | 2.319 | 3.198 | 0.201 | 0.215 | 2.42 |
| 115 | 72 | 55.4 | 7.92 | 0.738 | 2.238 | 3.089 | 0.205 | 0.225 | 2.32 |
| 115 | 72 | 54.4 | 7.42 | 0.772 | 2.265 | 3.114 | 0.199 | 0.214 | 2.32 |
| H | | 63.73 | 16.29 | 0.379 | 0.935 | 1.32 | 0.082 | 0.091 | 1.4 |
| 116 | 0 | 61.73 | 17.16 | 0.365 | 0.835 | 1.131 | 0.159 | 0.169 | 2.21 |
| 116 | 12 | 60.12 | 15.82 | 0.383 | 0.873 | 1.172 | 0.145 | 0.154 | 2.15 |
| 117 | 0 | 57.65 | 14.5 | 0.408 | 0.893 | 1.195 | 0.141 | 0.153 | 2.07 |
| 117 | 12 | 59.73 | 15.34 | 0.398 | 0.892 | 1.181 | 0.127 | 0.139 | 1.99 |

TABLE 15

Examples 108–117 Pulp Operating Conditions

| | | Refiner Operation | | | | | |
|---|---|---|---|---|---|---|---|
| Example | Pulp | Cons % | Pulp Flow Kg/mm | Run Time Min | Steam PSIG | Temp ° F. | Residence Min |
| 108 | Hardwood BCTMP | 35 | 0.5 | 3 | 15 | 250 | 10 |
| 109 | Hardwood BCTMP | 35 | 0.5 | 3 | 25 | 270 | 10 |
| 110 | Hardwood BCTMP | 35 | 0.5 | 3 | 15 | 250 | 10 |
| 111 | Hardwood BTCMP | 35 | 0.5 | 3 | 15 | 250 | 10 |
| 112 | SW | 20 | 0.5 | 3 | 15 | 250 | 5 |
| 113 | HW | 23 | 0.5 | 3 | 15 | 250 | 5 |
| 114 | SW | 35 | 0.5 | 3 | 15 | 250 | 5 |
| 115 | SW | 35 | 0.5 | 3 | 15 | 250 | 5 |
| 116 | HW | 35 | 0.5 | 3 | 15 | 250 | 5 |
| 117 | HW | 35 | 0.5 | 3 | 15 | 250 | 5 |

TABLE 16

Examples 103–107 Trial Fiber Analysis Data

| | | | Percent Fines | | Mean Length mm | | | Mean Curl | | |
|---|---|---|---|---|---|---|---|---|---|---|
| Example | Ret Hour | Sample | Arithmetic | Length Weighted | Arithmetic | Length Weighted | Weight Weighted | Arithmetic | Length Weighted | Kink Index |
| 103 | 0 | Post Refiner | 97.1 | 81.68 | 0.461 | 1.191 | 2.193 | 0.178 | 0.191 | 2.47 |
| 103 | 0 | Washed | 97.88 | 86.65 | 0.43 | 1.01 | 1.764 | 0.164 | 0.186 | 2.41 |
| 103 | 12 | Cold Storage | 50.75 | 71.85 | 0.402 | 0.977 | 1.789 | 0.179 | 0.214 | 2.28 |

TABLE 16-continued

Examples 103–107 Trial Fiber Analysis Data

| | | | Percent Fines | | Mean Length mm | | | Mean Curl | | |
|---|---|---|---|---|---|---|---|---|---|---|
| Example | Ret Hour | Sample | Arithmetic | Length Weighted | Arithmetic | Length Weighted | Weight Weighted | Arithmetic | Length Weighted | Kink Index |
| 103 | 12 | Cold Storage | 53.12 | 75.26 | 0.406 | 0.928 | 1.673 | 0.184 | 0.217 | 2.23 |
| 104 | 0 | Post Refiner | 97.67 | 85.76 | 0.436 | 1.012 | 1.762 | 0.16 | 0.169 | 2.25 |
| 104 | 0 | Washed | | | | | | | | |
| 104 | 12 | Cold Storage | 52.4 | 74.91 | 0.408 | 0.939 | 1.634 | 0.18 | 0.213 | 2.31 |
| 104 | 12 | Cold Storage | 53.55 | 74.53 | 0.429 | 1.007 | 1.796 | 0.155 | 0.177 | 2.19 |
| 105 | 0 | Post Refiner | 97.53 | 84.56 | 0.444 | 1.071 | 1.881 | 0.164 | 0.178 | 2.29 |
| 105 | 0 | Washed | | | | | | | | |
| 105 | 12 | Cold Storage | 51.73 | 73.24 | 0.424 | 1.023 | 1.801 | 0.18 | 0.199 | 2.36 |
| 105 | 12 | Cold Storage | 52.08 | 73.58 | 0.419 | 1.031 | 1.912 | 0.161 | 0.185 | 2.21 |
| 106 | 0 | Post Refiner | 97.53 | 84.84 | 0.436 | 1.038 | 1.792 | 0.157 | 0.167 | 2.22 |
| 106 | 0 | Washed | | | | | | | | |
| 106 | 12 | Cold Storage | 53.42 | 72.29 | 0.432 | 1.078 | 2.07 | 0.172 | 0.191 | 2.25 |
| 106 | 12 | Cold Storage | 53.33 | 73.75 | 0.435 | 1.033 | 1.847 | 0.169 | 0.186 | 2.25 |
| 107 | 0 | Post Refiner | 97.78 | 85.49 | 0.429 | 1.058 | 1.909 | 0.178 | 0.191 | 2.35 |
| 107 | 0 | Washed | | | | | | | | |
| 107 | 12 | Cold Storage | 53.12 | 75.46 | 0.421 | 0.983 | 1.726 | 0.175 | 0.192 | 2.25 |
| 107 | 12 | Cold Storage | 55.96 | 75.2 | 0.466 | 1.105 | 1.974 | 0.179 | 0.201 | 2.31 |

TABLE 17

Latency Testing Fiber Analysis Results

| | | Percent Fines | | Mean Length mm | | | Mean Curl | | |
|---|---|---|---|---|---|---|---|---|---|
| Example | Minutes | Fines Arithmetic | Fines LW | Length Arithmetic | Length LW | Length WW | Curl Arithmetic | Curl LW | Kink Index |
| 115 | 0 | 55.92 | 7.59 | 0.749 | 2.283 | 3.134 | 0.192 | 0.202 | 2.42 |
| 115 | 5 | 60.83 | 9.26 | 0.674 | 2.279 | 3.217 | 0.193 | 0.212 | 2.32 |
| 115 | 10 | 61.64 | 10.22 | 0.628 | 2.177 | 3.172 | 0.181 | 0.193 | 2.36 |
| 115 | 15 | 57 | 8.76 | 0.696 | 2.209 | 3.146 | 0.174 | 0.189 | 2.22 |
| 115 | 20 | 59.37 | 9.14 | 0.692 | 2.255 | 3.151 | 0.156 | 0.166 | 2.16 |
| 115 | 25 | 55.96 | 8.41 | 0.713 | 2.25 | 3.187 | 0.144 | 0.158 | 2.05 |
| 115 | 30 | 55.9 | 7.99 | 0.774 | 2.316 | 3.227 | 0.147 | 0.159 | 2 |
| 115 | 35 | 57.14 | 8.56 | 0.713 | 2.278 | 3.169 | 0.149 | 0.161 | 2.02 |
| 115 | 40 | 54.16 | 7.13 | 0.795 | 2.358 | 3.217 | 0.144 | 0.158 | 2.03 |
| 116 | 0 | 61.73 | 17.16 | 0.365 | 0.835 | 1.131 | 0.159 | 0.169 | 2.21 |
| 116 | 5 | 60.38 | 15.46 | 0.394 | 0.896 | 1.185 | 0.163 | 0.174 | 2.3 |
| 116 | 10 | 60.08 | 16.06 | 0.386 | 0.86 | 1.139 | 0.144 | 0.154 | 2.21 |
| 116 | 15 | 60.4 | 15.89 | 0.394 | 0.883 | 1.166 | 0.144 | 0.154 | 2.16 |
| 116 | 20 | 60.33 | 16.28 | 0.391 | 0.88 | 1.194 | 0.134 | 0.143 | 2.13 |
| 116 | 25 | 61.42 | 16.43 | 0.384 | 0.89 | 1.222 | 0.142 | 0.151 | 2.22 |
| 116 | 30 | 59.98 | 15.98 | 0.395 | 0.897 | 1.213 | 0.141 | 0.152 | 2.22 |
| 116 | 35 | 59.35 | 15.39 | 0.405 | 0.891 | 1.16 | 0.137 | 0.146 | 2.08 |
| 116 | 40 | 60.17 | 15.65 | 0.398 | 0.895 | 1.181 | 0.138 | 0.15 | 2.2 |
| 117 | 0 | 57.65 | 14.5 | 0.408 | 0.893 | 1.195 | 1.141 | 0.153 | 2.07 |
| 117 | 10 | 59.1 | 15.35 | 0.406 | 0.908 | 1.234 | 0.126 | 0.139 | 2.04 |
| 117 | 15 | 60.12 | 15.92 | 0.401 | 0.899 | 1.192 | 0.132 | 0.145 | 2.07 |
| 117 | 20 | 60.08 | 15.96 | 0.401 | 0.901 | 1.208 | 0.127 | 0.14 | 1.97 |
| 117 | 25 | 58.81 | 15.3 | 0.41 | 0.903 | 1.2 | 0.127 | 0.138 | 2.02 |
| 117 | 30 | 60.12 | 16.05 | 0.397 | 0.906 | 1.254 | 0.127 | 0.138 | 2 |
| 117 | 35 | 58.52 | 15.02 | 0.411 | 0.906 | 1.213 | 0.125 | 0.137 | 2.06 |
| 117 | 40 | 60.2 | 16.2 | 0.398 | 0.889 | 1.193 | 0.124 | 0.137 | 2.07 |

Note: Latency Procedure
Samples were diluted to about 0.4% consistency with Tap water at 125° F.
Samples were run for 40 minutes in the lab disintegrator with OP Test run every 5 minutes.

Figure 13:
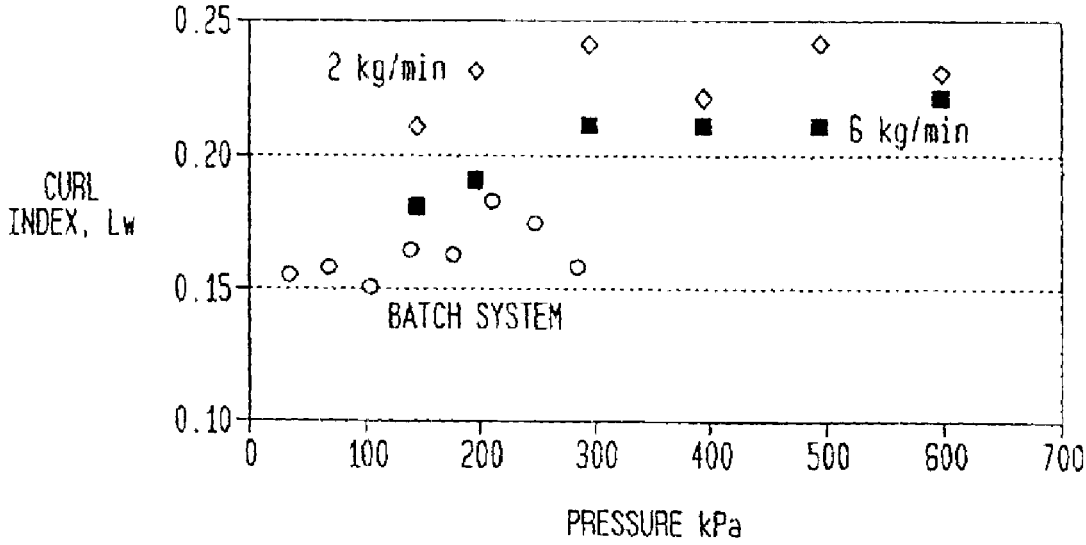
FIG. 13 is a plot of curl index vs. pressure comparing the batch and continuous systems (SBHK fiber)

The batch system data was generally consistent with the continuous system data as can be seen from FIG. 13 which is a plot of curl index (LW) vs. operating pressure in kPa. One key difference in the systems is the rate of depressurization. In the continuous system, this occurs rapidly across the blow valve. In the batch system depressurization is not rapid but very slow since there is extended retention at temperature during the run (several minutes) followed by slow depressurization (30 seconds to several minutes).

Plate Gap, Specific Energy, and Refining

Figure 14A:
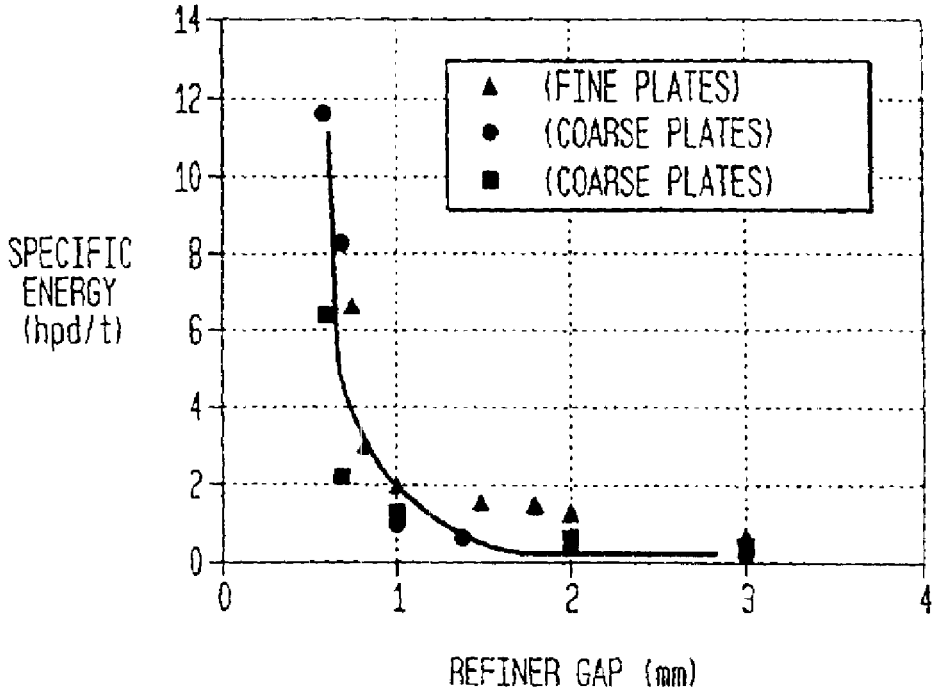
FIGS. 14A and 14B are plots of the effect of refiner gap on energy and freeness hardwood/softwood fiber (HW/SW) blend, 2 kg/min nominal throughput.
Figure 14B:
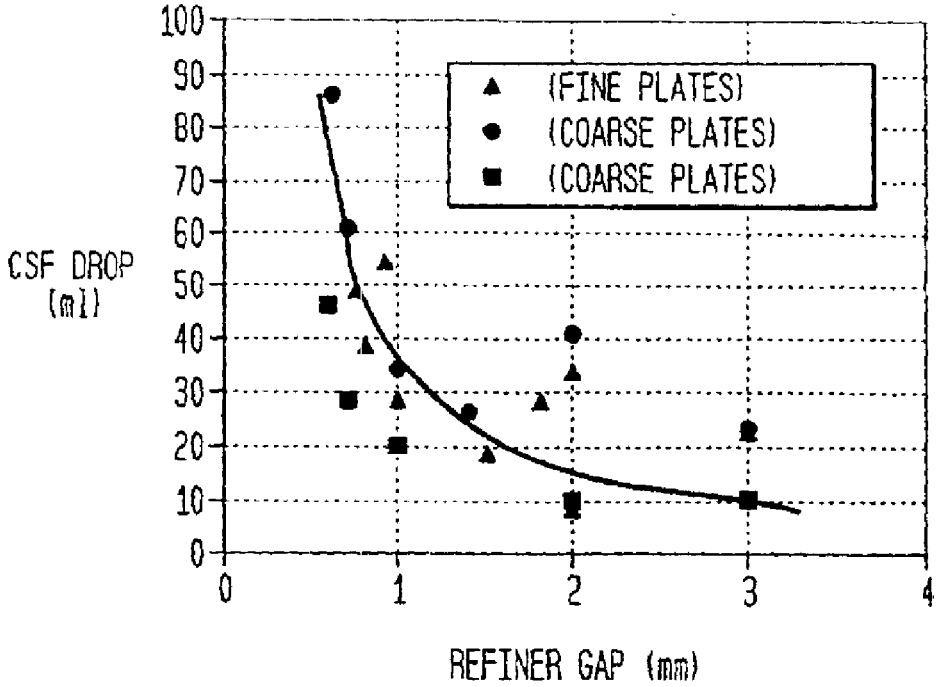

The amount of energy transferred to the fiber in a refiner is a function of pulp throughput and plate spacing. Fiber curling is achieved in a refiner using a relatively large plate gap, where energy input is extremely low and there is little or no pulp refining (as indicated by freeness drop). During initial runs with hardwood/softwood blends the plate gap was reduced to the point where a significant amount of energy was put in to the pulp. FIG. 14A plots the specific energy input as a function of plate spacing at a nominal production rate of 1.5 kg/min. The equipment is normally operated at much higher loads. The figure shows that no significant energy is transferred to the pulp until the gap is closed to less than 1 mm (around 1 to 2 mm for the higher production rate). FIG. 14B also shows the corollary result that there is very little change in freeness. Some of the more recent data shows a freeness increase achieved by way of the process of the present invention. The process may thus be viewed as a balance of curl generation and refining/fibrillation/fines generation; the former increases freeness while the latter decreases freeness.

Figure 14C:
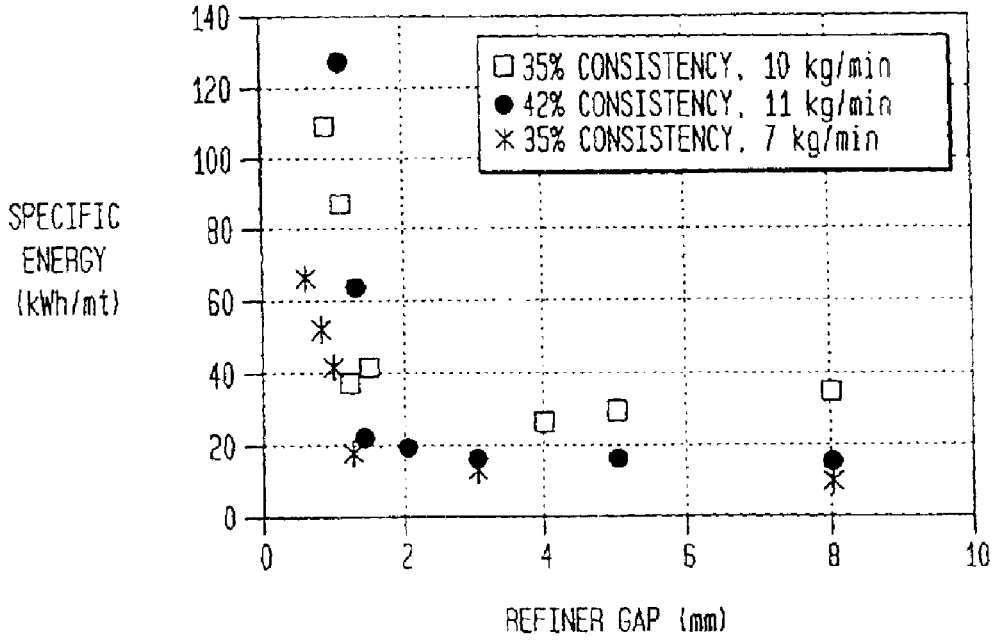
FIGS. 14C and 14D are respectively plots of specific energy vs. refiner gap and freeness vs. refiner gap for hardwood pulp treated in a disk refiner utilizing various consistencies, various feed rates and coarse plates.
Figure 14D:
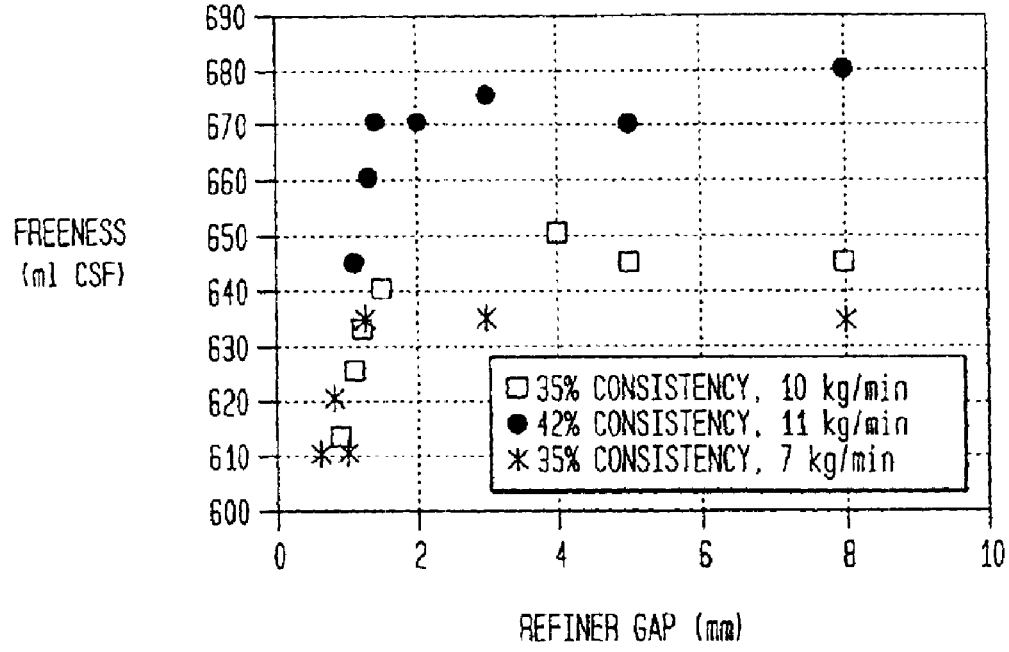

FIGS. 14C and 14D are plots of specific energy vs. refiner gap and freeness vs. refiner gap at various consistencies and feed rates for hardwood pulp having an initial freeness of 630 ml after treatment in a disk refiner with coarse plates. As will be appreciated from FIG. 14D in particular, the fibers treated at low energy and large plate gaps actually exhibited an increase in CSF.

Figure 15:
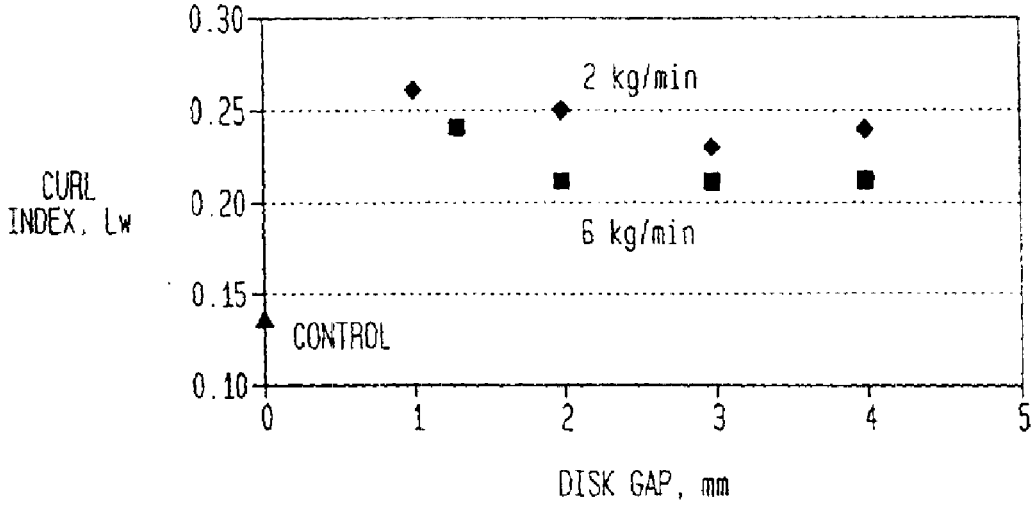
FIG. 15 is a plot of disk gap vs. curl index (SBHK)
Figure 16:
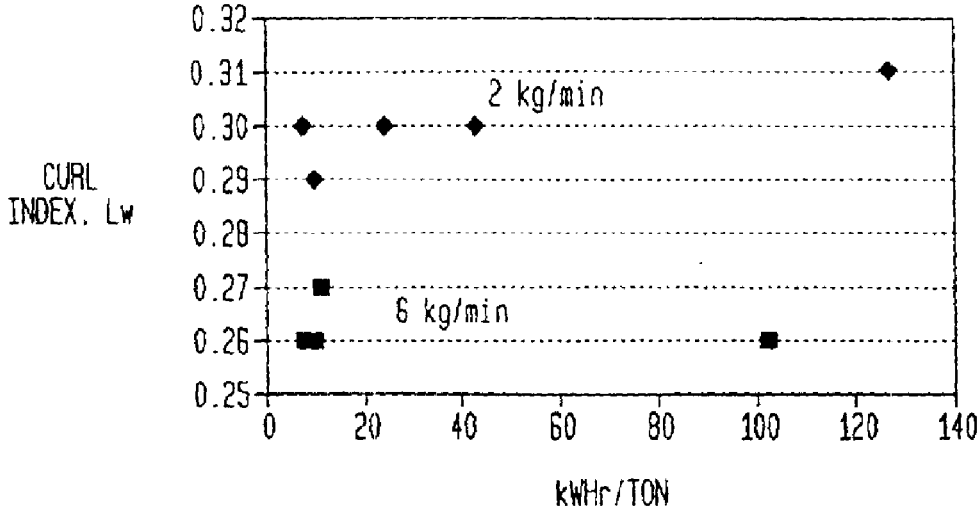
FIG. 16 is a plot of curl index vs. specific power, see Examples 30–39.

Examining curl as a function of plate gap reveals two facts which are illustrated in FIG. 15 for hardwood pulp. First, at all gaps there was a significant curl induced into the fibers. Second, plate spacing had little or no impact on curl, though there is some evidence of a trend toward higher curl at smaller gaps. This suggests that there is little change to the mechanical action applied to the fibers over this range. It is possible that the large gap limits the severity of the fiber to plate collisions the nature of which are largely unchanged as the plate gap is varied. Fiber to plate interactions would increase in energy and become more important as the gap is decreased until true refining becomes predominant—as reflected by significant changes in freeness. True refining increases fiber bonding and offsets many of the effects of fiber curl. It is interesting that even in a few experiments where more than 100 kWh/t (5 HP day/ton) energy was applied to the fiber the curl index was relatively constant (FIG. 16).

Figure 17A:
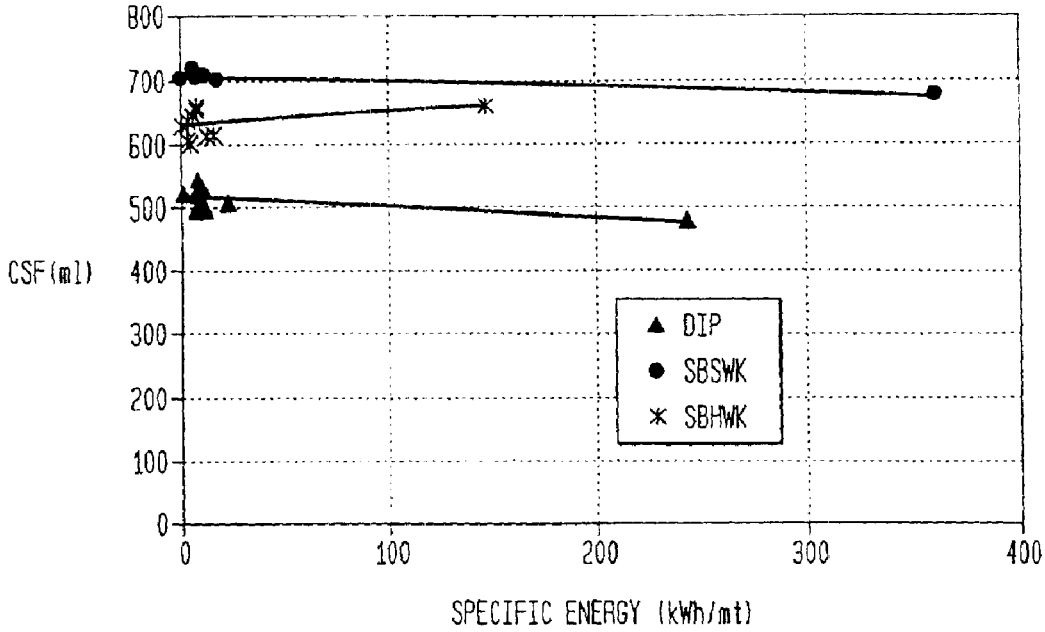
FIG. 17A is a plot of specific energy vs. freeness for various fiber including secondary fiber sometimes referred to as DIP.
Figure 17B:
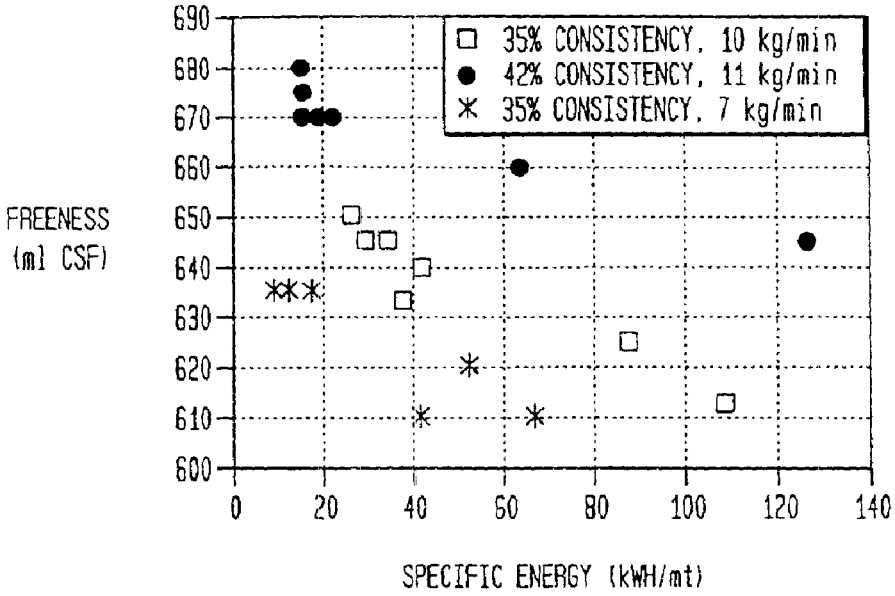
FIG. 17B is a plot of freeness vs. specific energy applied in the refiner for hardwood pulp having a pre-treatment CSF of 630 ml.

FIGS. 17A and 17B provide additional support for the lack of pulp refining (freeness drop) at the relatively low energy inputs investigated. In the cases shown in FIG. 17A, freeness is virtually constant. In FIG. 17B there is shown results of treating a hardwood pulp in accordance with the inventive process in a refiner at various specific energy inputs, feed rates and consistencies with coarse plates. The hardwood pulp had a pretreatment freeness of 630 ml and in many cases exhibited an increase in freeness especially at high consistencies and low energy inputs.

Plate Pattern

Figure 18A:
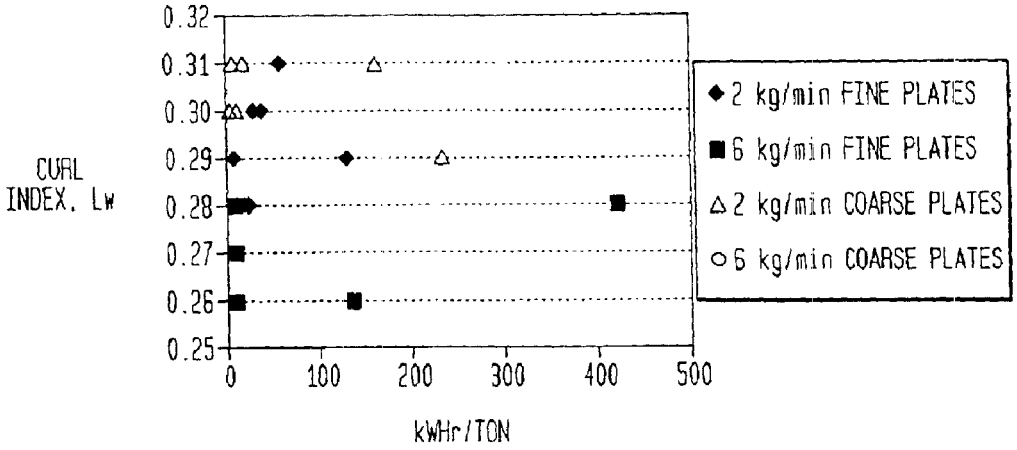
FIG. 18A is a plot of mechanical energy input vs. curl index.
Figure 18B:
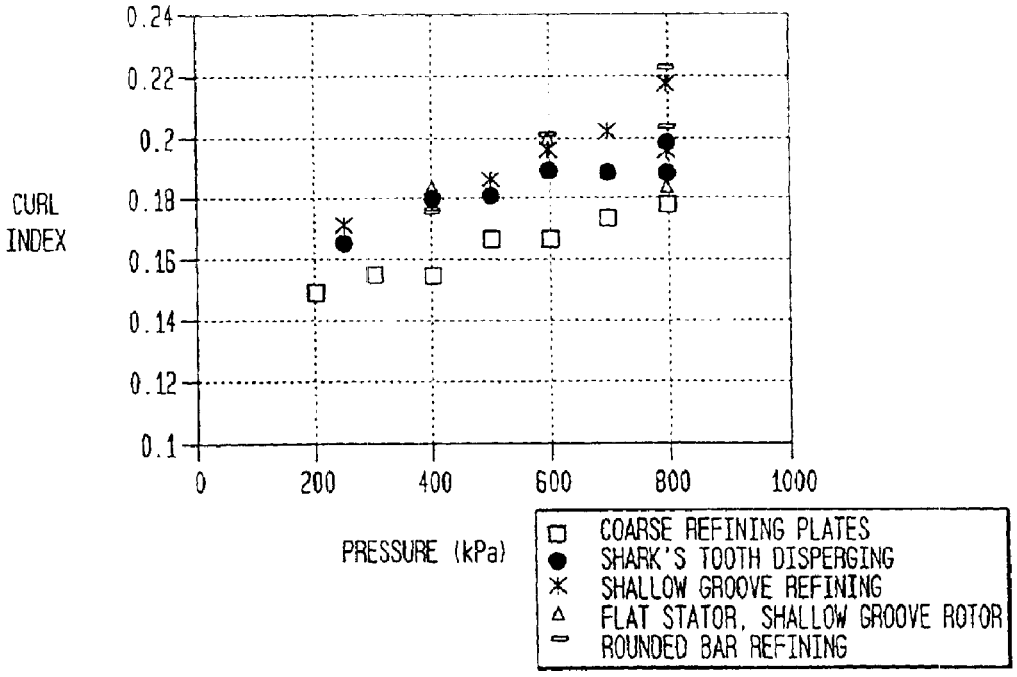
FIG. 18B is a plot of curl index vs. steam pressure for fiber processed with various plate types.

Initial experiments with the pulp used both plate types shown in FIGS. 12A and 12B, and there was no discernible difference in the curl results, which are plotted in FIG. 18A. Operationally, the fine pattern was more difficult to control when the gap was reduced to the point that significant energy was applied. This was manifested during the trial in that the fine pattern plates clogged twice while running the higher power cells. Later experiments demonstrated a modest improvement by using plate designs which presumably minimized refining of the pulp. In any event, curl generation appears to be relatively insensitive to plate type, whereas under high energy conditions pulp refining would be impacted by plate geometry. FIG. 18B is a plot of curl index vs. steam pressure for fiber treated in accordance with the process of the present invention with various plate types. The pulp had an initial freeness of 630 ml and a 3 mm gap was employed.

Disk Rotation Speed

Figure 19:
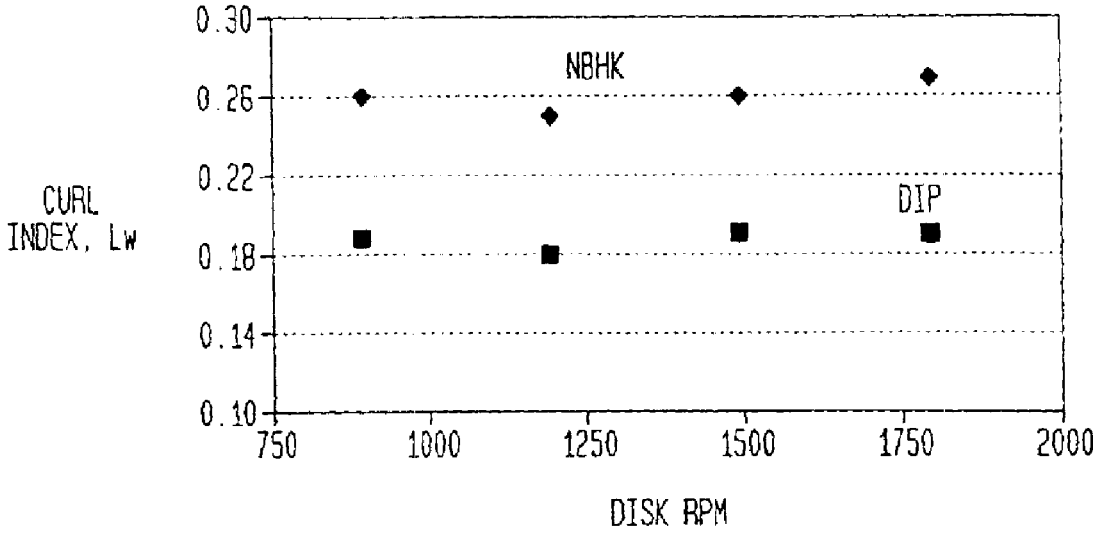
FIG. 19 is a plot of curl index vs. disk rotation speed for Northern Bleached Hardwood Kraft (NBHK) and secondary fiber.

The disk rotation speed was varied for the samples to determine the impact on curl. As shown in FIG. 19 there is no discernible difference over the range of rotational speeds examined.

Production Rate

Figure 20A:
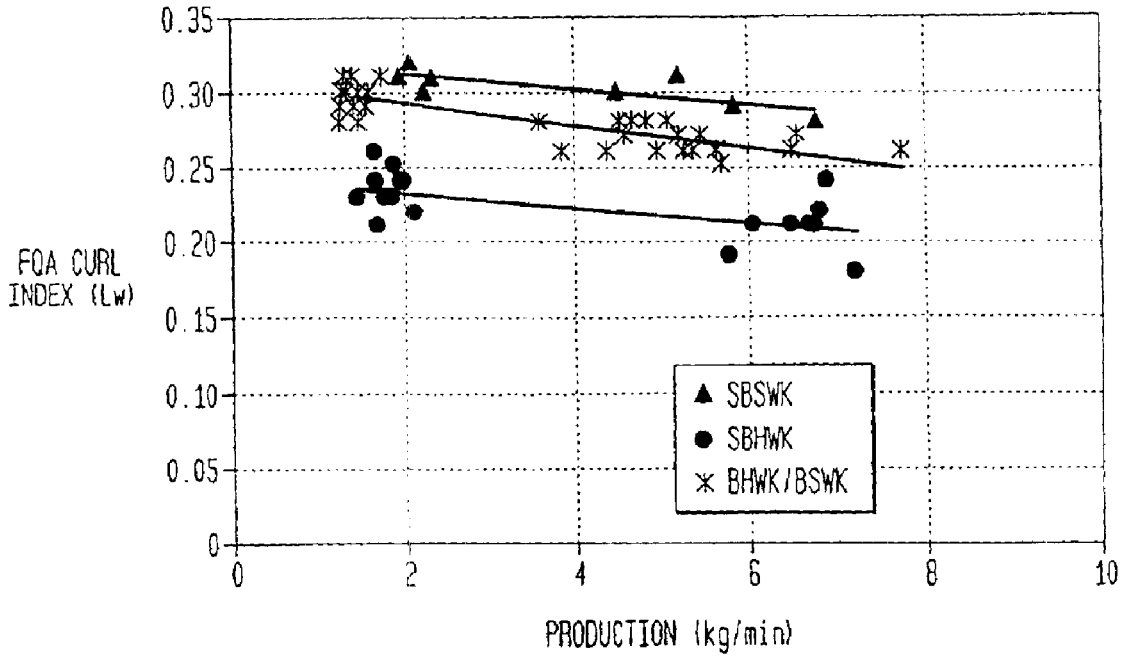
FIG. 20A is a plot of production rate vs. curl index.
Figure 20B:
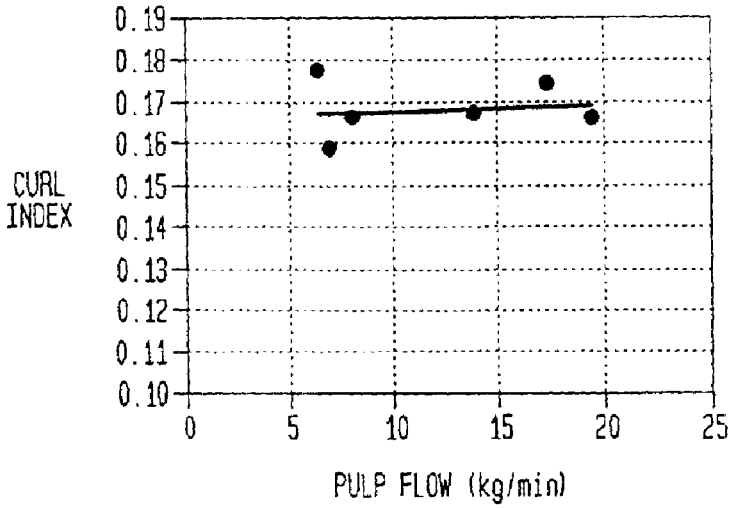
FIG. 20B is another plot of production rate vs. curl index.

In early runs, two target productions rates were examined in a continuous system: 2 kg/min and 6 kg/min. The actual feed rate was determined by weighing samples collected during a time sampling period. A number of comparisons where the feed rate was the only variable were slightly biased toward higher curl at the lower production rate, as is seen in FIG. 20A. In FIG. 20A the measured curl index for the samples is plotted as a function of throughput. In later trials, no trend with throughput was observed, as is seen in FIG. 20B.

TABLE 18

Batch Processing Retention Results

| Fiber of | Treatment Condition | | Time | Curl Index 1W | | | |
|---|---|---|---|---|---|---|---|
| Example | Consistency | Temperature | Hour | Untreated | Initial | Final | % Reduction |
| 85 | 1% | Room Temp | 12 | 0.073 | 0.177 | 0.174 | 2% |
| 86 | 1% | 120° F. | 72 | 0.073 | 0.156 | 0.138 | 12% |
| 87 | 1% | Room Temp | 18 | 0.073 | 0.181 | 0.181 | 0% |
| 88 | 1% | Room Temp | 24 | 0.073 | 0.188 | 0.165 | 12% |
| 91 | 35% | Room Temp | 18 | 0.076 | 0.157 | 0.153 | 3% |
| 93 | 1% | Room Temp | 24 | 0.076 | 0.197 | 0.191 | 3% |
| 94 | 8% | Room Temp | 72 | 0.076 | 0.186 | 0.219 | −18% |

TABLE 18-continued

Batch Processing Retention Results

| Fiber of | Treatment Condition | | Time | Curl Index 1W | | | |
|---|---|---|---|---|---|---|---|
| Example | Consistency | Temperature | Hour | Untreated | Initial | Final | % Reduction |
| 95 | 1% | Room Temp | 24 | 0.076 | 0.201 | 0.182 | 9% |
| 97 | 1% | Room Temp | 24 | 0.076 | 0.184 | 0.179 | 3% |
| 98 | 1% | Room Temp | 24 | 0.076 | 0.191 | 0.191 | 0% |
| 99 | 1% | Room Temp | 24 | 0.076 | 0.186 | 0.193 | −4% |
| 100 | 1% | Room Temp | 24 | 0.076 | 0.196 | 0.178 | 9% |
| 102 | 1% | Room Temp | 24 | 0.076 | 0.186 | 0.171 | 8% |

Curl Stability

Experiments were performed to assess the resilience of the generated fiber curl. Samples were subjected to a variety of conditions designed to mimic mill process conditions. Samples were held at high consistency, low consistency, cold, and warm temperatures. Table 18 gives typical treatment conditions for bath Examples 85 through 102. The maximum loss of curl was about 12% for all the conditions.

One significant experiment was performed on batch Example 86. The recycled pulp from Example 86 was held at low consistency (about 1%) in warm water (125° F.) water and agitated with a lab spinner for 72 hours. The measured curl index dropped from 0.156 to 0.138 over the 72 hours of retention—about a 12% reduction.

Figure 21:
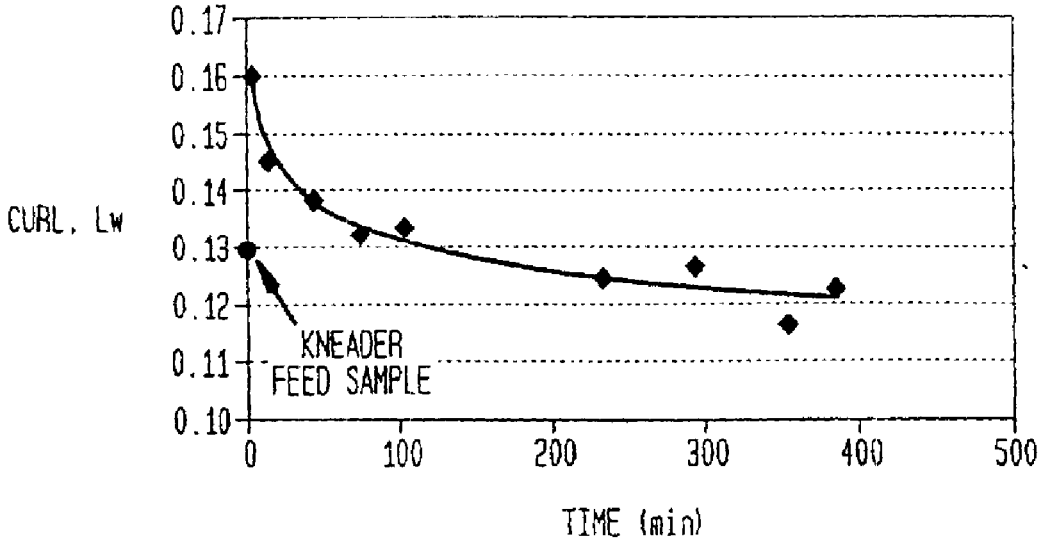
FIG. 21 is a curl decay curve upon treatment of the pulp.

Contrast the foregoing procedure with the curl induced by a kneader as shown in FIG. 21. From the plot we can see that the curl induced by the procedure was relatively small, and that in just over an hour all of the induced curl was relaxed.

Figure 22:
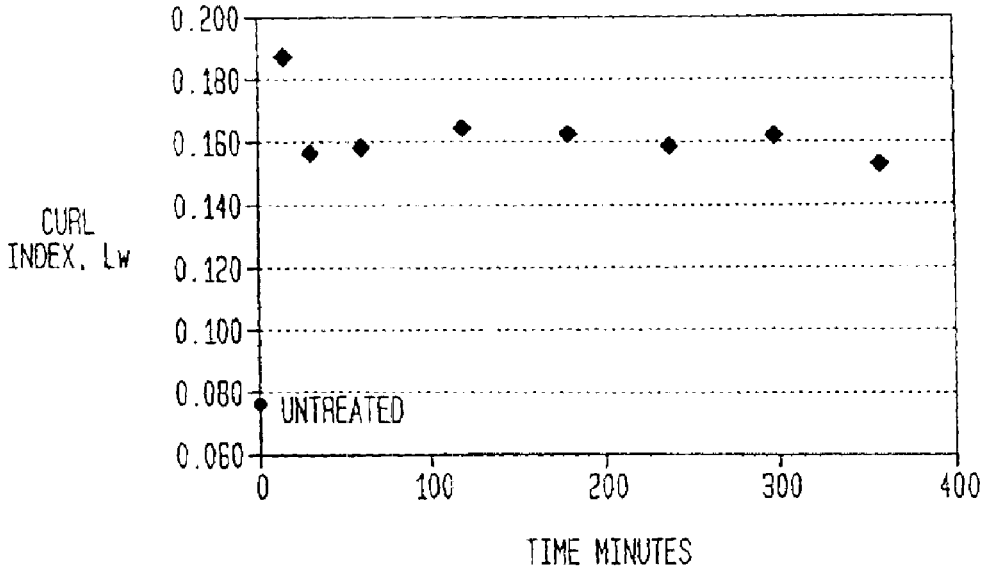
FIGS. 22–26 illustrate curl retention of the various fibers.

Pulp having an initial curl index of 0.076 was treated in a refiner with peroxide. Each sample was treated in the refiner (with peroxide bleach) and then washed in a screen box and stored at about 8% consistency in the cooler. Two days were required for the production of the samples. On the third day the samples were removed from storage and blended in a machine chest and re-pulped. The samples were diluted to about 2% consistency and continuously agitated during the papermaking trial. Curl indices were measured during the pulping process and at the machine headbox during the trial. In FIG. 22 the curl index of the blended curled pulps is plotted over the 6 hour trial. During this time the tank was continuously agitated. After the initial drop in curl of about 16% the curl leveled off and remained constant through the trial. Contrast this with the essentially identical conditions for the kneader sample plotted in FIG. 21.

Figure 23:
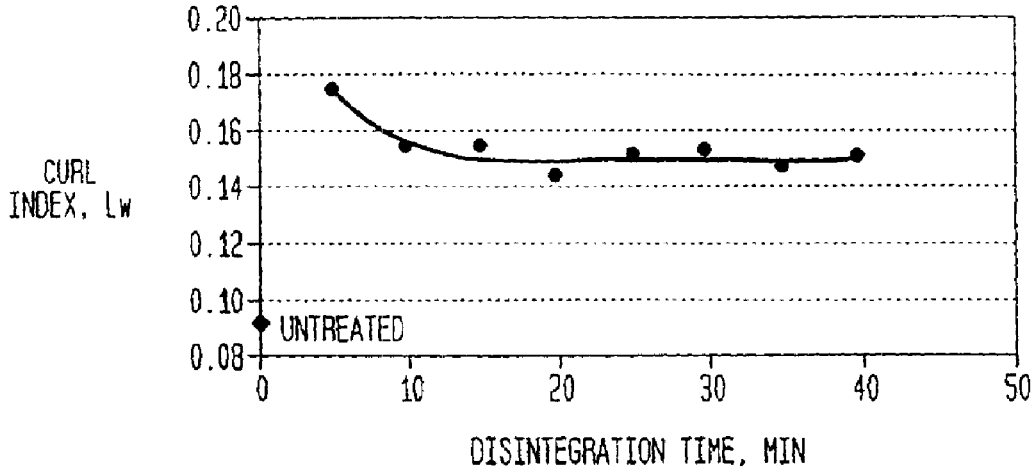
Figure 24:
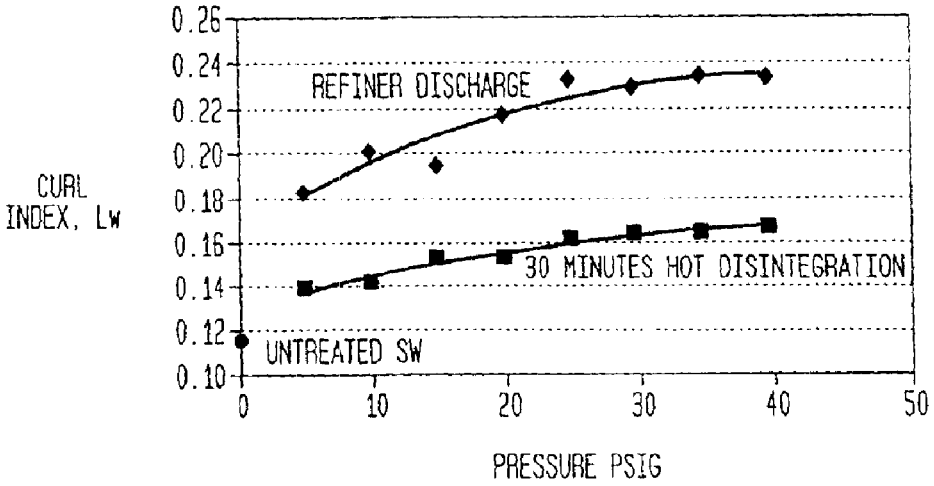

As previously mentioned, traditional high consistency refining will generate a temporary curl. In mechanical pulp mills a "latency removal" chest is placed after the refining stage to allow time for the curl to be relaxed (most mechanical pulp is utilized in flat paper applications where curl is not a desirable characteristic and is actually detrimental to the sheet). Standard practice in mechanical pulp mills is to perform a hot disintegration on any fiber to completely remove any curl or kink prior to handsheet testing. Standard methods include TAPPI 262, CPPA C.8P, and SCAN-M 10:77. Based on these methods a hot disintegration method was developed utilizing the standard laboratory disintegrator. Pulps are disintegrated for 30 minutes at low (1%) consistency, in hot (125° F.) tap water. Method development measurements showed that curl stabilized after about 10 minutes under these conditions for SBHK FIBER (FIG. 23). In FIG. 24 the results of a batch pressure series for SBSK are given.

Figure 25:
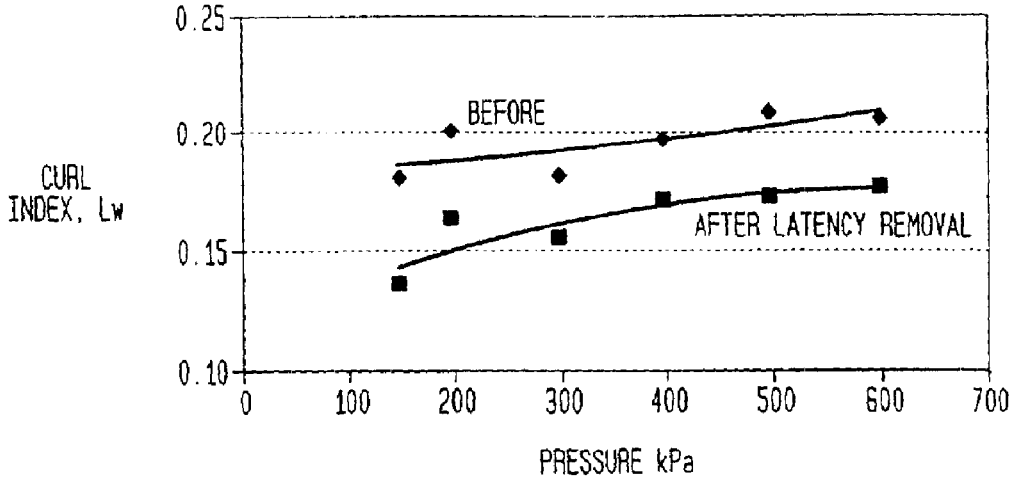
Figure 26:
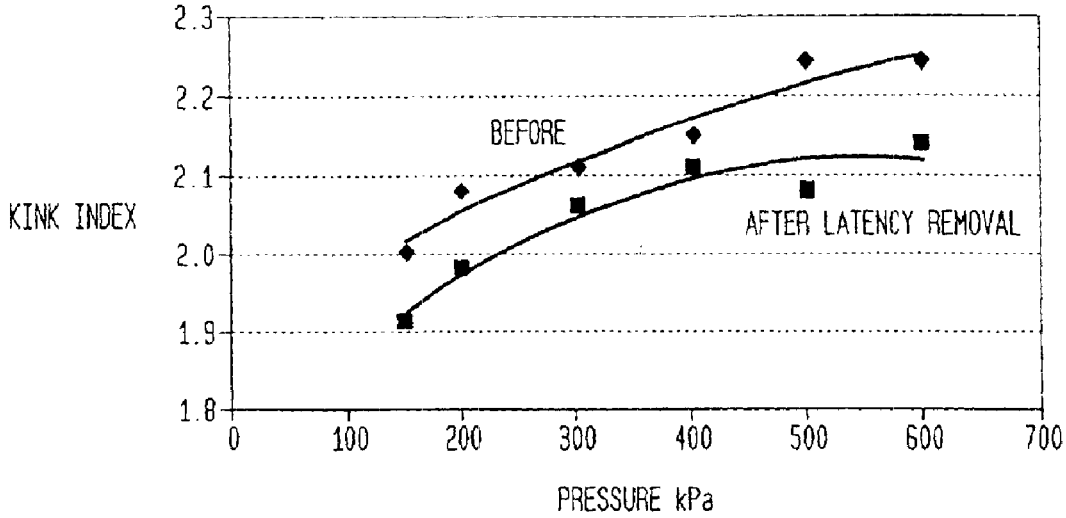

About two months after being curled, pulp samples from Examples 49 to 54 (secondary fiber) were run through the hot disintegration procedure to determine the curl resiliency. The data is plotted in FIG. 25. In FIG. 26 the kink index is plotted for the same samples. All of the samples had a measured kink and curl significantly above the untreated pulp.

TAD Laboratory Handsheet Results

Selected samples were evaluated using a laboratory TAD handsheet procedure developed. The technique involves forming the sheet on a TAD fabric and drying it with vacuum. The handsheets were then tested for tensile properties, caliper, SAT, and air permeability the results are summarized in Table 19. Samples tested include the plate gap series (Examples 41 to 44) and pressure series (Examples 49 to 54), and selected hardwood and softwood pulps, plus the corresponding uncurled control pulps.

After refiner curling, DIP secondary fiber handsheets showed a 15% caliper increase, a 19% SAT capacity increase, and a 40% tensile reduction. Currently one of the biggest obstacles to increased utilization of low cost recycled fiber is the high strength and corresponding low softness of the fiber. Often on high softness recycled grades a chemical debonder is added to reduce the strength (usually about a 25% reduction is achieved). This data suggests that refiner curling could be used to achieve a similar strength reduction while delivering a bulkier sheet.

Figure 27:
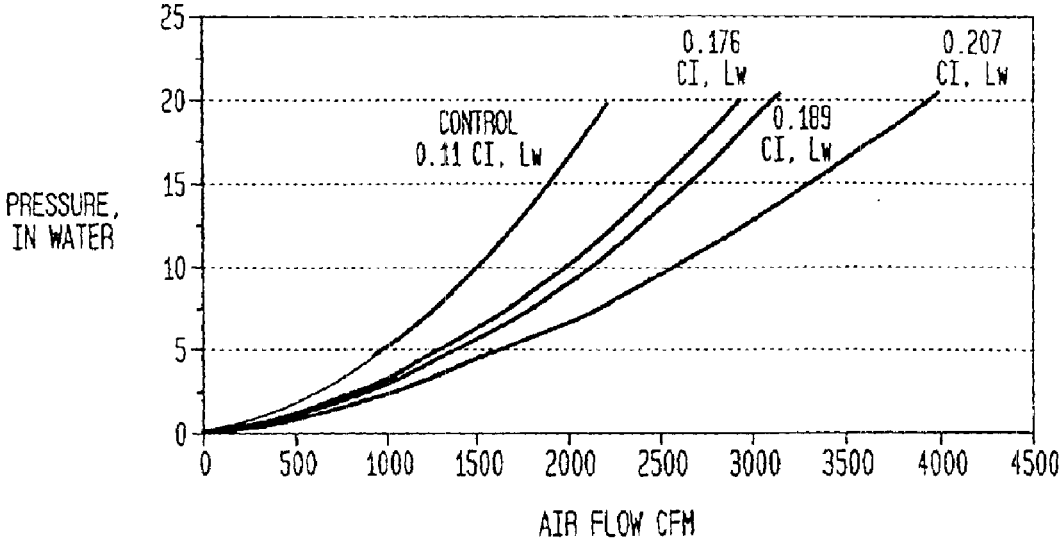
FIGS. 27–34 plot various absorbent sheet (handsheet) properties.
Figure 28:
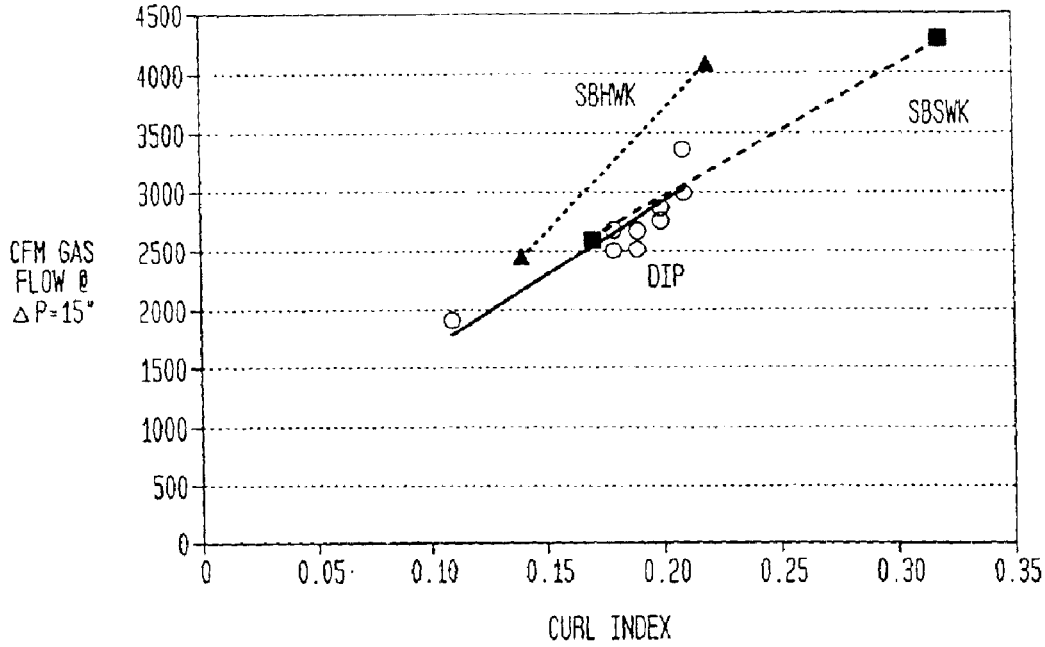

Perhaps the most important potential application for this technology is on a paper machine equipped with a through air dryer (TAD). The limiting factor for TAD machine speed is generally the drying capacity, which is directly related to the air flow through the sheet. TAD handsheet permeability was used to assess the potential of refiner curl to increase through drying efficiency. In the air permeability test the air flow rate through the handsheet is measured while the induced pressure drop across the sheet is gradually increased. FIG. 27 shows an example of the data obtained for refiner-curled secondary fiber samples. From the permeability data in FIG. 27 and Table 19 an increase in air flow (@15" water column) of over 70% was measured for the highest curled fiber. FIG. 28 summarizes all of the permeability data obtained from trial samples and shows that the permeability is directly related to the degree of fiber curl. Similar results were obtained with virgin hardwood and softwood.

TABLE 19

DIP TAD Handsheets

| Pulp from Example | Caliper mils/1 sht | SAT Capacity g/m$^2$ | SAT Time S | SAT Rate g/s 0.5 | Air Flow CFM @ 15" | Curl Index Lw | CD Tensile g/3 in | CD Stretch % | MD Tensile G/3 in | MD Stretch % |
|---|---|---|---|---|---|---|---|---|---|---|
| B | 14.88 | 135.52 | 60.10 | 0.04 | 1931 | 0.117 | 456.50 | 6.31 | 510.46 | 3.81 |
| 41 | 16.74 | 152.78 | 52.73 | 0.05 | 2439 | 0.176 | 370.50 | 8.78 | 355.36 | 4.75 |
| 42 | 16.70 | 156.24 | 52.93 | 0.05 | 2466 | 0.185 | 384.50 | 8.35 | 381.90 | 5.08 |
| 43 | 16.84 | 155.09 | 50.93 | 0.05 | 2621 | 0.189 | 378.50 | 7.95 | 391.94 | 5.50 |
| 44 | 17.52 | 149.49 | 47.53 | 0.05 | 3271 | 0.207 | 255.50 | 7.65 | 260.00 | 4.64 |
| 49 | 16.30 | 152.95 | 48.97 | 0.05 | 2670 | 0.18 | 351.80 | 7.86 | 390.36 | 4.97 |
| 50 | 16.84 | 153.77 | 53.13 | 0.05 | 2815 | 0.2 | 336.40 | 7.92 | 350.88 | 4.78 |
| 51 | 17.04 | 156.24 | 50.77 | 0.05 | 2621 | 0.181 | 352.95 | 7.94 | 361.45 | 5.08 |
| 52 | 17.38 | 157.39 | 47.67 | 0.05 | 2719 | 0.196 | 327.52 | 8.11 | 327.61 | 5.44 |
| 53 | 17.60 | 161.83 | 59.47 | 0.06 | 2950 | 0.208 | 264.21 | 8.47 | 308.80 | 5.00 |
| 54 | 17.14 | 161.34 | 49.37 | 0.4 | 3330 | 0.205 | 261.48 | 8.08 | 281.63 | 5.36 |

Figure 29:
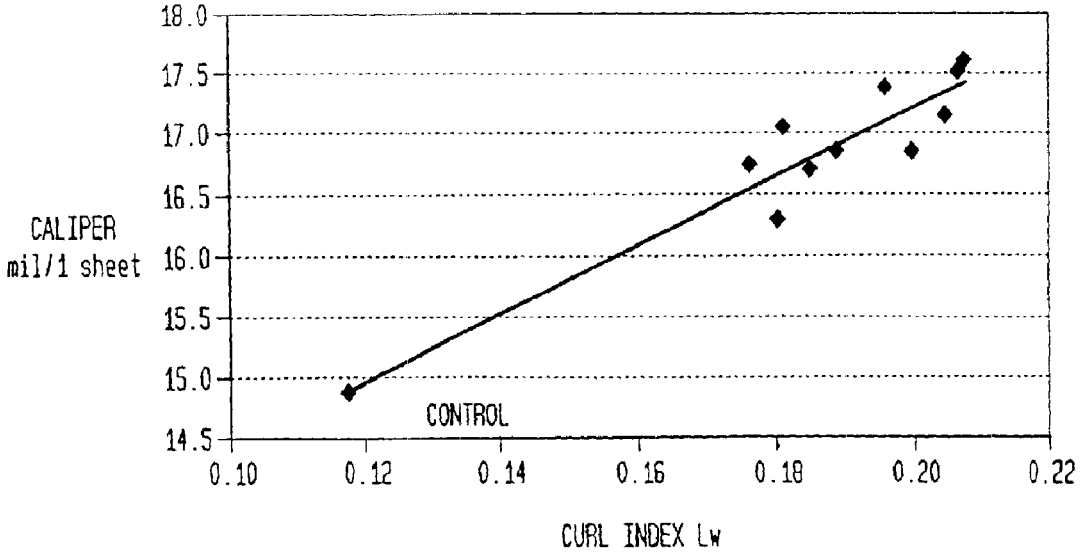
Figure 30:
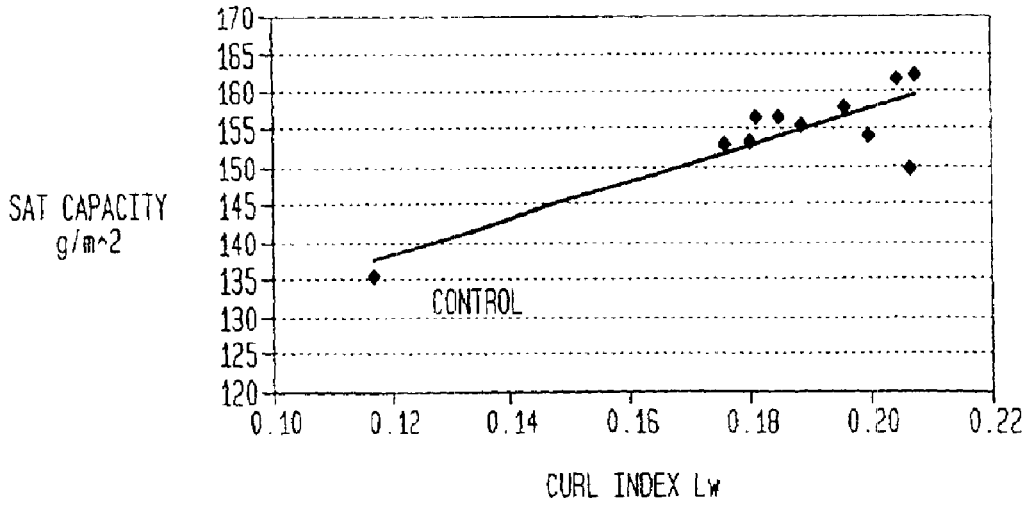

FIG. 29 shows for the DIP samples that as curl index increases the single-sheet caliper also increases. A similar relationship is seen for SAT results plotted in FIG. 30.

Figure 31:
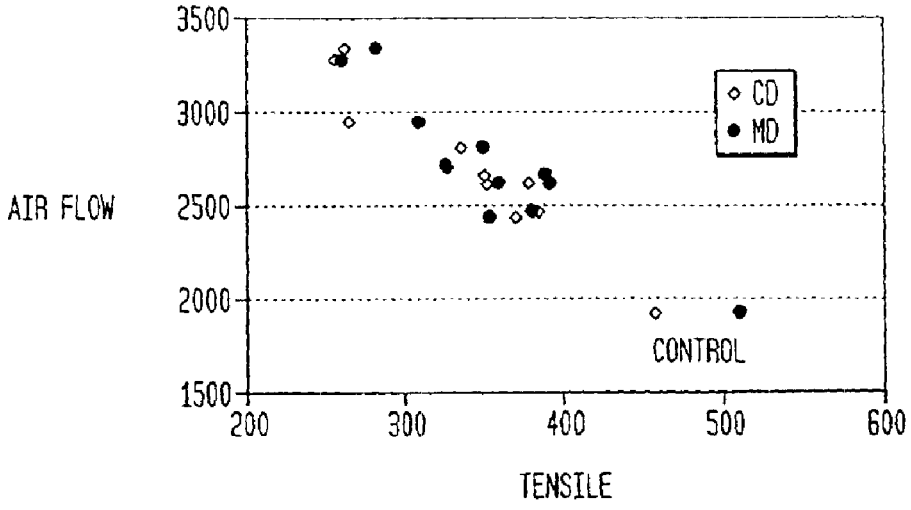

In FIG. 31 the handsheet tensile is plotted with the airflow. A relationship is seen between decreasing strength and increasing air flow as expected. It is important to note that these handsheets were made with 100% curled fiber (except the control pulps). It is not clear what characteristics a blend of curled fiber and traditionally refined fiber would have; e.g., whether it would fall on the same strength/air flow curve as 100% curled fiber. It may be that a high strength/high air flow product might be produced by combining curled and conventionally refined fibers.

In Table 19 the physical data for the DIP handsheets is given. In Table 20 similar data for the softwood and hardwood Kraft samples is given. Note the similarity, directionally, between the DIP and other samples.

Water retention

Figure 32:
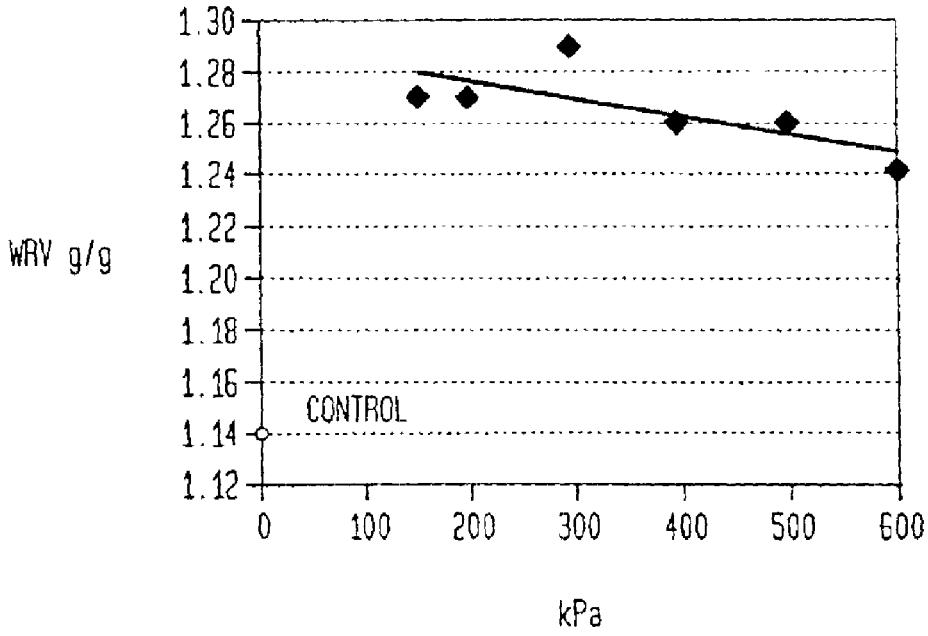
Figure 33:
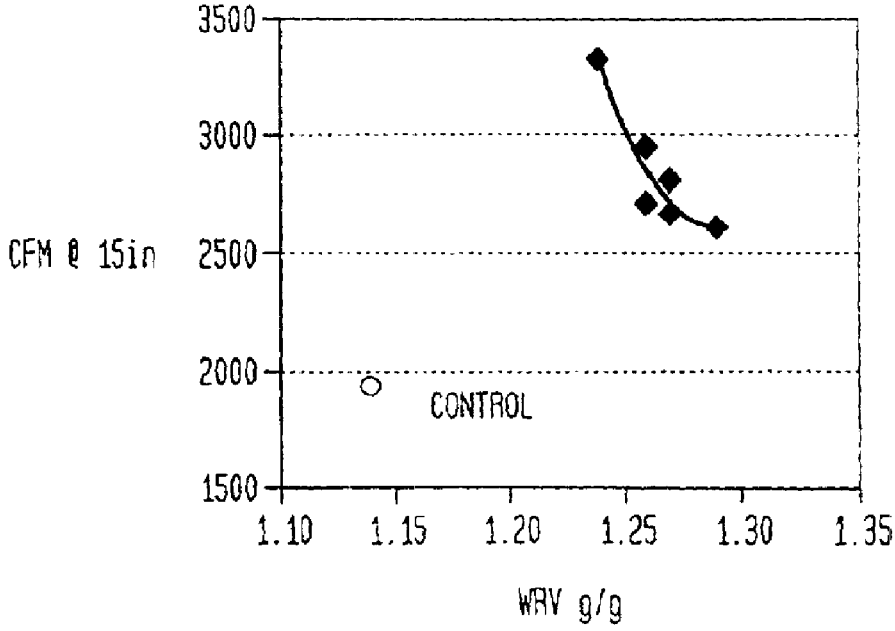
Figure 34:
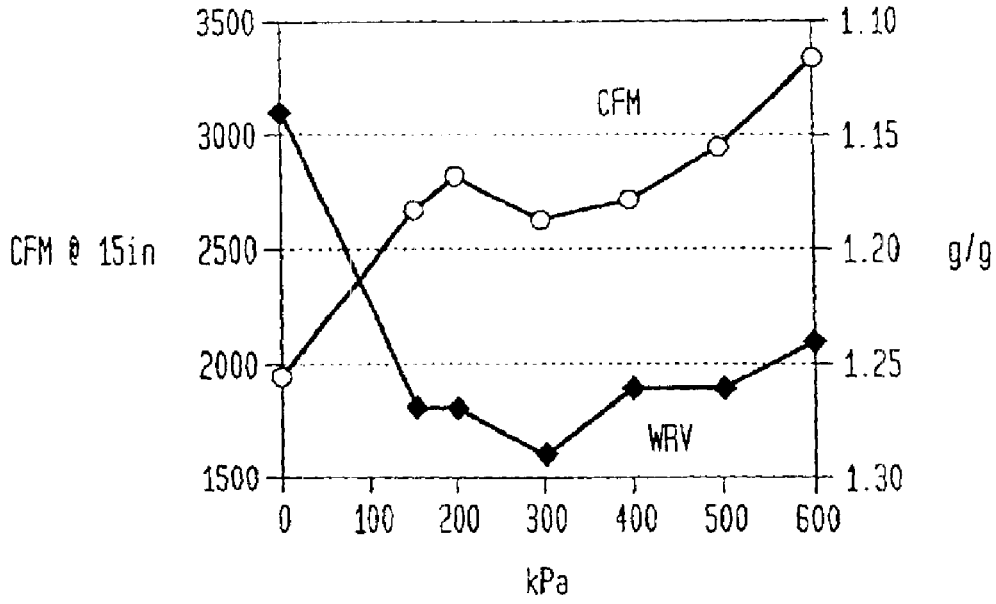

DIP based handsheets (the pressure series) and handsheets made with the control pulp were tested for water retention value. All of the pulps tested had an increase in water retention over the control, untreated, pulp. To test water retention value (WRV) the pulp sample is centrifuged under standardized conditions to remove any free water then weighted. The sample is then oven dried and re-weighed. The WRV is calculated from the centrifuged weight and the oven dried weight and has the units of g water per g fiber. Results (Table 21 and FIG. 32) show a correlation with the steam pressure/temperature used to curl the fiber. WRV goes down with pressure, but compared to the control sample all the treated pulps have a higher WRV. Thus, there is a correlation between curl and WRV for the curled samples but the baseline (uncurled) sample does not follow the same correlation. This is shown in FIGS. 33 and 34 where TAD handsheet permeability is shown as a surrogate for curl.

TABLE 20

TAD Handsheet Results

| Sample | Caliper Mils/1 sht | SAT Capacity g/m2 | SAT Time S | SAT Rate g/s 0.5 | Curl Index Lw | CD Tensile g/3 in | CD Stretch % | CD T.E.A. mm-gm/mm2 | MD Tensile g/3 in | MD Stretch % | MD T.E.A. mm-gm/mm2 |
|---|---|---|---|---|---|---|---|---|---|---|---|
| Softwood Control | 12.86 | 152.95 | 51.40 | 0.05 | 0.17 | 230.15 | 4.06 | 0.06 | 242.94 | 2.78 | 0.04 |
| Curled Softwood | 15.30 | 199.00 | 53.10 | 0.08 | 0.32 | 143.03 | 4.69 | 0.05 | 138.29 | 3.72 | 0.04 |
| Hardwood Control | 14.20 | 139.47 | 61.57 | 0.04 | 0.14 | 120.87 | 3.75 | 0.03 | 119.66 | 2.31 | 0.02 |
| Curled Hardwood | 16.24 | 180.25 | 60.97 | 0.06 | 0.22 | 55.87 | 3.61 | 0.01 | 58.64 | 2.72 | 0.01 |

TABLE 21

| | | | | | | DIP Pressure Series Water Retention | | | | |
|---|---|---|---|---|---|---|---|---|---|---|
| | Specific Energy | Pressure | Caliper | Curl Index | Freeness | Consistency | | Water Retention | | Air Flow |
| Example | KWh/ton b.d | kPa | Mils/1 sht | Lw | ml | % | Water g/g | g/g | % Total Water | CFM @ 15" |
| B | 0.00 | 0 | 14.88 | 0.12 | — | 35.00 | 1.86 | 1.14 | 61% | 1931 |
| 49 | 10.36 | 150 | 16.30 | 0.18 | 499.00 | 34.20 | 1.92 | 1.27 | 66% | 2670 |
| 50 | 7.76 | 200 | 16.84 | 0.20 | 516.00 | 35.20 | 1.84 | 1.27 | 69% | 2815 |
| 51 | 5.70 | 300 | 17.04 | 0.18 | 495.00 | 33.40 | 1.99 | 1.29 | 65% | 2621 |
| 52 | 5.00 | 400 | 17.38 | 0.20 | 515.00 | 37.00 | 1.70 | 1.26 | 74% | 2719 |
| 53 | 7.69 | 500 | 17.60 | 0.21 | 514.00 | 37.50 | 1.67 | 1.26 | 76% | 2950 |
| 54 | 6.81 | 600 | 17.14 | 0.21 | 545.00 | 40.60 | 1.46 | 1.24 | 85% | 3330 |

Figure 35:
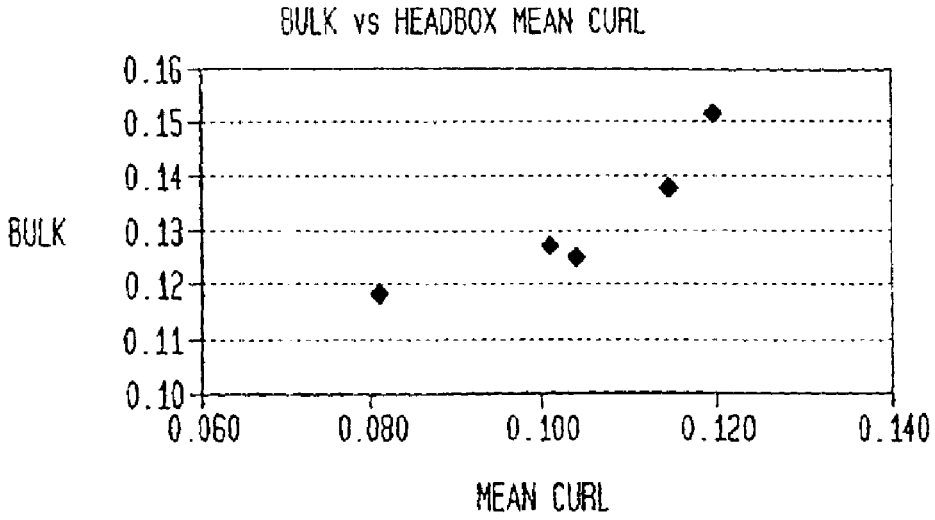
FIG. 35 is a plot of mean curl in a headbox vs. bulk of the sheet produced.
Figure 36:
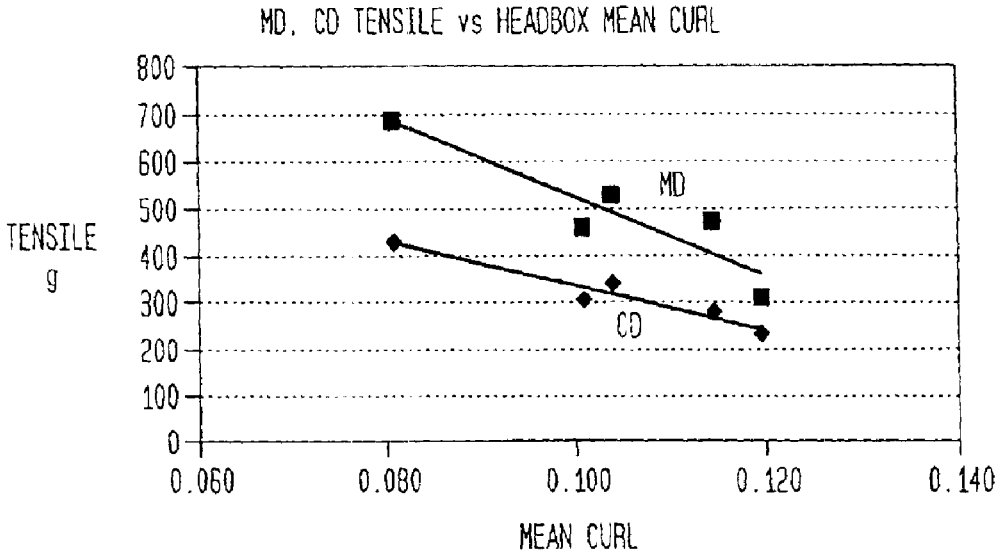
FIG. 36 is a plot of mean curl vs. tensile of absorbent sheet.
Figure 37:
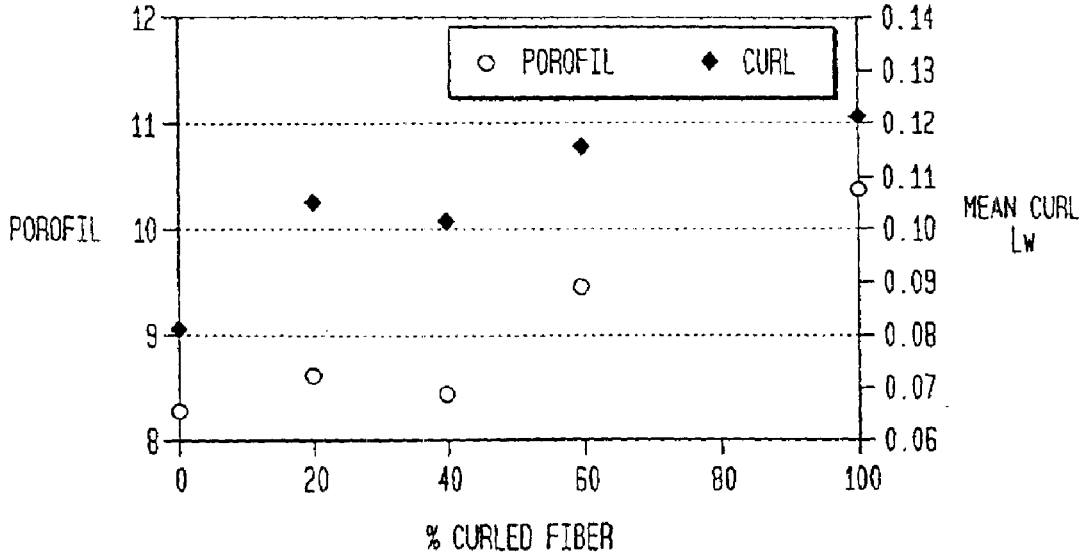
FIG. 37 is a plot of curled fiber vs. mean curl and porofil for various sheets.

A pilot paper machine trial was performed utilizing curled fiber from the batch refiner. A sample of the paper which was used in Examples 91–107 was used as the raw material. The paper was wetted to 35% consistency and run through the lab pilot pulp breaker and a portion as curled using the batch refiner. Utilizing a bleaching/curling process five batches of pulp were reduced. The five batches of pulp were combined in the machine chest, diluted to about 2% consistency and continuously agitated for the trial duration. The curl at the machine chest and headbox monitored for each cell. In FIG. 22 (above) the curl is plotted vs. time in the machine chest demonstrating the resilience of the curl produced. For the trial a nominal 9 lb/3000 $ft^2$ dry crepe sheet was produced. In Table 22 the basesheet results are given. The mean curl vs. the sheet bulk is plotted in FIG. 35. As the percentage of curled fiber is increased the headbox curl increased and so did the bulk. A similar relationship is seen in FIG. 36 where the tensile results are plotted vs. the curl; the tensile dropped with increasing curl. In FIG. 37 the porofil number (void volume) and headbox curl are plotted with the percent curled fiber in the furnish. This plot shows that both the curl in the headbox and the increasing porofil are a function of the percentage curled fiber in the furnish; the curl is resilient (survives mechanical action of agitation and pumping) and drives the changes in the sheet structure. Results also appear in Table 22.

TABLE 22

| | | Base Sheet Results | | | | |
|---|---|---|---|---|---|---|
| | | Example | | | | |
| | | 118 | 119 | 120 | 121 | 122 |
| % Refiner Bleached Fiber | | 0 | 20 | 40 | 60 | 100 |
| Basis Weight | lb/3000 $ft^2$ | 8.9 | 8.5 | 8.5 | 8.3 | 7.2 |
| Caliper | In | 33.7 | 34.0 | 34.6 | 36.5 | 34.9 |
| Bulk | $ft^3$/lb | 0.118 | 0.125 | 0.127 | 0.137 | 0.151 |
| MD Tensile | | | | | | |
| Max Load | g | 679.737 | 529.313 | 462.691 | 470.589 | 308.430 |
| % Disp | % | 25.667 | 24.426 | 23.296 | 25.759 | 24.667 |
| CD Tensile | | | | | | |
| Max Load | g | 424.431 | 340.157 | 308.716 | 274.995 | 230.614 |
| % Disp | % | 4.500 | 5.296 | 4.981 | 6.037 | 6.370 |
| Headbox Mean Curl | | 0.081 | 0.104 | 0.101 | 0.115 | 0.120 |
| Porofil | | 8.3 | 8.6 | 8.4 | 9.4 | 10.3 |

What is claimed is:

1. A process for producing high bulk cellulosic pulp exhibiting a durable elevated curl index comprising:

(a) feeding a cellulosic pulp including Kraft fiber to a refining gap defined between opposed surfaces, at least one of the surfaces being rotatable with respect to its opposed surface;

(b) concurrently heat-treating and convolving the cellulosic pulp including Kraft fiber in the refining gap at elevated temperature and pressure at high consistency under conditions selected so as to preclude substantial fibrillation and attendant paper strength and fiber bonding development, wherein said step of heat-treating and convolving said fiber has a duration of up to about 20 seconds;

(c) recovering said pulp wherein the length weighted curl index of the treated fiber is at least about 20% higher than the length weighted curl index of the fiber prior to said heat treatment and convolving thereof, wherein said at least 20% elevation of said length weighted curl index of the treated fiber is a property of the fiber capable of persisting for at least 30 minutes in a disintegrator at 1% consistency at a temperature of 125° F.

2. The process according to claim 1, wherein said step of concurrently heat-treating and convolving said fiber is carried out in a chamber in the presence of saturated steam.

3. The process according to claim 2, wherein the pressure in said chamber is pulsed with respect to time.

4. The process according to claim 3, wherein the localized pressure within the chamber is pulsed with respect to time.

5. The process according to claim 4, wherein said step of concurrently heat-treating and convolving said fiber is carried out in a disk refiner provided with a rotating disk having a relief pattern operative to impart localized pressure pulses within the chamber.

6. The method according to claim 5, wherein a gap between a disk of said disk refiner and an opposing surface is from about 0.5 mm to about 10 mm.

7. The method according to claim 6, wherein a gap between a disk of said disk refiner and an opposing surface is from about 1 mm to about 5 mm.

8. The process according to claim 1, wherein said pulp exhibits a drop in CSF of at most about 60 ml by way of said process.

9. The process according to claim 8, wherein said pulp exhibits a drop in CSF of at most about 45 ml by way of said process.

10. The process according to claim 9, wherein said pulp exhibits a drop in CSF of at most about 30 ml by way of said process.

11. The process according to claim 10, wherein said pulp exhibits a drop in CSF of at most about 20 ml by way of said process.

12. The process according to claim 11, wherein said pulp exhibits a drop in CSF of at most about 10 ml by way of said process.

13. The process according to claim 12, wherein the curl index of the treated fiber is reduced by at most about 25% by treatment at 1% consistency at 125° F. in a disintegrator for 30 minutes.

14. The process according to claim 13, wherein said treated fiber has a length-weighted curl index of at least about 0.25.

15. The process according to claim 12, wherein the curl index of the treated fiber is reduced by at most about 15% by treatment at 1% consistency at 125° F. in a disintegrator for 30 minutes.

16. The process according to claim 15, wherein said treated fiber has a length-weighted curl index of at least about 0.3.

17. The process according to claim 12, wherein the curl index of the treated fiber is at least about 40% higher than the curl index of the fiber prior to heat-treating and convolving said fiber.

18. The process according to claim 1, wherein said pulp exhibits no drop in CSF and optionally exhibits an increase in CSF by way of said process.

19. The process according to claim 18, wherein said pulp exhibits an increase in CSF of at least about 10 ml by way of said process.

20. The process according to claim 19, wherein said pulp exhibits an increase in CSF of at least about 20 ml by way of said process.

21. The process according to claim 20, wherein said pulp exhibits an increase in CSF of at least about 30 ml by way of said process.

22. The process according to claim 1, wherein the curl index of the treated fiber is at least about 30% higher than the curl index of the fiber prior to said step of concurrently heat-treating and convolving said fiber.

23. The process according to claim 22, wherein the treated fiber has a length-weighted curl index of at least about 0.2.

24. The process according to claim 1, wherein the curl index of the treated fiber is at least about 50% higher than the curl index of the fiber prior to heat-treating and convolving said fiber.

25. The process according to claim 1, wherein the treated fiber has a length-weighted curl index of at least about 0.12.

26. The process according to claim 1, wherein said treated fiber has a length-weighted curl index of at least about 0.15.

27. The process according to claim 1, wherein said step of heat-treating and convolving said fiber is carried out at a consistency of from about 20% to about 60%.

28. The process according to claim 27, wherein said step of heat-treating and convolving said fiber is carried out at a consistency of from about 20% to about 50%.

29. The process according to claim 28, wherein said step of heat-treating and convolving said fiber is carried out at a consistency of from about 30% to about 40%.

30. The process according to claim 1, wherein said step of heat-treating and convolving said fiber has a duration of from about 0.01 to about 20 seconds.

31. The process according to claim 30, wherein said step of heat-treating and convolving said fiber has a duration of less than about 10 seconds.

32. The process according to claim 31, wherein said step of heat-treating and convolving said fiber has a duration of less than about 5 seconds.

33. The process according to claim 32, wherein said step of heat-treating and convolving said fiber has a duration of less than about 2 seconds.

34. The process according to claim 1, wherein said step of heat-treating and convolving said fiber is carried out at a temperature of from about 230° F. to about 370° F.

35. The process according to claim 1, wherein mechanical energy input to said fiber during said heat-treating and convolving step is less than about 2 HP-days/ton.

36. The process according to claim 35, wherein the mechanical energy input to said fiber during said heat-treating and convolving is less than about 1 HP-day/ton.

37. The process according to claim 36, wherein mechanical energy input to said fiber during said heat-treating and convolving step is less than about 0.5 HP-days/ton.

38. The process according to claim 1, wherein said step of heat-treating and convolving is carried out at a pressure of from about 5 to about 150 psig.

39. The process according to claim 38, wherein said step of heat-treating and convolving is carried out at a pressure of from about 10 to about 90 psig.

40. The method according to claim 1, wherein said step for heat-treating and convolving said fiber is carried out in the presence of papermaking chemicals, one or more of which chemicals is selected from the group consisting of sulfates, silicates, hydroxides, peroxides and debonders.

41. The method according to claim 1, wherein said step of heat-treating and convolving said fiber is carried out in the presence of an alkaline agent and a peroxide bleach.

42. The process according to claim 41, wherein said alkaline agent comprises sodium hydroxide.

43. The process according to claim 1, wherein said fiber consists essentially of a secondary fiber.

44. The process according to claim 1, wherein said fiber consists of secondary fiber.

45. The process according to claim 1, wherein the cellulosic pulp is selected from the group consisting of Kraft hardwood fibers, Kraft softwood fibers, and mixtures thereof.

46. The process according to claim 1, wherein said pulp comprises a mixture of virgin fiber and secondary fiber comprising from about 5% to about 95% by weight of secondary fiber based on the weight of fiber present in the pulp.

47. A method of making absorbent sheet from cellulosic furnish comprising:

(a) thickening a pulp process stream including Kraft fiber to a consistency of from about 20% to about 60%;

(b) feeding the cellulosic pulp including Kraft fiber to a refining gap defined between opposed surfaces, at least one of the surfaces being rotatable with respect to its opposed surface;

(c) concurrently heat-treating and convolving the fiber of said thickened pulp process stream including Kraft fiber in the refining gap under conditions selected so as to preclude substantial fibrillation and attendant paper strength and fiber bonding development such that the length weighed curl index of the fiber is at least about 20% higher than the length weighted curl index of the fiber prior to said heat-treatment and convolving thereof and the 20% elevation of the curl index is a property of the fiber capable of persisting for 30 minutes in a disintegrator at 1% consistency at temperature of 125° F., wherein said step of heat-treating and convolving said fiber has a duration of up to about 20 seconds;

(d) combining said treated pulp process stream with a second pulp process stream to provide a papermaking furnish;

(e) depositing said papermaking furnish on a foraminous support to form a web; and (f) drying said web to make absorbent sheet.

48. The method according to claim 47, wherein said pulp process stream treated in accordance with step (b) is prepared by dividing a feed pulp process stream into said pulp process stream and said second pulp process stream.

49. The method according to claim 48, wherein said second pulp process stream is subjected to low consistency refining.

50. The method according to claim 49, wherein said feed pulp process stream and second pulp process stream are at a consistency of less than about 6%.

51. The method according to claim 50, wherein said feed pulp process stream and second pulp process stream are at a consistency of less than about 5%.

52. The process according to claim 47, wherein said step of drying said web comprises throughdrying said web.

53. A method of making absorbent sheet comprising:

(a) preparing a first cellulosic pulp component exhibiting an elevated durable curl index by way of (i) feeding a cellulosic pulp including Kraft fiber to a refining gap defined between opposed surfaces, at least one of the surfaces being rotatable with respect to its opposed surface; (ii) concurrently heat-treating and convolving the cellulosic pulp including Kraft fiber in the refining gap at elevated temperature and pressure under conditions selected so as to preclude substantial fibrillation and attendant paper strength and fiber bonding development wherein the length weighted curl index of the treated fiber is at least about 20% higher than the length weighted curl index of the fiber prior to heat treatment and convolving thereof, said 20% elevation in curl index being capable of persisting for 30 minutes in a disintegrator at 1% consistency at a temperature of 125° F., wherein said step of heat-treating and convolving said fiber has a duration of up to about 20 seconds;

(b) combining in admixture said first cellulosic pulp component with a second cellulosic pulp component to make a papermaking furnish, said second cellulosic pulp component having a length weighted curl index lower than the length weighted curl index of said first pulp component;

(c) depositing said papermaking furnish on a foraminous support to form a web; and (d) drying said web to make absorbent sheet.

54. The process according to claim 53, wherein said step of drying said web comprises throughdrying said web.

55. The process according to claim 53, wherein said first cellulosic pulp component comprises at least about 50% of the fiber present in said absorbent sheet.

56. The process according to claim 55, wherein said first cellulosic pulp component comprises at least about 75% of the fiber present in said absorbent sheet.

57. The process according to claim 56, wherein said first cellulosic pulp component comprises at least about 90% of the fiber present in said absorbent sheet.

58. The method of claim 53, wherein the length weighted curl in ex of said second cellulosic pulp component is at least 25% lower than the length weighted curl index of said first cellulosic pulp component after said first cellulosic pulp component has been heat treated and convolved.

59. The method of claim 53, wherein the length weighted curl index of said second cellulosic pulp component is at least 35% lower than the length weighted curl index of said first cellulosic pulp component after said first cellulosic pulp component has been heat treated and convolved.

60. The method of claim 53, wherein the length weighted curl index of said second cellulosic pulp component is at least 50% lower than the length weighted curl index of said first cellulosic pulp component after said first cellulosic pulp component has been heat treated and convolved.

61. A method of making absorbent sheet comprising:

(a) preparing a first cellulosic pulp component exhibiting an elevated durable curl index by way of (i) feeding a cellulosic pulp including Kraft fiber to a refining gap defined between opposed surfaces, at least one of the surfaces being rotatable with respect to its opposed surface; (ii) concurrently heat-treating and convolving the cellulosic pulp including Kraft fiber at elevated temperature and pressure under conditions selected so as to preclude substantial fibrillation and attendant paper strength and fiber bonding development, wherein said step of heat-treating and convolving said fiber has a duration of up to about 20 seconds, and wherein the length weighted curl index of the treated fiber is at least about 20% higher than the length weighted curl index of the fiber prior to heat treatment and convolving thereof, said 20% elevation in curl index being capable of persisting for 3 minutes in a disintegrator at 1% consistency at a temperature of 125° F.; and (b) combining in admixture said first cellulosic pulp component with a second cellulosic pulp component to make a papermaking furnish, said second cellulosic pulp component having been refined at low consistency prior to combination with said first cellulosic pulp component.

62. The method according to claim 61, wherein said second cellulosic pulp component is refined at a consistency of less than about 5 percent.

63. The method according to claim 61, further comprising the steps of:

(c) depositing said papermaking furnish on a foraminous support to form a web; and (d) drying said web to make absorbent sheet.

64. A process for producing high bulk cellulosic pulp exhibiting a durable elevated curl index comprising:

(a) feeding a cellulosic pulp including Kraft fiber to a refining gap defined between opposed surfaces, at least one of the surfaces being rotatable with respect to its opposed surface;

(b) concurrently heat-treating and convolving the cellulosic pulp including Kraft fiber in the refining gap at elevated temperature and pressure at high consistency under conditions selected so as to preclude substantial fibrillation and attendant paper strength and fiber bonding development, wherein said step of heat-treating and convolving said fiber has a duration of up to about 20 seconds;

(c) recovering said pulp wherein the length weighted curl index of the treated fiber is at least about 20% higher than the length weighted curl index of the fiber prior to said heat treatment and convolving thereof, wherein said at least 20% elevation of said length weighted curl index of the treated fiber is capable of persisting for at least 30 minutes in a disintegrator at 1% consistency at a temperature of 125° F.;

(d) diluting said pulp to a low consistency; and (e) refining said pulp at said low consistency.

65. The method according to claim 64, wherein said low consistency is about 5 percent or less.

66. A process for producing high bulk cellulosic pulp exhibiting a durable elevated curl index comprising:

(a) refining cellulosic pulp including Kraft fiber at low consistency;

(b) thickening the cellulosic pulp including Kraft fiber to a high consistency;

(c) feeding a cellulosic pulp including Kraft fiber to a refining gap defined between opposed surfaces, at least one of the surfaces being rotatable with respect to its opposed surface; and (d) concurrently heat-treating and convolving said cellulosic fiber pulp at elevated temperature and pressure at said high consistency under conditions selected so as to preclude substantial fibrillation and attendant paper strength and fiber bonding development, wherein said step of heat-treating and convolving said fiber has a duration of up to about 20 seconds; and wherein the length weighted curl index of the treated fiber is at least about 20% higher than the length weighted curl index of the fiber prior to said heat treatment and convolving thereof, wherein said at least 20% elevation of said length weighted curl index of the treated fiber is capable of persisting for at least 30 minutes in a disintegrator at 1% consistency at a temperature of 125° F.

67. The process according to claim 66, wherein said refining step at consistency is carried out at a consistency of about 5 percent or less.

* * * * *

UNITED STATES PATENT AND TRADEMARK OFFICE

CERTIFICATE OF CORRECTION

PATENT NO. : 6,899,790 B2
DATED : May 31, 2005
INVENTOR(S) : Jeffrey A. Lee

It is certified that error appears in the above-identified patent and that said Letters Patent is hereby corrected as shown below:

Column 1,
Line 60, change “20” to -- 20% --;
Line 62, change “reining” to -- refining --;
Line 64, delete the second instance of “be”;

Column 2,
Line 8, insert -- are -- after “they”;
Line 19, insert -- relates -- after “Logan et al.”;
Lines 28 and 30, change “Aspland” to -- Asplund --;
Line 63, change “Back at al.” to -- Back et al. --;
Line 66, change “muss” to -- mass --;

Column 3,
Line 4, change “fibors” to -- fibers --;
Line 42, change “mechanic” to -- mechanical --;

Column 4,
Line 50, change “kinking,” to -- kinking --;

Column 5,
Line 25, change “farther” to -- further --;

Column 7,
Line 33, insert -- pulp -- after “cellulosic”;
Line 55, change “to” to -- with --;

Column 8,
Line 17, change “v.” to -- vs. --;
Line 53, change “fiber” to -- fibers --;

Column 11,
Line 2, change “20” to -- 20% --;
Line 45, insert -- and -- before “(d)”;

Column 12,
Line 9, change “kraft” to -- Kraft --;
Line 48, delete “short”;

Column 13,
Line 55, delete “)” after “9902458.”;
Line 67, change “[$W_2$-$W_1$)” to -- [($W_2$-$W_1$) --;

UNITED STATES PATENT AND TRADEMARK OFFICE

CERTIFICATE OF CORRECTION

PATENT NO. : 6,899,790 B2
DATED : May 31, 2005
INVENTOR(S) : Jeffrey A. Lee

It is certified that error appears in the above-identified patent and that said Letters Patent is hereby corrected as shown below:

Column 14,
Lines 8, 10 and 12, change “Tappi” to -- TAPPI --;
Line 58, change “kraft” to -- Kraft --;

Column 15,
Line 18, change “mm-$^{1}$” to -- mm$^{-1}$ --;
Line 28, change “kraft” to -- Kraft --;

Column 17,
Line 36, change “patents” to -- patents, --;
Line 40, insert -- a -- before “shaft”;

Column 18,
Line 15, delete “a”;

Column 19,
Line 9, change “commercial soale” to -- Commercial scale --;

Column 20,
Line 23, bottom of Table 3, insert -- * -- before “Unless”;
Line 30, change “warm” to -- was --;
Line 31, change “(nominal 35% consistency)” to -- nominal 35% consistency --;

Columns 21 and 22,
Table 4, Example 15, under “test time min”, change “105” to -- 1.5 --;

Columns 25 and 26,
Table 8, Example 67, under “KW: Idle load”, change “77” to -- 7 --;

Column 28,
Line 29, insert -- and -- after “17”;

Column 38,
Table 18, change “Curl Index 1W” to -- Curl Index Lw --;

Column 39,
Line 25, change “bath” to -- batch --;

Columns 41 and 42,
Table 19, change “MD Tensile G/3 in” to -- MD Tensile g/3 in --;

UNITED STATES PATENT AND TRADEMARK OFFICE

CERTIFICATE OF CORRECTION

PATENT NO. : 6,899,790 B2
DATED : May 31, 2005
INVENTOR(S) : Jeffrey A. Lee

It is certified that error appears in the above-identified patent and that said Letters Patent is hereby corrected as shown below:

Column 42,
Line 34, change “weighted” to -- weighed --;

Column 43,
Line 22, change “as” to -- was --;
Line 24, change “reduced” to -- produced --;
Line 27, insert -- was -- after “headbox”;
Line 40, insert -- of -- before “curled”;

Column 47,
Line 59, change “in ex” to -- index --;

Column 48,
Line 24, change “3 minutes” to -- 30 minutes --; and

Column 50,
Line 12, insert -- low -- before “consistency”.

Signed and Sealed this

Twenty-second Day of November, 2005

JON W. DUDAS
*Director of the United States Patent and Trademark Office*